US009328578B2

(12) United States Patent
Kumaran et al.

(10) Patent No.: US 9,328,578 B2
(45) Date of Patent: May 3, 2016

(54) METHOD FOR AUTOMATIC CONTROL AND POSITIONING OF AUTONOMOUS DOWNHOLE TOOLS

(75) Inventors: Krishnan Kumaran, Raritan, NJ (US); Niranjan A. Subrahmanya, Three Bridges, NJ (US); Pavlin B. Entchev, Moscow (RU); Randy C. Tolman, Spring, TX (US); Renzo Moises Angeles Boza, Houston, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 387 days.

(21) Appl. No.: 13/989,726

(22) PCT Filed: Nov. 17, 2011

(86) PCT No.: PCT/US2011/061221

§ 371 (c)(1),
(2), (4) Date: May 24, 2013

(87) PCT Pub. No.: WO2012/082302

PCT Pub. Date: Jun. 21, 2012

(65) Prior Publication Data

US 2013/0255939 A1 Oct. 3, 2013

Related U.S. Application Data

(60) Provisional application No. 61/424,285, filed on Dec. 17, 2010.

(51) Int. Cl.

| | |
|---|---|
| ***E21B 23/00*** | (2006.01) |
| ***E21B 41/00*** | (2006.01) |
| ***E21B 43/116*** | (2006.01) |
| ***E21B 47/09*** | (2012.01) |

(52) U.S. Cl.
CPC ..... *E21B 23/00* (2013.01); *E21B 41/00* (2013.01); *E21B 43/116* (2013.01); *E21B 47/0905* (2013.01)

(58) Field of Classification Search
None
See application file for complete search history.

(56) References Cited

U.S. PATENT DOCUMENTS

| | | | |
|---|---|---|---|
| 3,396,786 | A | 8/1968 | Schuster et al. |
| 4,194,561 | A | 3/1980 | Stokley et al. |
| 4,658,902 | A | 4/1987 | Wesson et al. |
| 5,361,838 | A | 11/1994 | Kilgore |
| 5,705,812 | A | 1/1998 | Brewer et al. |

(Continued)

FOREIGN PATENT DOCUMENTS

| | | |
|---|---|---|
| WO | WO 2011/149597 | 12/2011 |
| WO | WO 2011/150251 | 12/2011 |
| WO | WO 2012/082304 | 6/2012 |

*Primary Examiner* — Jennifer H Gay
*Assistant Examiner* — Caroline Butcher
(74) *Attorney, Agent, or Firm* — ExxonMobil Upstream Research-Law Department

(57) ABSTRACT

Methods and apparatus for actuating a downhole tool in wellbore includes acquiring a CCL data set or log from the wellbore that correlates recorded magnetic signals with measured depth, and selects a location within the wellbore for actuation of a wellbore device. The CCL log is then downloaded into an autonomous tool. The tool is programmed to sense collars as a function of time, thereby providing a second CCL log. The autonomous tool also matches sensed collars with physical signature from the first CCL log and then self-actuates the wellbore device at the selected location based upon a correlation of the first and second CCL logs.

33 Claims, 37 Drawing Sheets

(56) References Cited

U.S. PATENT DOCUMENTS

| | | | |
|---|---|---|---|
| 5,909,774 | A | 6/1999 | Griffith et al. |
| 6,056,055 | A | 5/2000 | Falconer et al. |
| 6,151,961 | A | 11/2000 | Huber et al. |
| 6,378,627 | B1 | 4/2002 | Tubel et al. |
| 6,394,184 | B2 | 5/2002 | Tolman et al. |
| 6,513,599 | B1 | 2/2003 | Bixenman et al. |
| 6,543,280 | B2 | 4/2003 | Duhon |
| 6,543,538 | B2 | 4/2003 | Tolman et al. |
| 6,581,689 | B2 | 6/2003 | Hailey, Jr. |
| 6,601,646 | B2 | 8/2003 | Streich et al. |
| 6,752,206 | B2 | 6/2004 | Watson et al. |
| 6,789,623 | B2 | 9/2004 | Hill, Jr. et al. |
| 6,817,410 | B2 | 11/2004 | Wetzel et al. |
| 6,830,104 | B2 | 12/2004 | Nguyen et al. |
| 6,843,317 | B2 | 1/2005 | Mackenzie |
| 6,845,819 | B2 | 1/2005 | Barrett et al. |
| 6,896,056 | B2 | 5/2005 | Mendez et al. |
| 6,935,432 | B2 | 8/2005 | Nguyen |
| 6,953,094 | B2 | 10/2005 | Ross et al. |
| 6,983,796 | B2 | 1/2006 | Bayne et al. |
| 6,997,263 | B2 | 2/2006 | Campbell et al. |
| 7,055,598 | B2 | 6/2006 | Ross et al. |
| 7,096,945 | B2 | 8/2006 | Richards et al. |
| 7,100,691 | B2 | 9/2006 | Nguyen et al. |
| 7,252,142 | B2 | 8/2007 | Brezinski et al. |
| 7,264,061 | B2 | 9/2007 | Dybevik et al. |
| 7,325,616 | B2 | 2/2008 | Lopez de Cardenas et al. |
| 7,363,967 | B2 | 4/2008 | Burris, II et al. |
| 7,367,395 | B2 | 5/2008 | Vidrine et al. |
| 7,385,523 | B2 | 6/2008 | Thomeer et al. |
| 7,407,007 | B2 | 8/2008 | Tibbles |
| 7,431,085 | B2 | 10/2008 | Coronado et al. |
| 7,431,098 | B2 | 10/2008 | Ohmer et al. |
| 7,441,605 | B2 | 10/2008 | Coronado et al. |
| 7,562,709 | B2 | 7/2009 | Saebi et al. |
| 7,591,321 | B2 | 9/2009 | Whitsitt et al. |
| 7,617,558 | B2 | 11/2009 | Boe |
| 7,703,507 | B2 | 4/2010 | Strickland |
| 7,814,970 | B2 | 10/2010 | Strickland |
| 8,037,934 | B2 | 10/2011 | Strickland |
| 8,162,051 | B2 | 4/2012 | Strickland |
| 8,272,439 | B2 | 9/2012 | Strickland |
| 2002/0093431 | A1 | 7/2002 | Zierolf |
| 2003/0010495 | A1 | 1/2003 | Mendez et al. |
| 2004/0007829 | A1 | 1/2004 | Ross |
| 2004/0221993 | A1 | 11/2004 | Patterson et al. |
| 2004/0239521 | A1 | 12/2004 | Zierolf |
| 2005/0241824 | A1 | 11/2005 | Burris et al. |
| 2005/0241835 | A1 | 11/2005 | Burris et al. |
| 2005/0263287 | A1 | 12/2005 | Achee, Jr. et al. |
| 2005/0269083 | A1 | 12/2005 | Burris, II et al. |
| 2007/0056750 | A1 | 3/2007 | John et al. |
| 2008/0053658 | A1 | 3/2008 | Wesson et al. |
| 2008/0089175 | A1 | 4/2008 | Miszewski |
| 2008/0125335 | A1 | 5/2008 | Bhavsar |
| 2008/0142222 | A1 | 6/2008 | Howard et al. |
| 2008/0196896 | A1 | 8/2008 | Bustos et al. |
| 2008/0257546 | A1 | 10/2008 | Cresswell et al. |
| 2009/0084556 | A1 | 4/2009 | Richards et al. |
| 2009/0114392 | A1 | 5/2009 | Tolman et al. |
| 2009/0120637 | A1 | 5/2009 | Kirkwood et al. |
| 2009/0159279 | A1 | 6/2009 | Assal |
| 2009/0248307 | A1 | 10/2009 | Barrow et al. |
| 2009/0276094 | A1 | 11/2009 | De Guzman et al. |
| 2009/0283279 | A1 | 11/2009 | Patel et al. |
| 2009/0301723 | A1 | 12/2009 | Gray |
| 2011/0035152 | A1 | 2/2011 | Durocher et al. |
| 2011/0297369 | A1 | 12/2011 | Kumaran et al. |
| 2013/0062055 | A1* | 3/2013 | Tolman ..... E21B 23/00 166/250.01 |

* cited by examiner

METHOD FOR AUTOMATIC CONTROL AND POSITIONING OF AUTONOMOUS DOWNHOLE TOOLS

STATEMENT OF RELATED APPLICATIONS

This application is the National Stage of International Application No. PCT/US11/61221, filed Nov. 17, 2011, which claims the benefit of U.S. Provisional Application 61/424,285, filed Dec. 17, 2010, the entirety of which is incorporated herein by reference for all purposes.

This application is related to U.S. Provisional Pat. Appl. No. 61/348,578, which was filed on May 26, 2010, which generated International Application No. PCT/US2011/031948, filed Apr. 11, 2011 and International Application No. PCT/US2011/038202, filed May 26, 2011 and U.S. application Ser. No. 13/697,769, filed Nov. 13, 2012. That application is titled "Assembly And Method For Multi-Zone Fracture Stimulation of A Reservoir Using Autonomous Tubular Units," and is incorporated herein in its entirety by reference.

BACKGROUND OF THE INVENTION

This section is intended to introduce various aspects of the art, which may be associated with exemplary embodiments of the present disclosure. This discussion is believed to assist in providing a framework to facilitate a better understanding of particular aspects of the present disclosure. Accordingly, it should be understood that this section should be read in this light, and not necessarily as admissions of prior art.

FIELD OF THE INVENTION

This invention relates generally to the field of perforating and treating subterranean formations to enable the production of oil and gas therefrom. More specifically, the invention provides a method for remotely actuating an autonomous downhole tool to assist in perforating, isolating, or treating one interval or multiple intervals sequentially.

GENERAL DISCUSSION OF TECHNOLOGY

In the drilling of oil and gas wells, a wellbore is formed using a drill bit that is urged downwardly at a lower end of a drill string. After drilling to a predetermined depth, the drill string and bit are removed and the wellbore is lined with a string of casing. An annular area is thus formed between the string of casing and the surrounding formations.

A cementing operation is typically conducted in order to fill or "squeeze" the annular area with cement. This serves to form a cement sheath. The combination of cement and casing strengthens the wellbore and facilitates the isolation of the formations behind the casing.

It is common to place several strings of casing having progressively smaller outer diameters into the wellbore. Thus, the process of drilling and then cementing progressively smaller strings of casing is repeated several or even multiple times until the well has reached total depth. The final string of casing, referred to as a production casing, is cemented into place. In some instances, the final string of casing is a liner, that is, a string of casing that is not tied back to the surface, but is hung from the lower end of the preceding string of casing.

As part of the completion process, the production casing is perforated at a desired level. This means that lateral holes are shot through the casing and the cement sheath surrounding the casing. This provides fluid communication between the wellbore and the surrounding subsurface intervals, and allows hydrocarbon fluids to flow into the wellbore. Thereafter, the formation is typically fractured.

Hydraulic fracturing consists of injecting viscous fluids into a subsurface interval at such high pressures and rates that the reservoir rock fails and forms a network of fractures. The fracturing fluid is typically a shear thinning, non-Newtonian gel or emulsion. The fracturing fluid is typically mixed with a granular proppant material such as sand, ceramic beads, or other granular materials. The proppant serves to hold the fracture(s) open after the hydraulic pressures are released. The combination of fractures and injected proppant increases the flow capacity of the treated reservoir.

In order to further stimulate the formation and to clean the near-wellbore regions downhole, an operator may choose to "acidize" the formations. This is done by injecting an acid solution down the wellbore and through the perforations. The use of an acidizing solution is particularly beneficial when the formation comprises carbonate rock. In operation, the drilling company injects a concentrated formic, acetic acid, or other acidic composition into the wellbore, and directs the fluid into selected zones of interest. The acid helps to dissolve carbonate material, thereby opening up porous channels through which hydrocarbon fluids may flow into the wellbore. In addition, the acid helps to dissolve drilling mud that may have invaded the near-wellbore region.

Application of hydraulic fracturing and acid stimulation as described above is a routine part of petroleum industry operations as applied to individual target zones. Such target zones may represent up to about 60 meters (200 feet) of gross, vertical thickness of subterranean formation. When there are multiple or layered reservoirs to be hydraulically fractured, or a very thick hydrocarbon-bearing formation, such as over about 40 meters (135 feet), then more complex treatment techniques are required to obtain treatment of the entire target formation. In this respect, the operating company must isolate various zones to ensure that each separate zone is not only perforated, but adequately fractured and treated. In this way, the operator is able to direct fracturing fluid and stimulant through each set of perforations and into each zone of interest to effectively increase the flow capacity along all zones.

The isolation of various zones for pre-production treatment requires that the intervals be treated in stages. This, in turn, involves the use of so-called diversion methods. In petroleum industry terminology, "diversion" means that injected fluid is diverted from entering one set of perforations so that the fluid primarily enters only one selected zone of interest. Where multiple zones of interest are to be perforated, this requires that multiple stages of diversion be carried out.

In order to isolate selected zones of interest, various diversion techniques may be employed within the wellbore. Known diversion techniques include the use of:

- Mechanical devices such as bridge plugs, packers, downhole valves, sliding sleeves, and baffle/plug combinations;
- Ball sealers;
- Particulates such as sand, ceramic material, proppant, salt, waxes, resins, or other compounds; and
- Chemical systems such as viscosified fluids, gelled fluids, foams, or other chemically formulated fluids.

These methods for temporarily blocking the flow of fluids into or out of a given set of perforations are described more fully in U.S. Pat. No. 6,394,184, entitled "Method and Apparatus for Stimulation of Multiple Formation Intervals", issued in 2002. The '184 patent is referred to and incorporated herein by reference in its entirety.

The '184 patent also discloses novel techniques for running a bottom hole assembly ("BHA") into a wellbore, and then creating fluid communication between the wellbore and various zones of interest. In most embodiments, the BHA's include various perforating guns having associated charges. The BHA's further include a wireline extending from the surface and to the assembly for providing electrical signals to the perforating guns. The electrical signals allow the operator to cause the charges to detonate, thereby forming perforations.

The BHA's also include a set of mechanically actuated, re-settable axial position locking devices, or slips. The illustrative slips are actuated through a "continuous J" mechanism by cycling the axial load between compression and tension. The BHA's further include an inflatable packer or other sealing mechanism. The packer is actuated by application of a slight compressive load after the slips are set within the casing. The packer is resettable so that the BHA may be moved to different depths or locations along the wellbore so as to isolate selected perforations.

The BHA also includes a casing collar locator. The casing collar locator allows the operator to monitor the depth or location of the assembly for appropriately detonating charges. After the charges are detonated so that the casing is penetrated for fluid communication with a surrounding zone of interest, the BHA is moved so that the packer may be set at a new depth. The casing collar locator allows the operator to move the BHA to an appropriate depth relative to the newly formed perforations, and then isolate those perforations for hydraulic fracturing and chemical treatment.

Each of the various embodiments for a BHA disclosed in the '184 patent includes a means for deploying the assembly into the wellbore, and then translating the assembly up and down the wellbore. Such translation means include a string of coiled tubing, conventional jointed tubing, a wireline, an electric line, or a downhole tractor. In any instance, the purpose of the bottom hole assemblies is to allow the operator to perforate the casing along various zones of interest, and then sequentially isolate the respective zones of interest so that fracturing fluid may be injected into the zones of interest in the same trip.

Well completion processes such as the process described in the '184 patent require the use of surface equipment. FIG. 1 presents a side view of a well site 100 wherein a well is being drilled. The well site 100 is using known surface equipment 50 to support wellbore tools (not shown) above and within a wellbore 10. The wellbore tools may be, for example, a perforating gun or a fracturing plug.

The surface equipment 50 first includes a lubricator 52. The lubricator 52 defines an elongated tubular device configured to receive wellbore tools (or a string of wellbore tools), and introduce them into the wellbore 10. In general, the lubricator 52 must be of a length greater than the length of the perforating gun assembly (or other tool string) to allow the perforating gun assembly to be safely deployed in the wellbore 100 under pressure.

The lubricator 52 delivers the tool string in a manner where the pressure in the wellbore 10 is controlled and maintained. With readily-available existing equipment, the height to the top of the lubricator 52 can be approximately 100 feet from an earth surface 105. Depending on the overall length requirements, other lubricator suspension systems (fit-for-purpose completion/workover rigs) may also be used. Alternatively, to reduce the overall surface height requirements, a downhole lubricator system similar to that described in U.S. Pat. No. 6,056,055 issued May 2, 2000 may be used as part of the surface equipment 50 and completion operations.

A wellhead 70 is provided above the wellbore 10 at the earth surface 105. The wellhead 70 is used to selectively seal the wellbore 10. During completion, the wellhead 10 includes various spooling components, sometimes referred to as spool pieces. The wellhead 70 and its spool pieces are used for flow control and hydraulic isolation during rig-up operations, stimulation operations, and rig-down operations.

The spool pieces may include a crown valve 72. The crown valve 72 is used to isolate the wellbore 10 from the lubricator 52 or other components above the wellhead 70. The spool pieces also include a lower master fracture valve 125 and an upper master fracture valve 135. These lower 125 and upper 135 master fracture valves provide valve systems for isolation of wellbore pressures above and below their respective locations. Depending on site-specific practices and stimulation job design, it is possible that one of these isolation-type valves may not be needed or used.

The wellhead 70 and its spool pieces may also include side outlet injection valves 74. The side outlet injection valves 74 provide a location for injection of stimulation fluids into the wellbore 10. The piping from surface pumps (not shown) and tanks (not shown) used for injection of the stimulation fluids are attached to the injection valves 74 using appropriate fittings and/or couplings.

The lubricator 52 is suspended over the wellbore 10 by means of a crane arm 54. The crane arm 54 is supported over the earth surface 105 by a crane base 56. The crane base 56 may be a working vehicle that is capable of transporting part or all of the crane arm 54 over a roadway. The crane arm 54 includes wires or cables 58 used to hold and manipulate the lubricator 52 into and out of position over the wellbore 10. The crane arm 54 and crane base 56 are designed to support the load of the lubricator 52 and any load requirements anticipated for the completion operations.

In the view of FIG. 1, the lubricator 52 has been set down over the wellbore 10. An upper portion of an illustrative wellbore 10 is seen. The wellbore 10 defines a bore 5 that extends from the surface 105 of the earth, and into the earth's subsurface 110.

The wellbore 10 is first formed with a string of surface casing 20. The surface casing 20 has an upper end 22 in sealed connection with the lower master fracture valve 125. The surface casing 20 also has a lower end 24. The surface casing 20 is secured in the wellbore 10 with a surrounding cement sheath 25.

The wellbore 10 also includes a string of production casing 30. The production casing 30 is also secured in the wellbore 10 with a surrounding cement sheath 35. The production casing 30 has an upper end 32 in sealed connection with the upper master fracture valve 135. The production casing 30 also has a lower end (not shown). It is understood that the depth of the wellbore 10 preferably extends some distance below a lowest zone or subsurface interval to be stimulated to accommodate the length of the downhole tool, such as a perforating gun assembly.

Referring again to the surface equipment 50, the surface equipment 50 also includes a wireline 85. The downhole tool (not shown) is attached to the end of the wireline 85. To protect the wireline 85, the wellhead 70 may include a wireline isolation tool 76. The wireline isolation tool 76 provides a means to guard the wireline 85 from direct flow of proppant-laden fluid injected into the side outlet injection valves 74 during a formation fracturing procedure.

The surface equipment 50 is also shown with a blow-out preventer 60. The blow-out preventer 60 is typically remotely actuated in the event of operational upsets. The lubricator 52, the crane arm 54, the crane base 56, the wireline 85, and the blow-out preventer 60 (and their associated ancillary control and/or actuation components) are standard equipment known to those skilled in the art of well completion.

It is understood that the various items of surface equipment 50 and components of the wellhead 70 are merely illustrative. A typical completion operation will include numerous valves, pipes, tanks, fittings, couplings, gauges, pumps, and other devices. Further, downhole equipment may be run into and out of the wellbore using an electric line, coiled tubing, or a tractor.

The lubricator 52 and other items of surface equipment 50 are used to deploy various downhole tools such as fracturing plugs and perforating guns. Beneficially, the present inventions include apparatus and methods for seamlessly perforating and stimulating subsurface formations at sequential intervals. Such technology may be referred to herein as "Just-In-Time-Perforating" (JITP). The JITP process allows an operator to fracture a well at multiple intervals with limited or even no "trips" out of the wellbore. The process has particular benefit for multi-zone fracture stimulation of tight gas reservoirs having numerous lenticular sand pay zones. For example, the JITP process is currently being used to recover hydrocarbon fluids in the Piceance basin.

The JITP technology is the subject of U.S. Pat. No. 6,543,538, entitled "Method for Treating Multiple Wellbore Intervals." The '538 patent issued Apr. 8, 2003, and is incorporated by reference herein in its entirety. In one embodiment, the '538 patent generally teaches:

- using a perforating device, perforating at least one interval of one or more subterranean formations traversed by a wellbore;
- pumping treatment fluid through the perforations and into the selected interval without removing the perforating device from the wellbore;
- deploying or activating an item or substance in the wellbore to removably block further fluid flow into the treated perforations; and
- repeating the process for at least one more interval of the subterranean formation.

The technologies disclosed in the '184 patent and the '538 patent provide stimulation treatments to multiple subsurface formation targets within a single wellbore. In particular, the techniques: (1) enable stimulation of multiple target zones or regions via a single deployment of downhole equipment; (2) enable selective placement of each stimulation treatment for each individual zone to enhance well productivity; (3) provide diversion between zones to ensure each zone is treated per design and previously treated zones are not inadvertently damaged; and (4) allow for stimulation treatments to be pumped at relatively high flow rates to facilitate efficient and effective stimulation. As a result, these multi-zone stimulation techniques enhance hydrocarbon recovery from subsurface formations that contain multiple stacked subsurface intervals.

While these multi-zone stimulation techniques provide for a more efficient completion process, they nevertheless typically involve the use of long, wireline-conveyed perforating guns. The use of such perforating guns presents various challenges, most notably, difficulty in running a long assembly of perforating guns through a lubricator and into the wellbore. In addition, pump rates are limited by the presence of the wireline in the wellbore during hydraulic fracturing due to friction or drag created on the wire from the abrasive hydraulic fluid. Further, cranes and wireline equipment present on location occupy needed space and create added completion expenses, thereby lowering the overall economics of a well-drilling project.

Therefore, a need exists for downhole tools that may be deployed within a wellbore without a lubricator and a crane arm. Further, a need exists for tools that may be deployed in a string of production casing or other tubular body that are autonomous, that is, they are not electrically controlled from the surface. Further, a need exists for methods for perforating and treating multiple intervals along a wellbore without being limited by pump rate.

SUMMARY OF THE INVENTION

The assemblies and methods described herein have various benefits in the conducting of oil and gas exploration and production activities. First, a method of actuating a downhole tool in a wellbore is provided. In accordance with the method, the wellbore has casing collars that form a physical signature for the wellbore.

The method first includes acquiring a CCL data set from the wellbore. The CCL data set correlates continuously recorded magnetic signals with measured depth. In this way, a first CCL log for the wellbore is formed.

The method also includes selecting a location within the wellbore for actuation of a wellbore device. The wellbore device may be, for example a bridge plug, a cement plug, a fracturing plug, or a perforating gun. The wellbore device is part of the downhole tool.

The method further comprises downloading the first CCL log into a processor. The processor is also part of the downhole tool. The method then includes deploying the downhole tool into the wellbore. The downhole tool traverses casing collars, and senses the casing collars using its own casing collar locator.

The processor in the downhole tool is programmed to continuously record magnetic signals as the downhole tool traverses the casing collars. In this way, a second CCL log is formed. The processor, or on-board controller, transforms the recorded magnetic signals of the second CCL log by applying a moving windowed statistical analysis. Further, the processor incrementally compares the transformed second CCL log with the first CCL log during deployment of the downhole tool to correlate values indicative of casing collar locations. This is preferably done through a pattern matching algorithm. The algorithm correlates individual peaks or even groups of peaks representing casing collar locations. In addition, the processor is programmed to recognize the selected location in the wellbore, and then send an actuation signal to the actuatable wellbore device when the processor has recognized the selected location.

The method further then includes sending the actuation signal. Sending the actuation signal actuates the wellbore device. In this way, the downhole tool is autonomous, meaning that it is not tethered to the surface for receiving the actuation signal.

In one embodiment, the method further comprises transforming the CCL data set for the first CCL log. This also is done by applying a moving windowed statistical analysis. The first CCL log is downloaded into the processor as a first transformed CCL log. In this embodiment, the processor incrementally compares the second transformed CCL log with the first transformed CCL log to correlate values indicative of casing collar locations.

In the above embodiments, applying a moving windowed statistical analysis preferably comprises defining a pattern window size for sets of magnetic signal values, and then computing a moving mean m(t+1) for the magnetic signal values over time. The moving mean m(t+1) is preferably in vector form, and represents an exponentially weighted moving average for the magnetic signal values for the pattern windows. Applying a moving windowed statistical analysis then further comprises defining a memory parameter μ for the windowed statistical analysis, and calculating a moving covariance matrix Σ(t+1) for the magnetic signal values over time.

In one arrangement for the method, calculating a moving covariance matrix Σ(t+1) for the magnetic signal values comprises:

computing an exponentially weighted moving second moment A(t+1) for the magnetic signal values in a most recent pattern window (W+1); and computing the moving covariance matrix Σ(t+1) based upon the exponentially weighted second moment A(t+1).

Computing an exponentially weighted second moment A(t+1) may be done according to the following equation:

$$A(t+1)=\mu y(t+1)\times[y(t+1)]^T+(1-\mu)A(t),$$

while computing the moving covariance matrix Σ(t+1) is done according to the following equation:

$$\Sigma(t+1)=A(t+1)-m(t+1)\times[m(t+1)]^T.$$

In another embodiment, applying a moving windowed statistical analysis further comprises:

computing an initial Residue R(t) for when the downhole tool is deployed;

computing a moving Residue R(t+1) over time; and computing a moving Threshold T(t+1) based on the moving Residue R(t+1).

Computing the initial Residue R(t) is preferably done according to the following equation:

$$R(t)=[y(t)-m(t-1)]^T\times[\Sigma(t-1)^{-1}\times[y(t)-m(t-1)]$$

where

R(t) is a single, unitless number, y(t) is a vector representing a collection of magnetic signal values for a present pattern window (W), and m(t−1) is a vector representing the mean for a collection of magnetic signal values for a preceding pattern window (W−1).

Computing the moving Threshold T(t+1) is preferably done is done according to the following equation:

$$T(t+1)=\mathrm{MR}(t+1)+\mathrm{STD_Factor}\times\mathrm{STDR}(t+1)$$

where

MR(t) is the Moving Residue at a preceding pattern window,

MR(t+1) is the Moving Residue at a present pattern window,

STDR(t+1) is the Standard Deviation of the Residue R(t) at the present pattern window based upon SR(t+1), and SR(t+1) is the Second Moment of Residue at the present pattern window.

As noted, the processor may incrementally compare the transformed second CCL log with the first CCL log to correlate values indicative of casing collar locations using a pattern matching algorithm. In one aspect, the collar pattern matching algorithm comprises:

establishing baseline references for depth from the first CCL log, and for time from the transformed second CCL log;

estimating an initial velocity $v_1$ of the autonomous tool;

updating a collar matching index from a last confirmed collar match, indexed to be $d_k$ for the depth, and $t_l$ for the time;

determining a next match of casing collars using an iterative process of convergence;

updating the indices; and repeating the iterative process.

Estimating an initial velocity $v_1$ of the autonomous tool may comprise:

assuming a first depth $d_1$ matches a first time $t_1$;

assuming a second depth $d_2$ matches a second time $t_2$; and calculating the estimated initial velocity using the following equation:

$$v_1=\frac{d_2-d_1}{t_2-t_1}$$

A tool assembly for performing an operation in a wellbore is also provided herein. Such an operation may represent, for example, a completion operation or a remediation operation. Again, the wellbore is completed with casing collars that form a physical signature for the wellbore. The wellbore may optionally have short joints or pup joints to serve as confirmatory markers.

In one embodiment, the tool assembly first includes an actuatable tool. The actuatable tool may be, for example, a fracturing plug, a bridge plug, a cutting tool, a casing patch, a cement retainer, or a perforating gun.

The tool assembly also includes a casing collar locator, or CCL sensor. The casing collar locator senses location within the tubular body based on a physical signature provided along the tubular body. More specifically, the sensor senses changes in magnetic flux along the casing, indicative of collars, and generates a current. The physical signature is formed by the spacing of the collars along the tubular body.

The tool assembly further comprises an on-board controller. The on-board controller has stored in memory a first CCL log. The first CCL log represents magnetic signals pre-recorded from the wellbore.

The on-board controller is programmed to perform the functions described above in connection with the method for actuating a downhole tool. The controller is beneficially configured to send an actuation signal to the actuatable tool when the CCL sensor has recognized a selected location in the wellbore relative to the casing collars. For example, the controller continuously records magnetic signals as the tool assembly traverses the casing collars, forming a second CCL log. The controller transforms the recorded magnetic signals of the second CCL log by applying a moving windowed statistical analysis. The controller then incrementally compares the transformed second CCL log with the first CCL log during deployment of the downhole tool to correlate values indicative of casing collar locations.

The actuatable tool, the casing collar locator, and the on-board controller are together dimensioned and arranged to be deployed in the tubular body as an autonomous unit. In this respect, the actuatable tool is automatically actuated without need of an external force or signal from the surface. Instead, the on-board controller recognizes the selected location in the wellbore, and sends an actuation signal to the actuatable tool component when the controller has recognized the selected location. The actuatable tool then performs the wellbore operation.

It is preferred that the tool assembly be fabricated from a friable material. The tool assembly self-destructs in response to a designated event. Thus, where the tool is a fracturing plug, the tool assembly may self-destruct within the wellbore at a designated time after being set. Where the tool is a perforating gun, the tool assembly may self-destruct as the gun is being fired upon reaching a selected level or depth.

The tool assembly may include a fishing neck. This allows the operator to retrieve the tool in the event it becomes stuck or fails to fire. The tool assembly will also preferably have a battery pack for providing power to the controller and any tool-setting components.

Where the actuatable tool is a fracturing plug or a bridge plug, the plug may have an elastomeric sealing element. When the tool is actuated, the sealing element, which is generally in the configuration of a ring, is expanded to form a substantial fluid seal within the tubular body at a selected location. The plug may also have a set of slips for holding the location of the tool assembly proximate the selected location.

Where the actuatable tool is a perforating gun, it is preferred that the perforating gun assembly include a safety system for preventing premature detonation of the associated charges of the perforating gun.

BRIEF DESCRIPTION OF THE DRAWINGS

So that the present inventions can be better understood, certain drawings, charts, graphs and/or flow charts are appended hereto. It is to be noted, however, that the drawings illustrate only selected embodiments of the inventions and are therefore not to be considered limiting of scope, for the inventions may admit to other equally effective embodiments and applications.

In FIG. 6A, an autonomous tool representing a combined plug assembly and perforating gun assembly is falling down the wellbore.

In FIG. 6B, the plug body of the plug assembly has been actuated, causing the autonomous tool to be seated in the wellbore at a selected depth. The perforating gun assembly is ready to fire.

FIG. 14A shows magnetic responses for a casing collar locator in an autonomous tool as it is deployed in a portion of a wellbore. This is compared to a Residue value R(t) along the wellbore. The Residue value R(t) represents a transformed signal.

FIG. 14B shows the readings of FIG. 14A as applied to a Threshold T(t). The Threshold T(t) is a moving threshold value.

FIG. 17A is a Cartesian graph that plots collar location with depth. Lines for the first CCL log and the transformed second CCL log substantially overlap.

FIG. 17B demonstrates magnetic signal readings along a three foot section of a wellbore. This is from the first, or base, CCL log, shown as a function of depth.

FIG. 17C demonstrates magnetic signal readings along the same three-foot section of wellbore for the second CCL log. The transformed second log, or Residue(t), is overlaid onto the signal readings. FIG. 17C demonstrates the use of a collar pattern matching algorithm for the method of FIG. 15, in one embodiment

DETAILED DESCRIPTION OF CERTAIN EMBODIMENTS

Definitions

Figure 1:
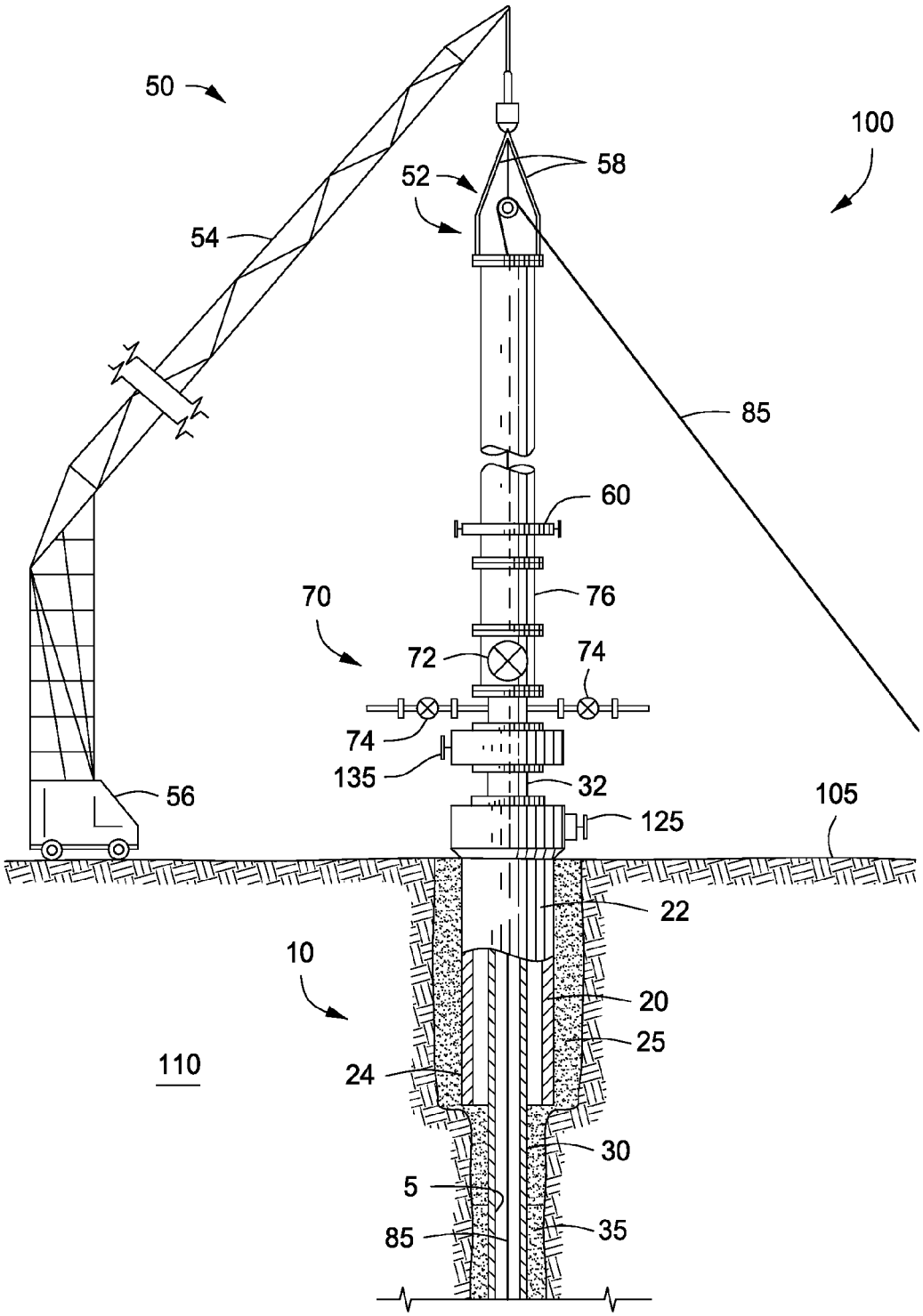
FIG. 1 (PRIOR ART)
FIG. 1 presents a side view of a well site wherein a well is being completed. Known surface equipment is provided to support wellbore tools (not shown) above and within a wellbore. This is a depiction of the prior art.

As used herein, the term "hydrocarbon" refers to an organic compound that includes primarily, if not exclusively, the elements hydrogen and carbon. Hydrocarbons may also include other elements, such as, but not limited to, halogens, metallic elements, nitrogen, oxygen, and/or sulfur. Hydrocarbons generally fall into two classes: aliphatic, or straight chain hydrocarbons, and cyclic, or closed ring hydrocarbons, including cyclic terpenes. Examples of hydrocarbon-containing materials include any form of natural gas, oil, coal, and bitumen that can be used as a fuel or upgraded into a fuel.

As used herein, the term "hydrocarbon fluids" refers to a hydrocarbon or mixtures of hydrocarbons that are gases or liquids. For example, hydrocarbon fluids may include a hydrocarbon or mixtures of hydrocarbons that are gases or liquids at formation conditions, at processing conditions or at ambient conditions (15° C. and 1 atm pressure). Hydrocarbon fluids may include, for example, oil, natural gas, coalbed methane, shale oil, pyrolysis oil, pyrolysis gas, a pyrolysis product of coal, and other hydrocarbons that are in a gaseous or liquid state.

As used herein, the terms "produced fluids" and "production fluids" refer to liquids and/or gases removed from a subsurface formation, including, for example, an organic-rich rock formation. Produced fluids may include both hydrocarbon fluids and non-hydrocarbon fluids. Production fluids may include, but are not limited to, oil, natural gas, pyrolyzed shale oil, synthesis gas, a pyrolysis product of coal, carbon dioxide, hydrogen sulfide and water.

As used herein, the term "fluid" refers to gases, liquids, and combinations of gases and liquids, as well as to combinations of gases and solids, combinations of liquids and solids, and combinations of gases, liquids, and solids.

As used herein, the term "gas" refers to a fluid that is in its vapor phase.

As used herein, the term "oil" refers to a hydrocarbon fluid containing primarily a mixture of condensable hydrocarbons.

As used herein, the term "subsurface" refers to geologic strata occurring below the earth's surface.

As used herein, the term "formation" refers to any definable subsurface region. The formation may contain one or more hydrocarbon-containing layers, one or more non-hydrocarbon containing layers, an overburden, and/or an underburden of any geologic formation.

The term "zone" or "zone of interest" refers to a portion of a formation containing hydrocarbons. Alternatively, the formation may be a water-bearing interval.

For purposes of the present patent, the term "production casing" includes one or more joints of casing, a liner string, or any other tubular body fixed in a wellbore along a zone of interest.

The term "friable" means any material that is easily crumbled, powderized, or broken into very small pieces. The term "friable" includes frangible materials such as ceramic.

The term "millable" means any material that may be drilled or ground into pieces within a wellbore. Such materials may include aluminum, brass, cast iron, steel, ceramic, phenolic, composite, and combinations thereof.

The term "magnetic signals' refers to electrical signals created by the presence of magnetic flux, or a change in magnetic flux. Such changes create current that may be detected and measured.

As used herein, the term "moving windowed statistical analysis" means any process wherein a moving group of substantially adjacent values is selected, and one or more representative values of that group is determined. The moving group may be selected, for example, at designated time intervals, and the representative value(s) may be, for example, an average or a co-variance matrix.

The term "CCL log" refers to any casing collar log. Unless provided otherwise in the claims, the term "log" includes both raw downhole signal values and processed signal values.

As used herein, the term "wellbore" refers to a hole in the subsurface made by drilling or insertion of a conduit into the subsurface. A wellbore may have a substantially circular cross section, or other cross-sectional shape. As used herein, the term "well," when referring to an opening in the formation, may be used interchangeably with the term "wellbore."

DESCRIPTION OF SELECTED SPECIFIC EMBODIMENTS

The inventions are described herein in connection with certain specific embodiments. However, to the extent that the following detailed description is specific to a particular embodiment or a particular use, such is intended to be illustrative only and is not to be construed as limiting the scope of the inventions.

It is proposed herein to use tool assemblies for well-completion or other tubular operations that are autonomous. In this respect, the tool assemblies do not require a wireline and are not otherwise electrically controlled from the surface. The delivery method of a tool assembly may include gravity, pumping, and tractor delivery.

Various tool assemblies are proposed herein that generally include:

- an actuatable tool;
- a location device for sensing the location of the actuatable tool within a tubular body based on a physical signature provided along the tubular body; and
- an on-board controller configured to send an actuation signal to the tool when the location device has recognized a selected location of the tool based on the physical signature.

The actuatable tool is designed to be actuated to perform a tubular operation in response to the actuation signal.

The actuatable tool, the location device, and the on-board controller are together dimensioned and arranged to be deployed in the tubular body as an autonomous unit. The tubular body is preferably a wellbore constructed to produce hydrocarbon fluids.

Figure 2:
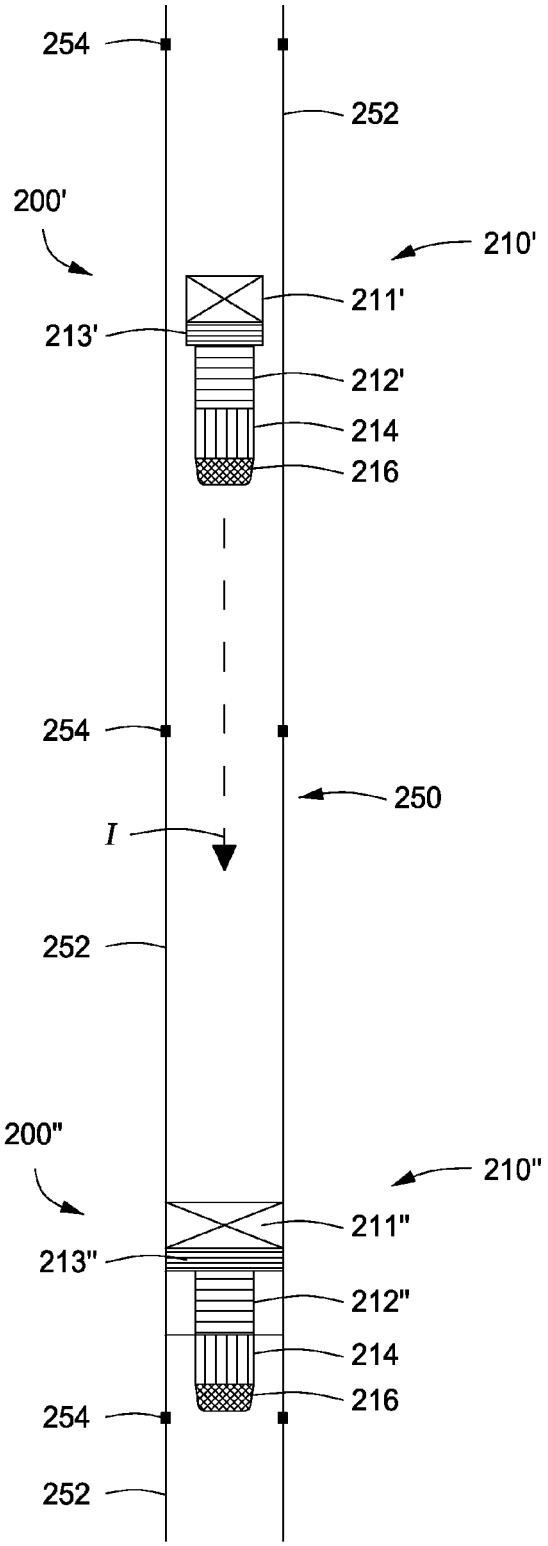
FIG. 2 is a side view of an autonomous tool as may be used for tubular operations, such as operations in a wellbore, without need of the lubricator of FIG. 1. In this view, the tool is a fracturing plug assembly deployed in a string of production casing. The fracturing plug assembly is shown in both a pre-actuated position and an actuated position.

FIG. 2 presents a side view of an illustrative autonomous tool 200' as may be used for tubular operations. In this view, the tool 200' is a fracturing plug assembly, and the tubular operation is a wellbore completion.

The fracturing plug assembly 200' is deployed within a string of production casing 250. The production casing 250 is formed from a plurality of "joints" 252 that are threadedly connected at collars 254. The wellbore completion includes the injection of fluids into the production casing 250 under high pressure.

In FIG. 2, the fracturing plug assembly is shown in both a pre-actuated position and an actuated position. The fracturing plug assembly is shown in a pre-actuated position at 200', and in an actuated position at 200". Arrow "I" indicates the movement of the fracturing plug assembly 200' in its pre-actuated position, down to a location in the production casing 250 where the fracturing plug assembly 200" is in its actuated position. The fracturing plug assembly will be described primarily with reference to its pre-actuated position, at 200'.

The fracturing plug assembly 200' first includes a plug body 210'. The plug body 210' will preferably define an elastomeric sealing element 211' and a set of slips 213'. The elastomeric sealing element 211' is mechanically expanded in response to a shift in a sleeve or other means as is known in the art. The slips 213' also ride outwardly from the assembly 200' along wedges (not shown) spaced radially around the assembly 200'. Preferably, the slips 213' are also urged outwardly along the wedges in response to a shift in the same sleeve or other means as is known in the art. The slips 213' extend radially to "bite" into the casing when actuated, securing the plug assembly 200' in position. Examples of existing plugs with suitable designs are the Smith Copperhead Drillable Bridge Plug and the Halliburton Fas Drill® Frac Plug.

The fracturing plug assembly 200' also includes a setting tool 212'. The setting tool 212' will actuate the slips 213' and the elastomeric sealing element 211' and translate them along the wedges to contact the surrounding casing 250.

In the actuated position for the plug assembly 200", the plug body 210" is shown in an expanded state. In this respect, the elastomeric sealing element 211" is expanded into sealed engagement with the surrounding production casing 250, and the slips 213" are expanded into mechanical engagement with the surrounding production casing 250. The sealing element 211" comprises a sealing ring, while the slips 213" offer grooves or teeth that "bite" into the inner diameter of the casing 250. Thus, in the tool assembly 200", the plug body 210" consisting of the sealing element 211" and the slips 213" defines the actuatable tool.

The fracturing plug assembly 200' also includes a position locator 214. The position locator 214 serves as a location device for sensing the location of the tool assembly 200' within the production casing 250. More specifically, the position locator 214 senses the presence of objects or "tags" along the wellbore 250, and generates depth signals in response.

In the view of FIG. 2, the objects are the casing collars 254. This means that the position locator 214 is a casing collar locator, known in the industry as a "CCL." The CCL senses the location of the casing collars 254 as it moves down the production casing 250. While FIG. 2 presents the position locator 214 schematically as a single CCL, it is understood that the position locator 214 may be an array of casing collar locators.

As a casing collar locator, the position locator 214 measures magnetic signal values as it traverses the production casing 250. These magnetic signal values will fluctuate depending upon the thickness of the surrounding tubular body. As the CCL crosses collars 254, the magnetic signal values will increase. The magnetic signals are recorded as a function of depth.

An operator may pre-run a casing collar locator in a wellbore to obtain a baseline CCL log. The baseline log correlates casing collar location with measured depth. In this way, location for actuating a downhole tool may be determined with reference to the number of collars present to reach the desired location. The resulting CCL log is converted into a suitable data set comprised of digital values representing the magnetic signals. The digital data set is then loaded into the controller 216 as a first CCL log.

It is also noted that each wellbore has its own unique spacing of casing collars. This spacing creates a fingerprint, or physical signature. The physical signature may be beneficially used for launching the fracturing plug assembly 200' into the wellbore 100, and actuating the fracturing plug assembly 200' without electrical signals or mechanical control from the surface.

The fracturing plug assembly 200' also includes an on-board controller 216. The on-board controller 216 processes the depth signals generated by the position locator 214. In one aspect, the on-board controller 216 is programmed to count the casing collars 254 as the downhole tool 200' travels down the wellbore. Alternatively, the on-board controller 216 is programmed to record magnetic signal values, and then transform them using a moving windowed statistical analysis. This represents a transformed second CCL data set. The on-board controller 216 identifies signal peaks, and compares them with peaks from the first CCL log to match casing collars. In either instance, the controller 216 sends an actuation signal to the fracturing plug assembly 200' when a selected depth is reached. More specifically, the actuation signal causes the sealing element 211" and slips 213" to be set.

In some instances, the production casing 250 may be pre-designed to have so-called short joints, that is, selected joints that are only, for example, 15 feet, or 20 feet, in length, as opposed to the "standard" length selected by the operator for completing a well, such as 30 feet. In this event, the on-board controller 216 may use the non-uniform spacing provided by the short joints as a means of checking or confirming a location in the wellbore as the fracturing plug assembly 200' moves through the production casing 250.

Techniques for enabling a controller 216 to know the location of an autonomous tool in a cased wellbore are described in further detail below. The techniques enable the on-board controller 216 to identify the last collar before sending an actuation signal. In this way, the actuatable tool is actuated when the controller 216 determines that the autonomous tool has arrived at a particular depth adjacent a selected zone of interest. In the example of FIG. 2, the on-board controller 216 activates the fracturing plug 210" and the setting tool 212" to cause the fracturing plug assembly 200" to stop moving, and to set in the production casing 250 at a desired depth or location.

In one aspect, the on-board controller 216 includes a timer. The on-board controller 216 is programmed to release the fracturing plug 210" after a designated time. This may be done by causing the sleeve in the setting tool 212" to reverse itself. The fracturing plug assembly 200" may then be flowed back to the surface and retrieved via a pig catcher (not shown) or other such device. Alternatively, the on-board controller 216 may be programmed after a designated period of time to ignite a detonating device, which then causes the fracturing plug assembly 200" to detonate and self-destruct. The detonating device may be a detonating cord, such as the Primacord® detonating cord. In this arrangement, the entire fracturing plug assembly 200" is fabricated from a friable material such as ceramic.

Figure 3:
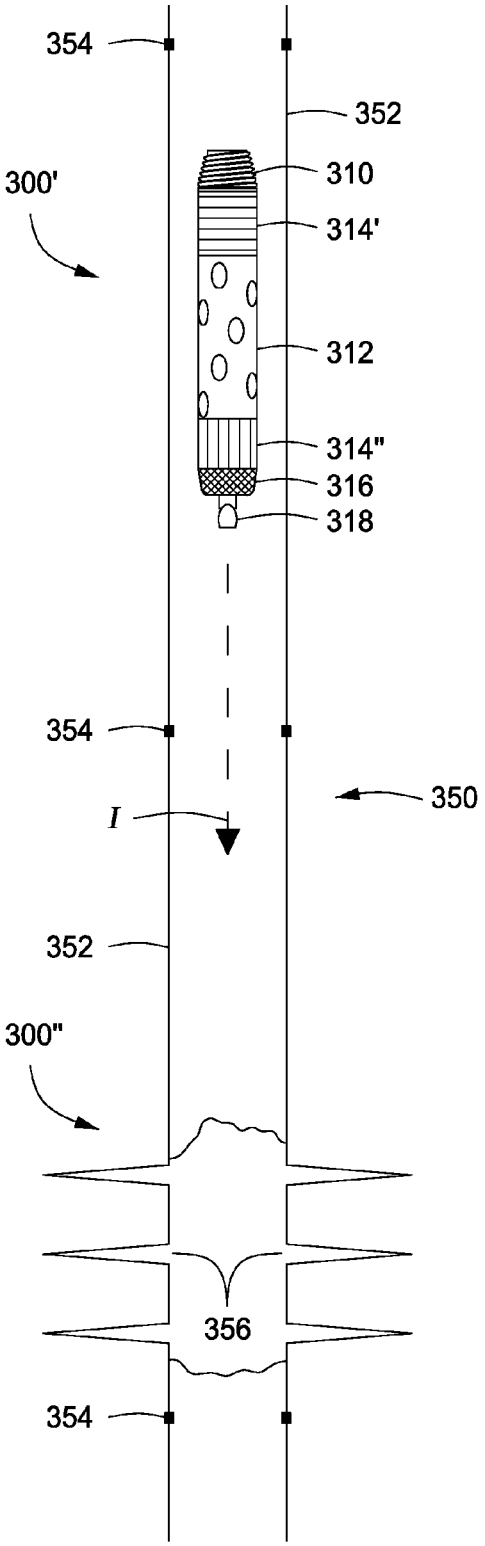
FIG. 3 is a side view of an autonomous tool as may be used for tubular operations, such as operations in a wellbore, in an alternate view. In this view, the tool is a perforating gun assembly. The perforating gun assembly is once again deployed in a string of production casing, and is shown in both a pre-actuated position and an actuated position.

Other arrangements for an autonomous tool besides the fracturing plug assembly 200'/200" may be used. FIG. 3 presents a side view of an alternative arrangement for an autonomous tool 300' as may be used for tubular operations. In this view, the tool 300' is a perforating gun assembly.

In FIG. 3, the perforating gun assembly is shown in both a pre-actuated position and an actuated position. The perforating gun assembly is shown in a pre-actuated position at 300', and is shown in an actuated position at 300". Arrow "I" indicates the movement of the perforating gun assembly 300' in its pre-actuated (or run-in) position, down to a location in the wellbore where the perforating gun assembly 300" is in its actuated position 300". The perforating gun assembly will be described primarily with reference to its pre-actuated position, at 300', as the actuated position 300" means complete destruction of the assembly 300'.

The perforating gun assembly 300' is again deployed within a string of production casing 350. The production casing 350 is formed from a plurality of "joints" 352 that are threadedly connected at collars 354. The wellbore completion includes the perforation of the production casing 350 at various selected intervals using the perforating gun assembly 300'. Utilization of the perforating gun assembly 300' is described more fully in connection with FIGS. 4A-4M and 5A-5I, below.

The perforating gun assembly 300' first optionally includes a fishing neck 310. The fishing neck 310 is dimensioned and configured to serve as the male portion to a mating downhole fishing tool (not shown). The fishing neck 310 allows the operator to retrieve the perforating gun assembly 300' in the unlikely event that it becomes stuck in the casing 352 or fails to detonate.

The perforating gun assembly 300' also includes a perforating gun 312. The perforating gun 312 may be a select fire gun that fires, for example, 16 shots. The gun 312 has an associated charge that detonates in order to cause shots to be fired from the gun 312 into the surrounding production casing 350. Typically, the perforating gun 312 contains a string of shaped charges distributed along the length of the gun and oriented according to desired specifications. The charges are preferably connected to a single detonating cord to ensure simultaneous detonation of all charges. Examples of suitable perforating guns include the Frac Gun™ from Schlumberger, and the GForce® from Halliburton.

The perforating gun assembly 300' also includes a position locator 314'. The position locator 314' operates in the same manner as the position locator 214 for the fracturing plug assembly 200'. In this respect, the position locator 314' serves as a location device for sensing the location of the perforating gun assembly 300' within the production casing 350. More specifically, the position locator 314' senses the presence of objects or "tags" along the wellbore 350, and generates depth signals in response.

In the view of FIG. 3, the objects are again the casing collars 354. This means that the position locator 314' is a casing collar locator, or "CCL." The CCL senses the location of the casing collars 354 as it moves down the casing 350. Of course, it is again understood that other sensing arrangements may be employed in the perforating gun assembly 300', such as the use of "RFID" devices.

The perforating gun assembly 300' further includes an on-board controller 316. The on-board controller 316 preferably operates in the same manner as the on-board controller 216 for the fracturing plug assembly 200'. In this respect, the on-board controller 316 processes the depth signals generated by the position locator 314' using appropriate logic and power units. In one aspect, the on-board controller 316 compares the generated signals with a pre-determined physical signature obtained for the wellbore objects (such as collars 354). For example, a CCL log may be run before deploying the autonomous tool (such as the perforating gun assembly 300') in order to determine the depth and/or spacing of the casing collars 354.

The on-board controller 316 activates the actuatable tool when it determines that the autonomous tool 300' has arrived at a particular depth adjacent a selected zone of interest. This is done using a statistical analysis, as described below. In the example of FIG. 3, the on-board controller 316 activates a detonating cord that ignites the charge associated with the perforating gun 310 to initiate the perforation of the production casing 250 at a desired depth or location. Illustrative perforations are shown in FIG. 3 at 356.

In addition, the on-board controller 316 may generate a separate signal to ignite the detonating cord to cause complete destruction of the perforating gun assembly. This is shown at 300". To accomplish this, the components of the gun assembly 300' are fabricated from a friable material. The perforating gun 312 may be fabricated, for example, from ceramic materials. Upon detonation, the material making up the perforating gun assembly 300' may become part of the proppant mixture injected into fractures in a later completion stage.

In one aspect, the perforating gun assembly 300' also includes a ball sealer carrier 318. The ball sealer carrier 318 is preferably placed at the bottom of the assembly 300'. Destruction of the assembly 300' causes ball sealers (not shown) to be released from the ball sealer carrier 318. Alternatively, the on-board controller 316 may have a timer that releases the ball sealers from the ball sealer carrier 318 shortly before the perforating gun 312 is fired, or simultaneously therewith. As will be described more fully below in connection with FIGS. 5F and 5G, the ball sealers are used to seal perforations that have been formed at a lower depth or location in the wellbore.

It is desirable with the perforating gun assembly 300' to provide various safety features that prevent the premature firing of the perforating gun 312. These are in addition to the locator device 314' described above.

Figure 4A:
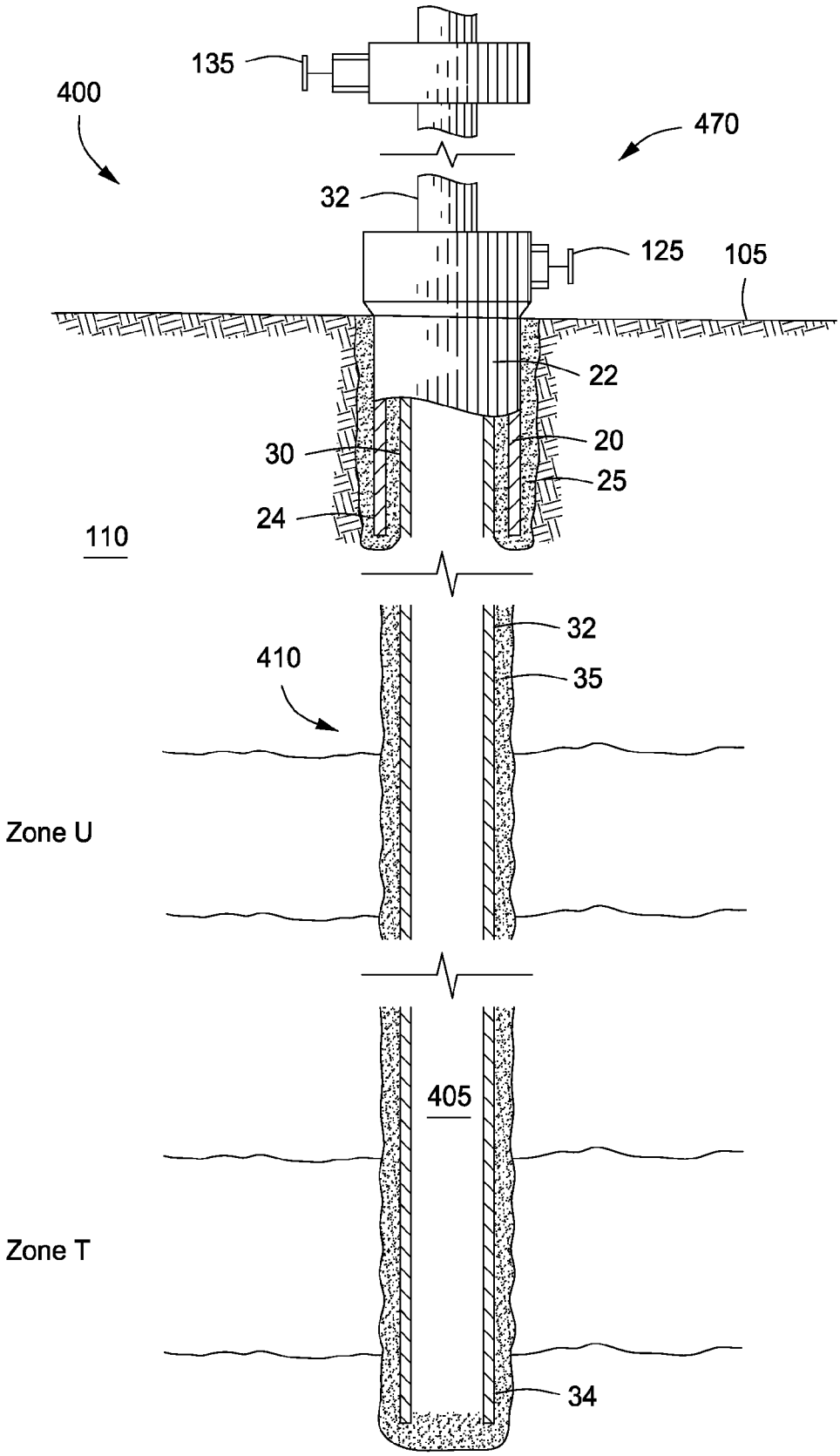
FIG. 4A is a side view of a well site having a wellbore for receiving an autonomous tool. The wellbore is being completed in at least zones of interest "T" and "U."

FIGS. 4A through 4M demonstrate the use of the fracturing plug assembly 200' and the perforating gun assembly 300' in an illustrative wellbore. First, FIG. 4A presents a side view of a well site 400. The well site 400 includes a wellhead 470 and a wellbore 410. The wellbore 410 includes a bore 405 for receiving the assemblies 200', 300'. The wellbore 410 is generally in accordance with wellbore 10 of FIG. 1; however, it is shown in FIG. 4A that the wellbore 410 is being completed in at least zones of interest "T" and "U" within a sub surface 110.

As with wellbore 10, the wellbore 410 is first formed with a string of surface casing 20. The surface casing 20 has an upper end 22 in sealed connection with a lower master fracture valve 125. The surface casing 20 also has a lower end 24. The surface casing 20 is secured in the wellbore 410 with a surrounding cement sheath 25.

The wellbore 410 also includes a string of production casing 30. The production casing 30 is also secured in the wellbore 410 with a surrounding cement sheath 35. The production casing 30 has an upper end 32 in sealed connection with an upper master fracture valve 135. The production casing 30 also has a lower end 34. The production casing 30 extends through a lowest zone of interest "T," and also through at least one zone of interest "U" above the zone "T." A wellbore operation will be conducted that includes perforating each of zones "T" and "U" sequentially.

A wellhead 470 is positioned above the wellbore 410. The wellhead 470 includes the lower 125 and upper 135 master fracture valves. The wellhead 470 will also include blow-out preventers (not shown), such as the blow-out preventer 60 shown in FIG. 1.

FIG. 4A differs from FIG. 1 in that the well site 400 will not have the lubricator or associated surface equipment components. In addition, no wireline is shown. Instead, the operator can simply drop the fracturing plug assembly 200' and the perforating gun assembly 300' into the wellbore 410. To accommodate this, the upper end 32 of the production casing 30 may extend a bit longer, for example, five to ten feet, between the lower 125 and upper 135 master fracture valves.

Figure 4B:
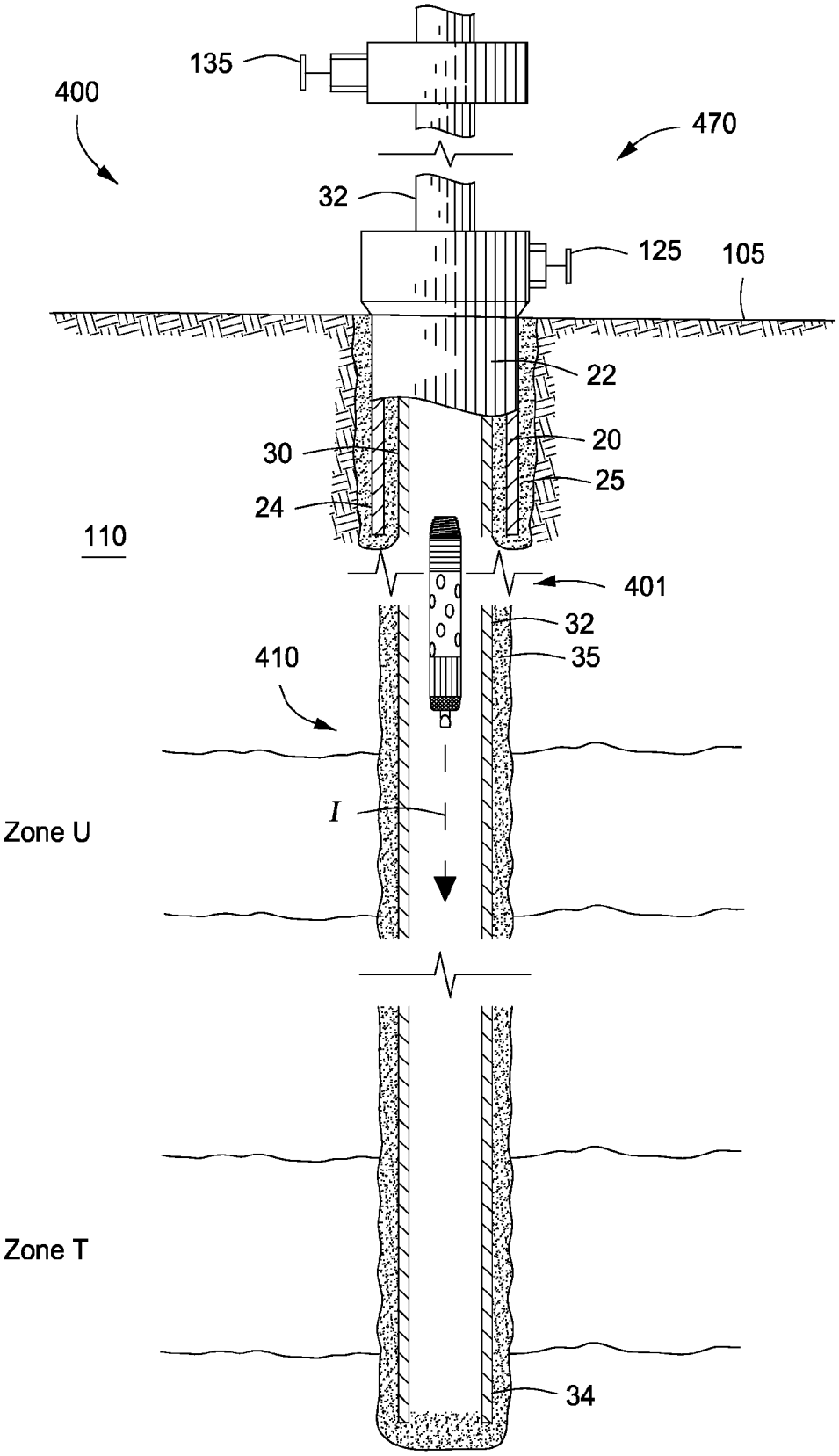
FIG. 4B is a side view of the well site of FIG. 4A. Here, the wellbore has received a first perforating gun assembly, in one embodiment.

FIG. 4B is a side view of the well site 400 of FIG. 4A. Here, the wellbore 410 has received a first perforating gun assembly 401. The first perforating gun assembly 401 is generally in accordance with the perforating gun assembly 300' of FIG. 3 in its various embodiments, as described above. It can be seen that the perforating gun assembly 401 is moving downwardly in the wellbore 410, as indicated by arrow "I." The perforating gun assembly 401 may be simply falling through the wellbore 410 in response to gravitational pull. In addition, the operator may be assisting the downward movement of the perforating gun assembly 401 by applying hydraulic pressure through the use of surface pumps (not shown). Alternatively, the perforating gun assembly 401 may be aided in its downward movement through the use of a tractor (not shown). In this instance, the tractor will be fabricated entirely of a friable material.

Figure 4C:
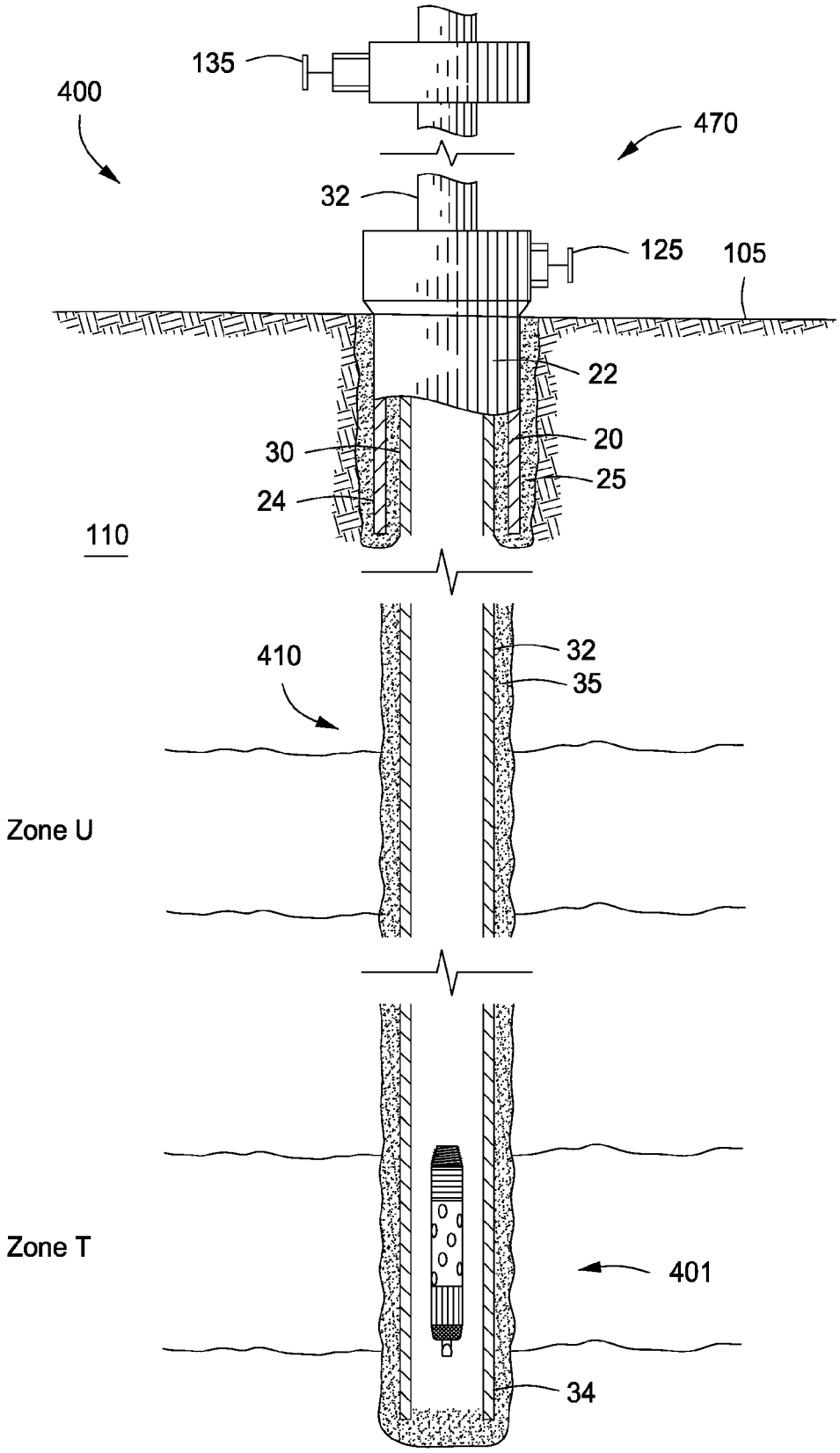
FIG. 4C is another side view of the well site of FIG. 4A. Here, the first perforating gun assembly from FIG. 4B has fallen in the wellbore to a position adjacent zone of interest "T."

FIG. 4C is another side view of the well site 400 of FIG. 4A. Here, the first perforating gun assembly 401 has fallen in the wellbore 410 to a position adjacent zone of interest "T." In accordance with the present inventions, the locator device (shown at 314' in FIG. 3) has generated signals in response to collars residing along the production casing 30. In this way, the on-board controller (shown at 316 of FIG. 3) is aware of the location of the first perforating gun assembly 401.

Figure 4D:
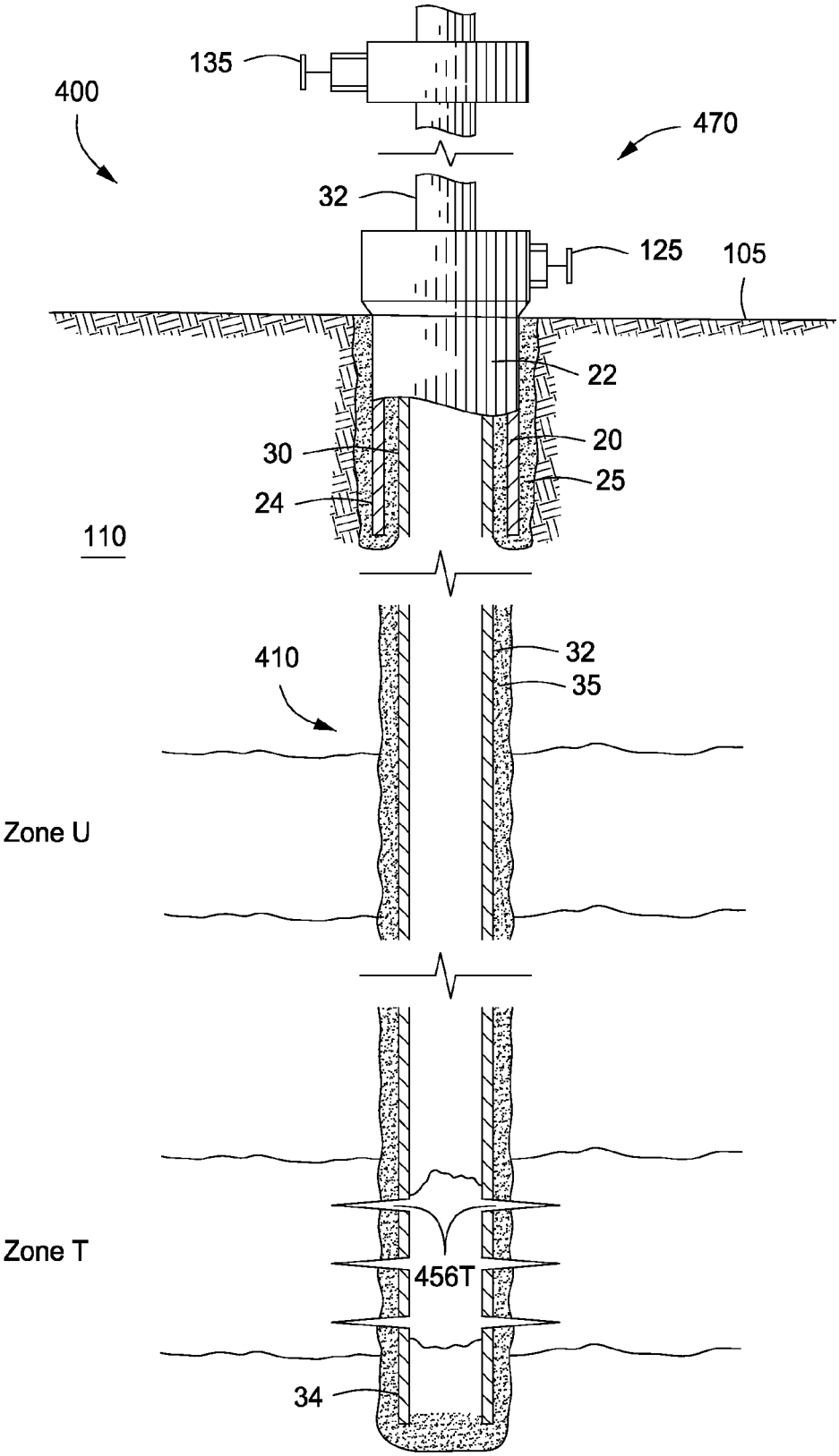
FIG. 4D is another side view of the well site of FIG. 4A. Here, charges of the first perforating gun assembly have been detonated, causing the perforating gun of the perforating gun assembly to fire. The casing along the zone of interest "T" has been perforated.

FIG. 4D is another side view of the well site 400 of FIG. 4A. Here, charges of the perforating gun assembly 401 have been detonated, causing the perforating gun (shown at 312 of FIG. 3) to fire. The casing along zone of interest "T" has been perforated. A set of perforations 456T is shown extending from the wellbore 410 and into the subsurface 110. While only six perforations 456T are shown in the side view, it us understood that additional perforations may be formed, and that such perforations will extend radially around the production casing 30.

In addition to the creation of perforations 456T, the perforating gun assembly 401 is self-destructed. Any pieces left from the assembly 401 will likely fall to the bottom 34 of the production casing 30.

Figure 4E:
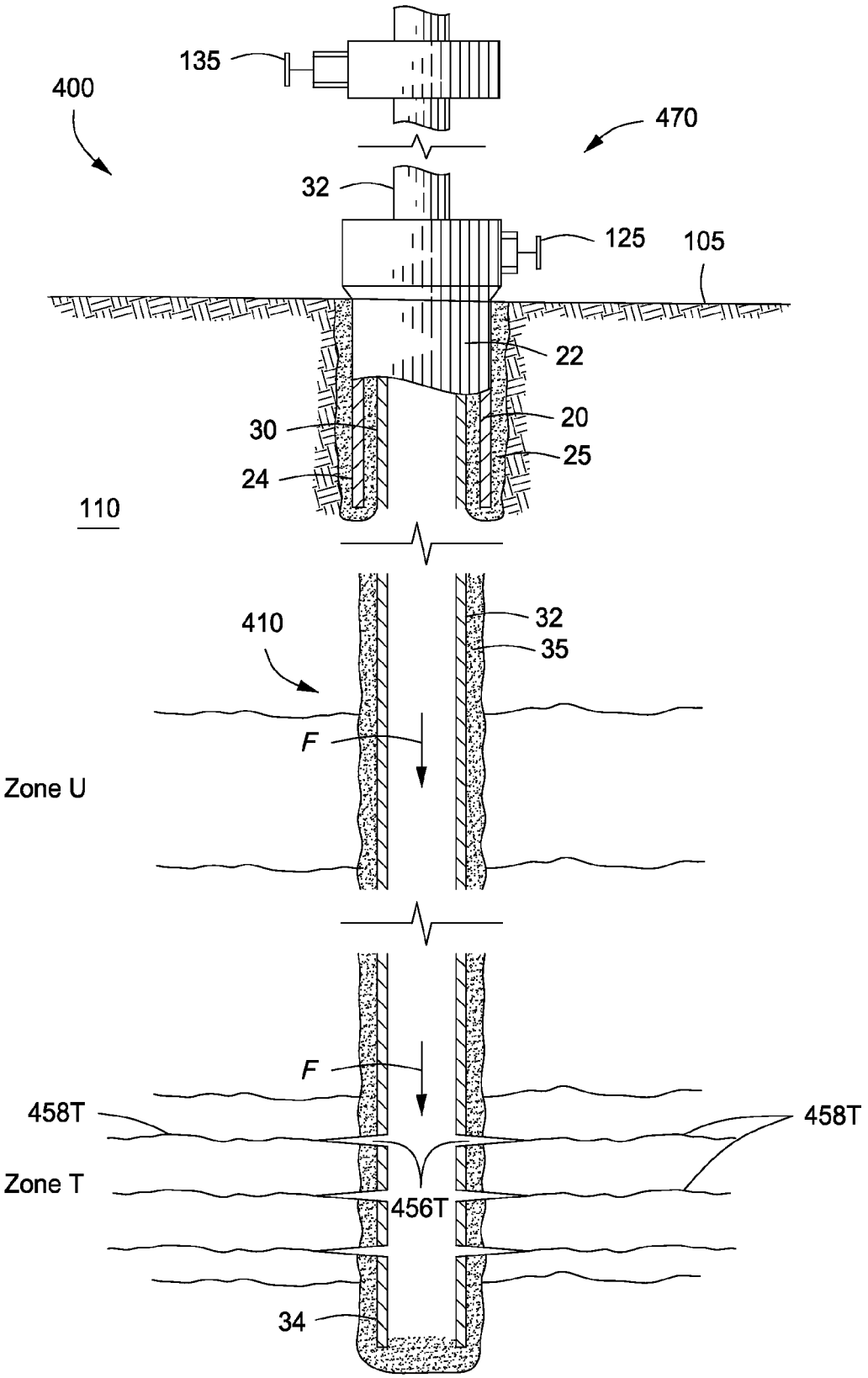
FIG. 4E is yet another side view of the well site of FIG. 4A. Here, fluid is being injected into the wellbore under high pressure, causing the formation within the zone of interest "T" to be fractured.

FIG. 4E is yet another side view of the well site 400 of FIG. 4A. Here, fluid is being injected into the bore 405 of the wellbore 410 under high pressure. Downward movement of the fluid is indicated by arrows "F." The fluid moves through the perforations 456T and into the surrounding subsurface 110. This causes fractures 458T to be formed within the zone of interest "T." An acid solution may also optionally be circulated into the bore 405 to remove carbonate build-up and remaining drilling mud and further stimulate the subsurface 110 for hydrocarbon production.

Figure 4F:
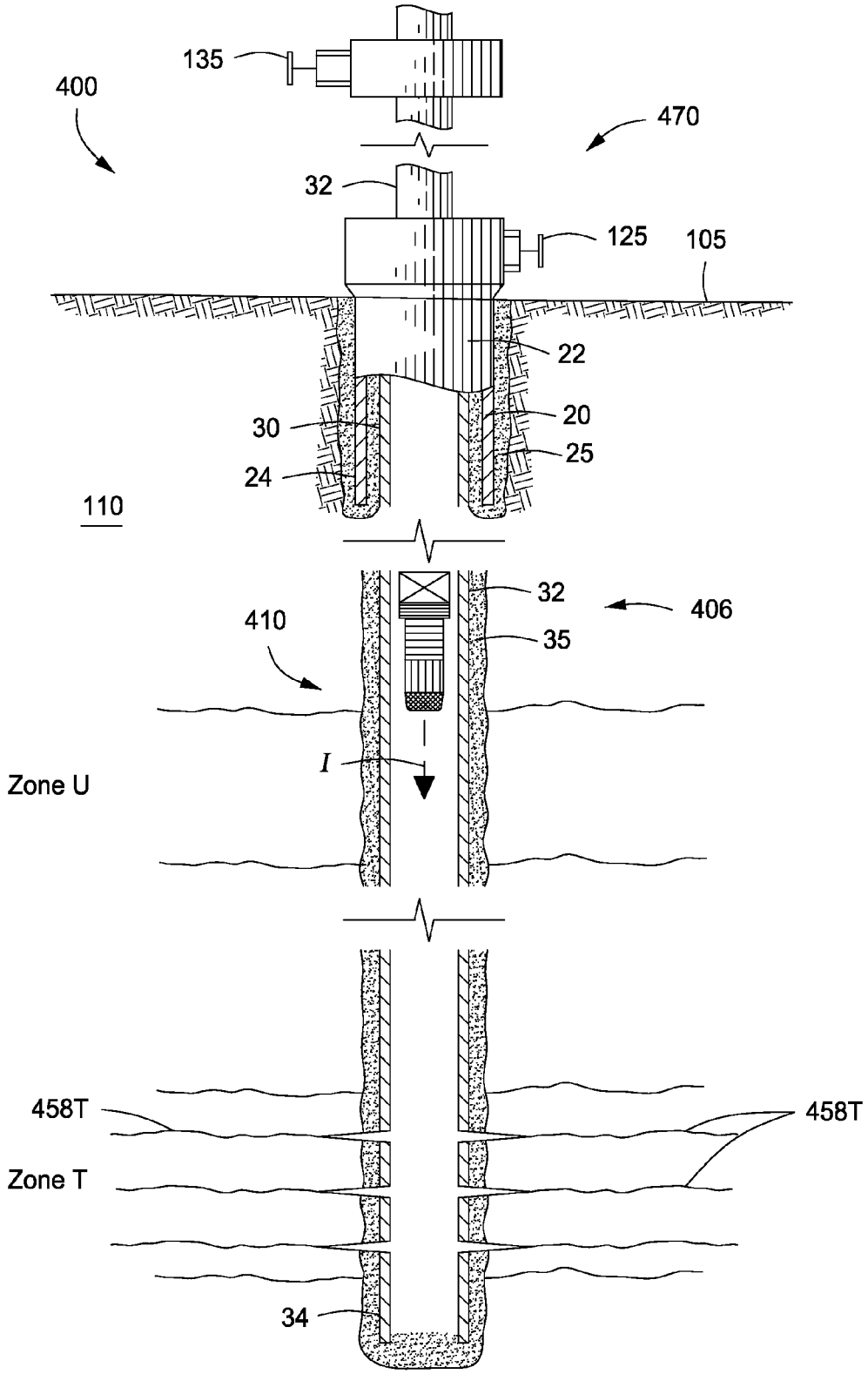
FIG. 4F is another side view of the well site of FIG. 4A. Here, the wellbore is receiving a fracturing plug assembly, in one embodiment.

FIG. 4F is yet another side view of the well site 400 of FIG. 4A. Here, the wellbore 410 has received a fracturing plug assembly 406. The fracturing plug assembly 406 is generally in accordance with the fracturing plug assembly 200' of FIG. 2 in its various embodiments, as described above.

In FIG. 4F, the fracturing plug assembly 406 is in its run-in (pre-actuated) position. The fracturing plug assembly 406 is moving downwardly in the wellbore 410, as indicated by arrow "I." The fracturing plug assembly 406 may simply be falling through the wellbore 410 in response to gravitational pull. In addition, the operator may be assisting the downward movement of the fracturing plug assembly 406 by applying pressure through the use of surface pumps (not shown).

Figure 4G:
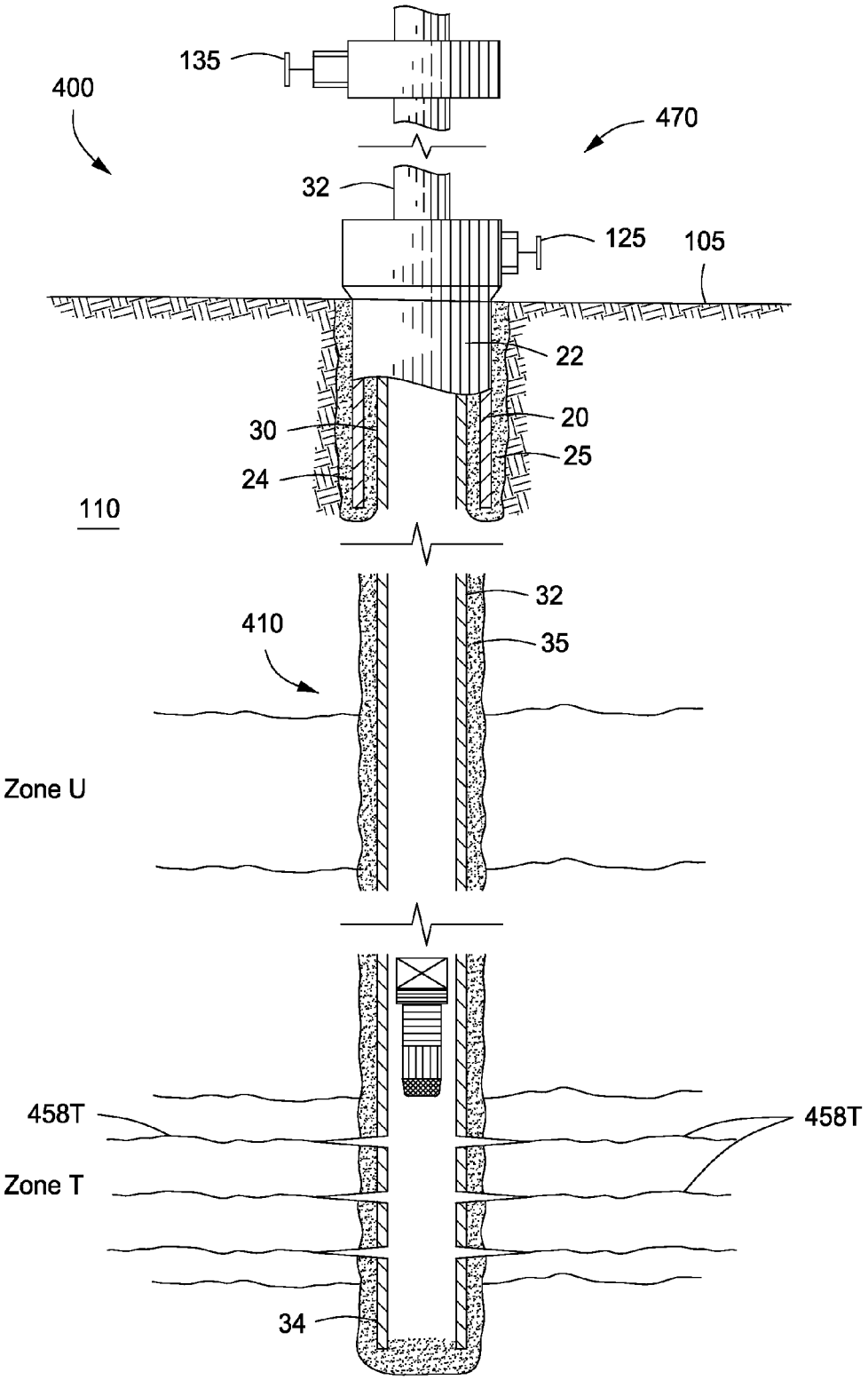
FIG. 4G is still another side view of the well site of FIG. 4A. Here, the fracturing plug assembly from FIG. 4F has fallen in the wellbore to a position above the zone of interest "T."

FIG. 4G is still another side view of the well site 400 of FIG. 4A. Here, the fracturing plug assembly 406 has fallen in the wellbore 410 to a position above the zone of interest "T." In accordance with the present inventions, the locator device (shown at 214 in FIG. 2) has generated signals in response to collars residing along the production casing 30. In this way, the on-board controller (shown at 216 of FIG. 2) is aware of the location of the fracturing plug assembly 406.

Figure 4H:
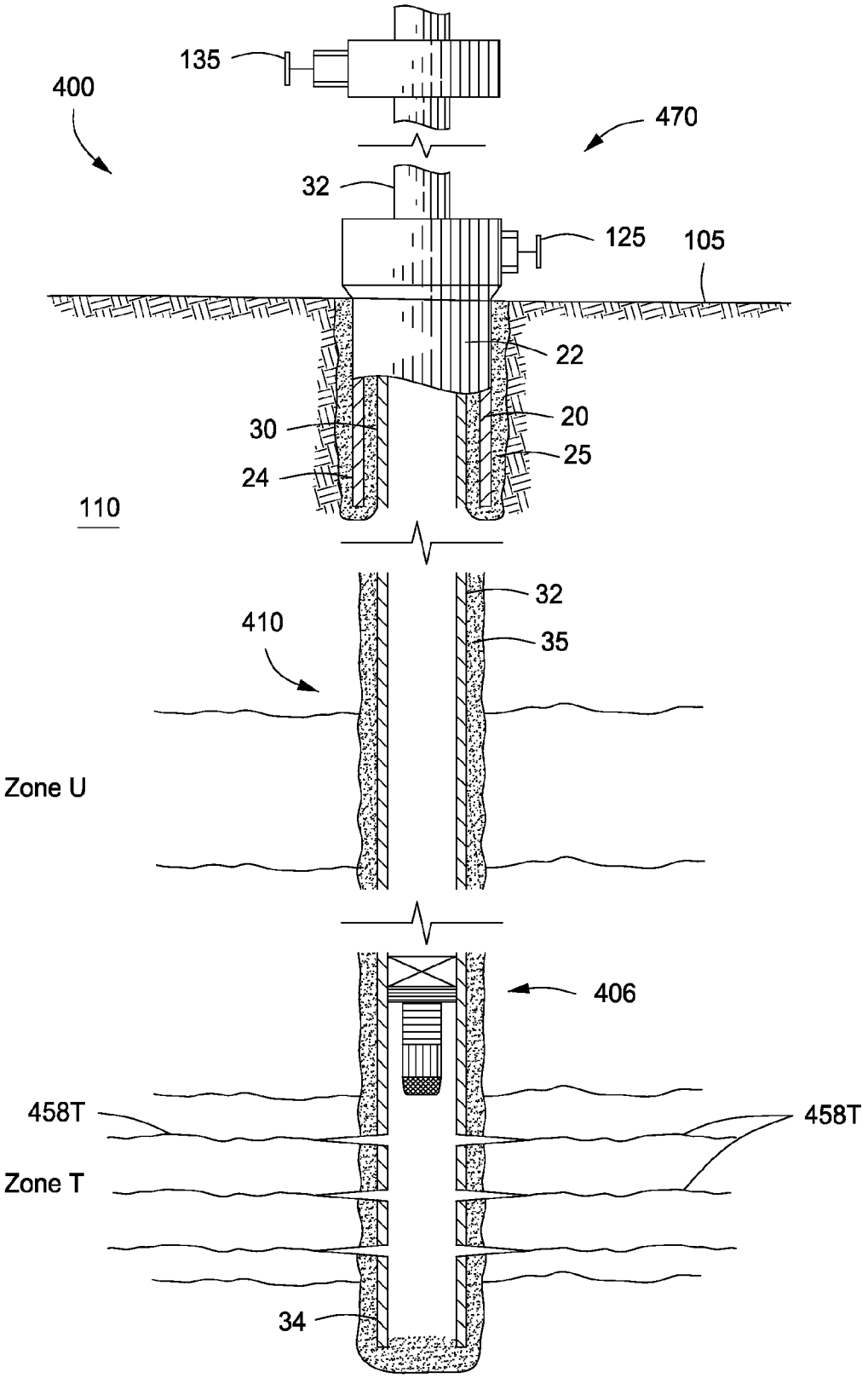
FIG. 4H is another side view of the well site of FIG. 4A. Here, the fracturing plug assembly has been actuated and set below zone of interest "U." Zone of interest "U" is above zone of interest "T."

FIG. 4H is another side view of the well site 400 of FIG. 4A. Here, the fracturing plug assembly 406 has been set. This means that on-board controller has generated signals to activate the setting tool (shown at 212 of FIG. 2) along with the sealing element (shown at 211" of FIG. 2) and the slips (shown at 213") to set and to seal the plug assembly 406 in the bore 405 of the wellbore 410. In FIG. 4H, the fracturing plug assembly 406 has been set above the zone of interest "T." This allows isolation of the zone of interest "U" for a next perforating stage.

Figure 4I:
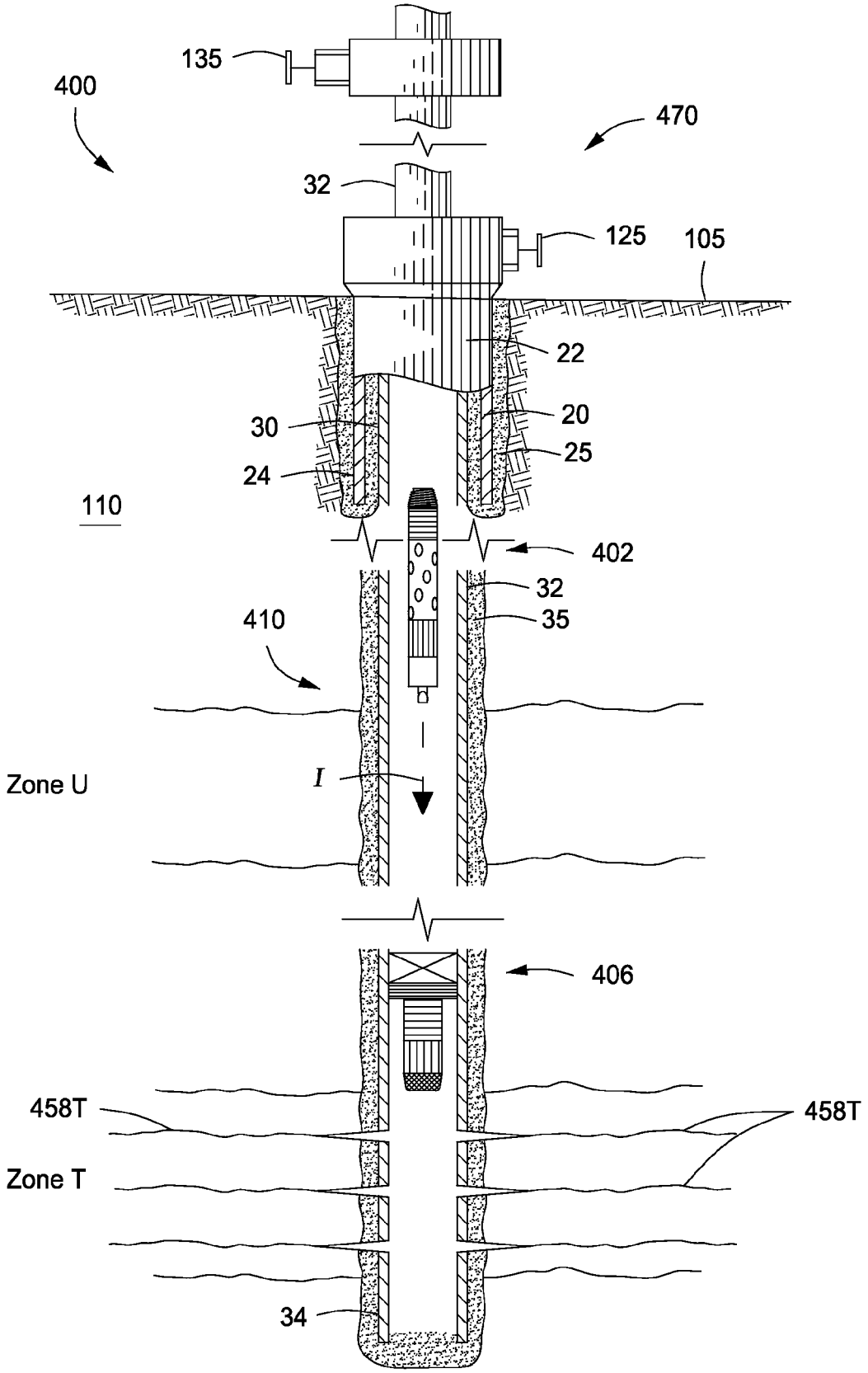
FIG. 4I is yet another side view of the well site of FIG. 4A. Here, the wellbore has received a second perforating gun assembly.

FIG. 4I is another side view of the well site 400 of FIG. 4A. Here, the wellbore 410 is receiving a second perforating gun assembly 402. The second perforating gun assembly 402 may be constructed and arranged as the first perforating gun assembly 401. This means that the second perforating gun assembly 402 is also autonomous.

It can be seen in FIG. 4I that the second perforating gun assembly 402 is moving downwardly in the wellbore 410, as indicated by arrow "I." The second perforating gun assembly 402 may be simply falling through the wellbore 410 in response to gravitational pull. In addition, the operator may be assisting the downward movement of the perforating gun assembly 402 by applying pressure through the use of surface pumps (not shown). Alternatively, the perforating gun assembly 402 may be aided in its downward movement through the use of a tractor (not shown). In this instance, the tractor will be fabricated entirely of a friable material.

Figure 4J:
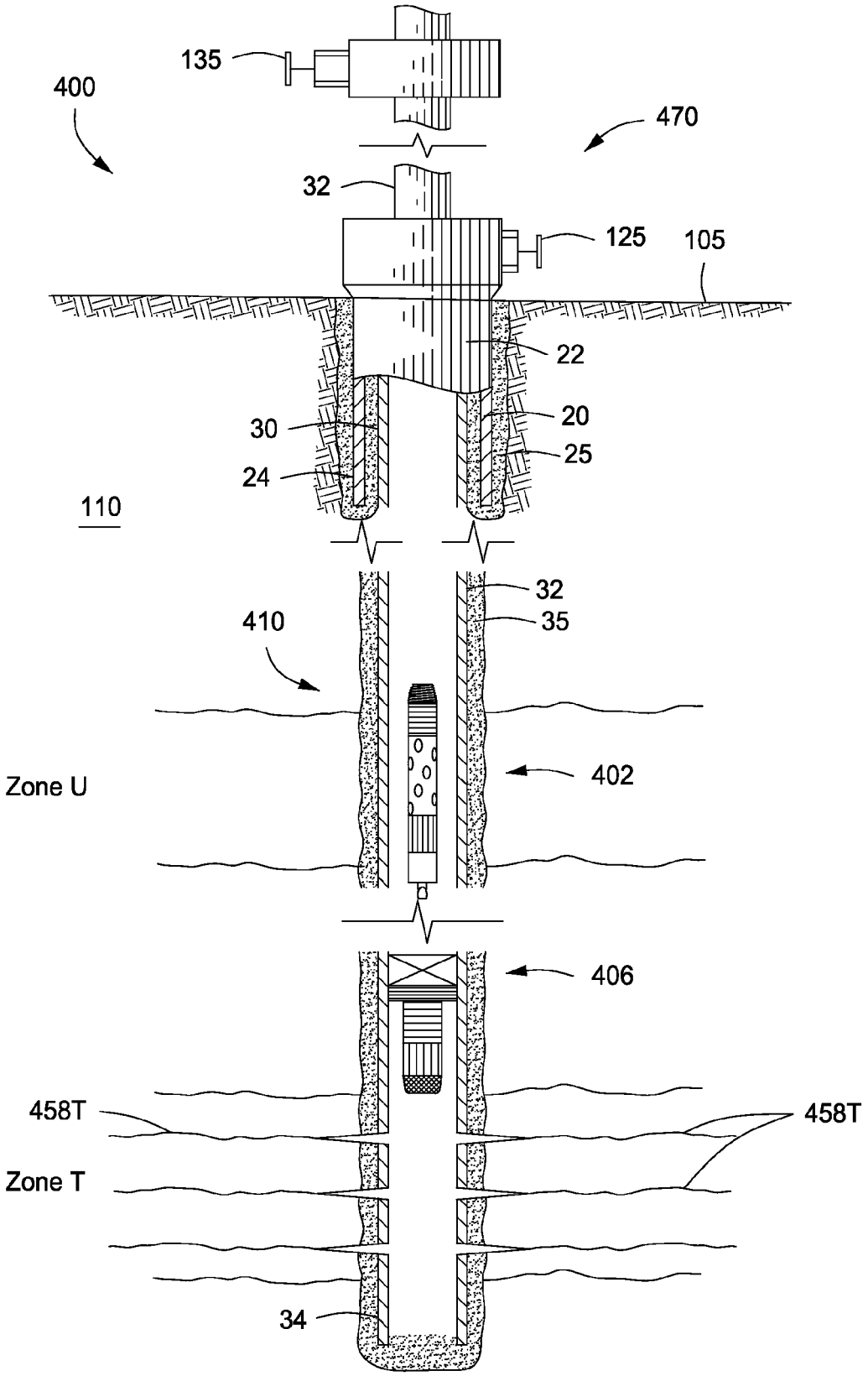
FIG. 4J is another side view of the well site of FIG. 4A. Here, the second perforating gun assembly has fallen in the wellbore to a position adjacent zone of interest "U."

FIG. 4J is another side view of the well site 400 of FIG. 4A. Here, the second perforating gun assembly 402 has fallen in the wellbore to a position adjacent zone of interest "U." Zone of interest "U" is above zone of interest "T." In accordance with the present inventions, the locator device (shown at 314' in FIG. 3) has generated signals in response to tags placed along the production casing 30. In this way, the on-board controller (shown at 316 of FIG. 3) is aware of the location of the first perforating gun assembly 401.

Figure 4K:
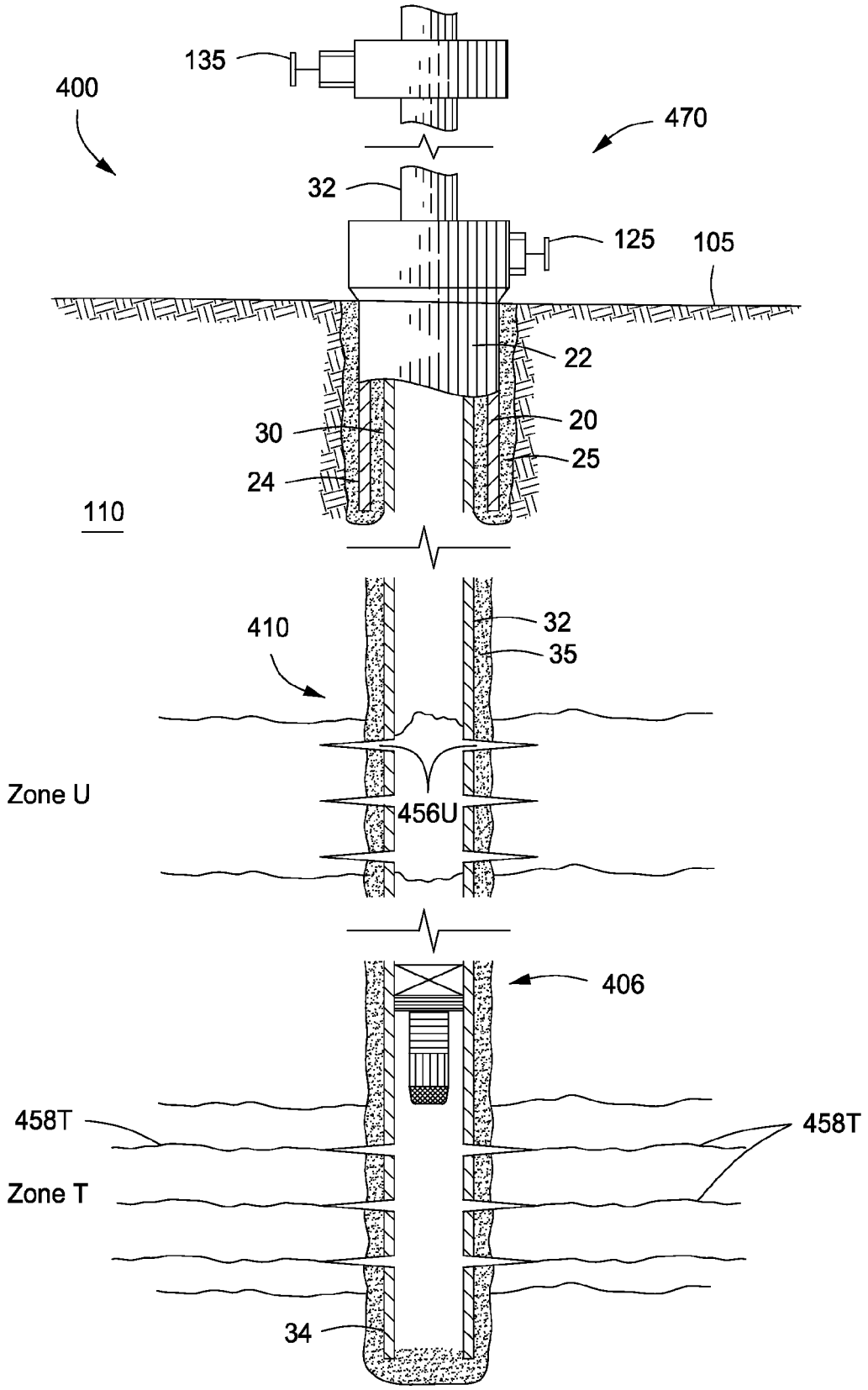
FIG. 4K is another side view of the well site of FIG. 4A. Here, charges of the second perforating gun assembly have been detonated, causing the perforating gun of the perforating gun assembly to fire. The casing along the zone of interest "U" has been perforated.

FIG. 4K is another side view of the well site 400 of FIG. 4A. Here, charges of the second perforating gun assembly 402 have been detonated, causing the perforating gun of the perforating gun assembly to fire. The zone of interest "U" has been perforated. A set of perforations 456U is shown extending from the wellbore 410 and into the subsurface 110. While only six perforations 456U are shown in side view, it us understood that additional perforations are formed, and that such perforations will extend radially around the production casing 30.

In addition to the creation of perforations 456U, the second perforating gun assembly 402 is self-destructed. Any pieces left from the assembly 402 will likely fall to the plug assembly 406 still set in the production casing 30.

It is noted here that the perforation step of FIGS. 4J and 4K may precede the plug-setting step of FIGS. 4H and 4I. This is a matter within the operator's discretion.

Figure 4L:
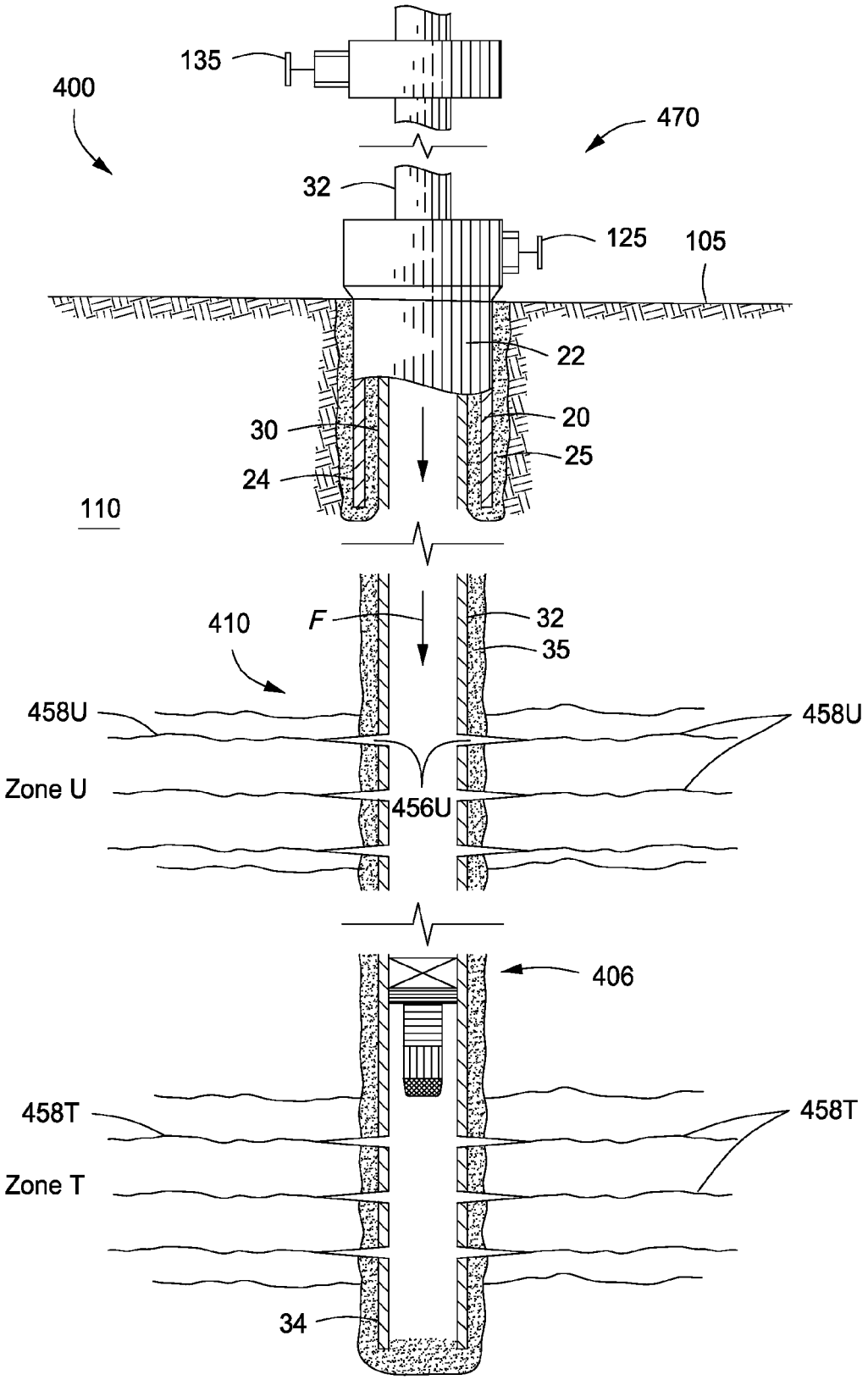
FIG. 4L is still another side view of the well site of FIG. 4A. Here, fluid is being injected into the wellbore under high pressure, causing the formation within the zone of interest "U" to be fractured.

FIG. 4L is yet another side view of the well site 400 of FIG. 4A. Here, fluid is being injected into the bore 405 of the wellbore 410 under high pressure. The fluid injection causes the subsurface 110 within the zone of interest "U" to be fractured. Downward movement of the fluid is indicated by arrows "F." The fluid moves through the perforations 456A and into the surrounding subsurface 110. This causes fractures 458U to be formed within the zone of interest "U." An acid solution may also optionally be circulated into the bore 405 to remove carbonate build-up and remaining drilling mud and further stimulate the subsurface 110 for hydrocarbon production.

Figure 4M:
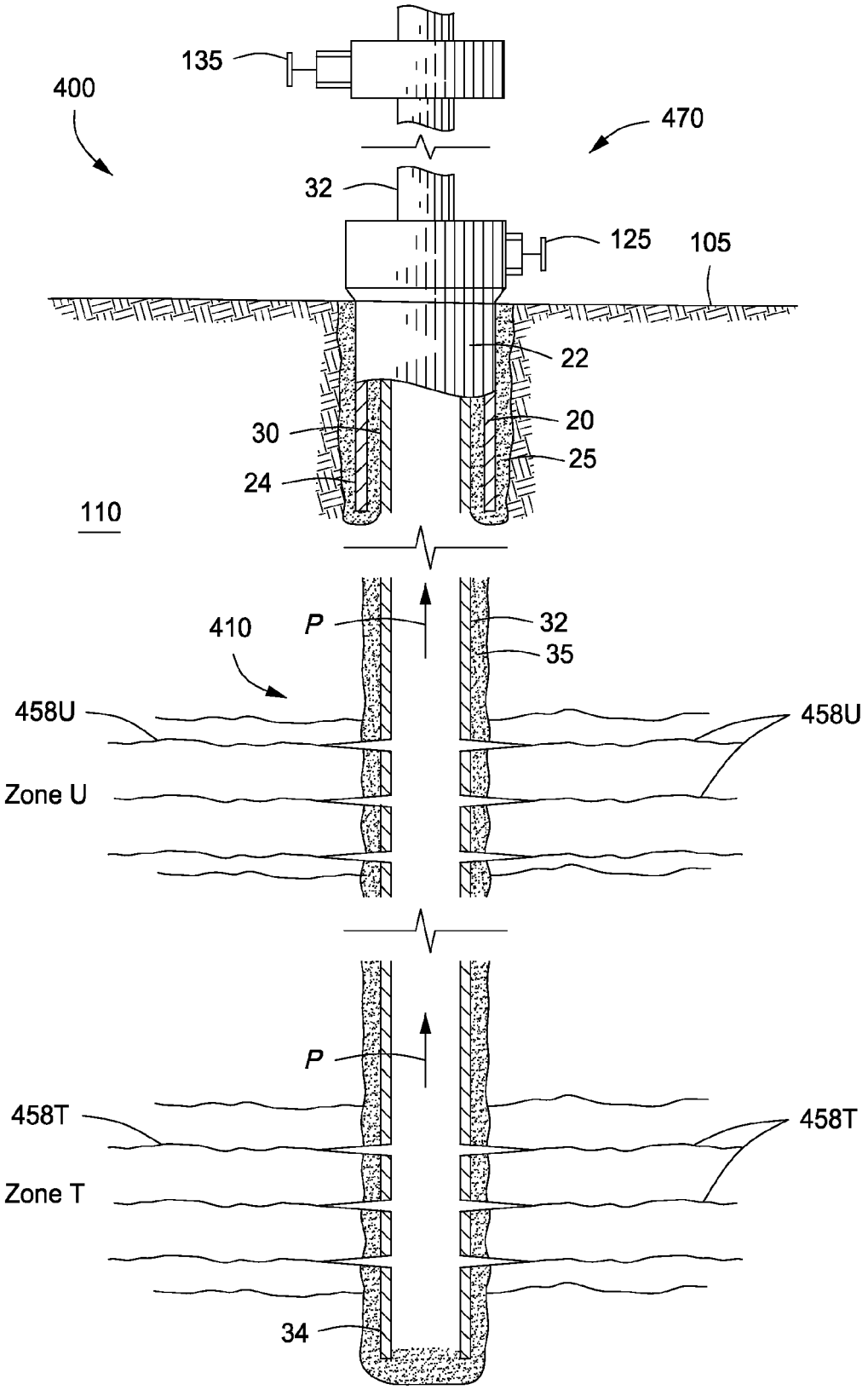
FIG. 4M provides a final side view of the well site of FIG. 4A. Here, the fracturing plug assembly has been removed from the wellbore. In addition, the wellbore is now receiving production fluids.

Finally, FIG. 4M provides a final side view of the well site 400 of FIG. 4A. Here, the fracturing plug assembly 406 has been removed from the wellbore 410. In addition, the wellbore 410 is now receiving production fluids. Arrows "P" indicate the flow of production fluids from the subsurface 110 into the wellbore 410 and towards the surface 105.

In order to remove the plug assembly 406, the on-board controller (shown at 216 of FIG. 2) may release the plug body 210" (with the slips 213" of FIG. 2) after a designated period of time. The fracturing plug assembly 406 may then be flowed back to the surface 105 and retrieved via a pig catcher (not shown) or other such device. Alternatively, the on-board controller 216 may be programmed so that after a designated period of time, a detonating cord is ignited, which then causes the fracturing plug assembly 406 to detonate and self-destruct. In this arrangement, the entire fracturing plug assembly 406 is fabricated from a friable material.

FIGS. 4A through 4M demonstrate the use of perforating gun assemblies with a fracturing plug to perforate and stimulate two separate zones of interest (zones "T" and "U") within an illustrative wellbore 410. In this example, both the first 401 and the second 402 perforating gun assemblies were autonomous, and the fracturing plug assembly 406 was also autonomous. However, it is possible to perforate the lowest or terminal zone "T" using a traditional wireline with a select-fire gun assembly, but then use autonomous perforating gun assemblies to perforate multiple zones above the terminal zone "T."

Other combinations of wired and wireless tools may be used within the spirit of the present inventions. For example, the operator may run the fracturing plugs into the wellbore on a wireline, but use one or more autonomous perforating gun assemblies. Reciprocally, the operator may run the respective perforating gun assemblies into the wellbore on a wireline, but use one or more autonomous fracturing plug assemblies.

Figure 5A:
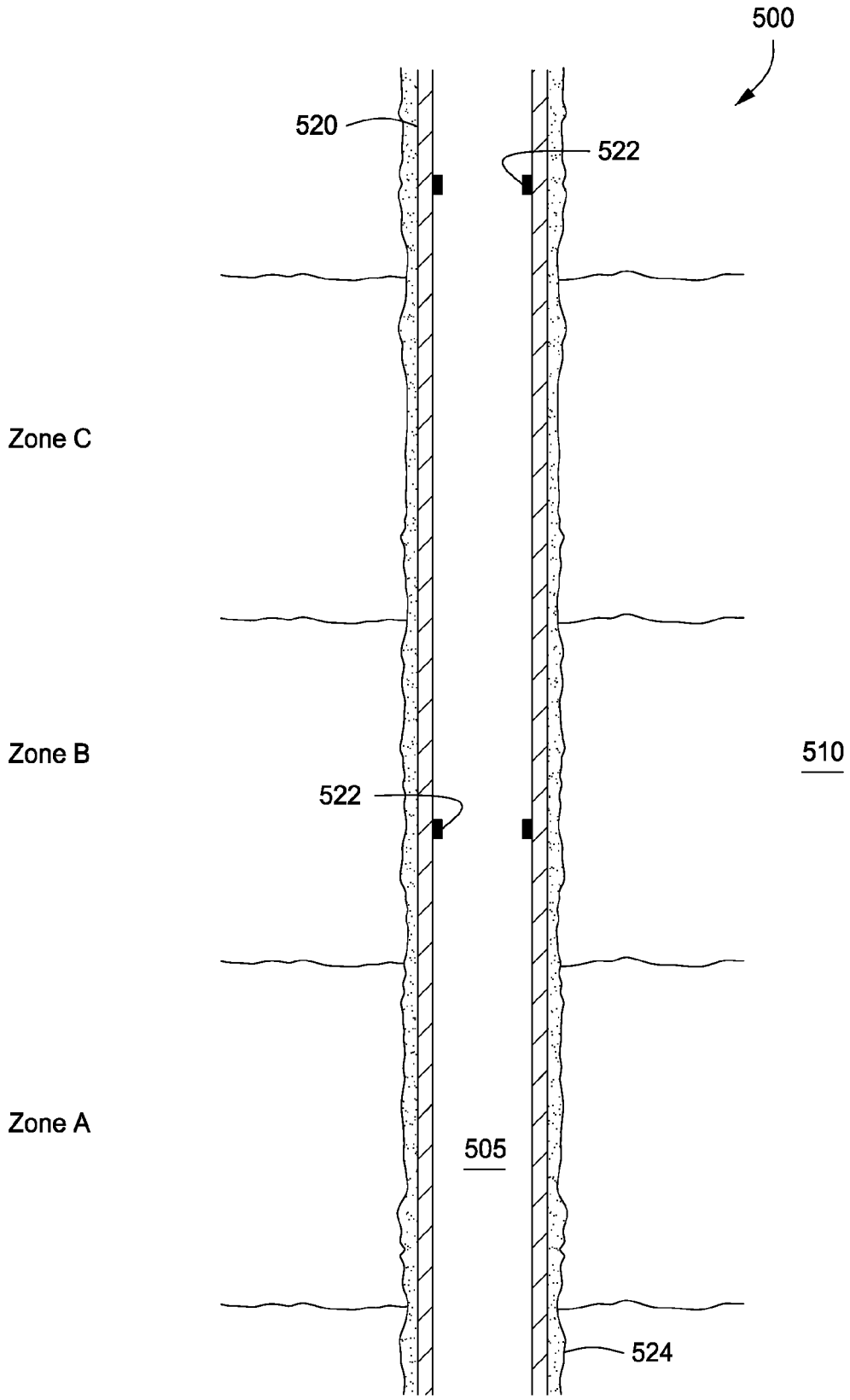
FIG. 5A is a side view of a portion of a wellbore. The wellbore is being completed in multiple zones of interest, including zones "A," "B," and "C."

In another arrangement, the perforating steps may be done without a fracturing plug assembly. FIGS. 5A through 5I demonstrate how multiple zones of interest may be sequentially perforated and treated in a wellbore using destructible, autonomous perforating gun assemblies and ball sealers. First, FIG. 5A is a side view of a portion of a wellbore 500. The wellbore 500 is being completed in multiple zones of interest, including zones "A," "B," and "C." The zones of interest "A," "B," and "C" reside within a subsurface 510 containing hydrocarbon fluids.

The wellbore 500 includes a string of production casing (or, alternatively, a liner string) 520. The production casing 520 has been cemented into the subsurface 510 to isolate the zones of interest "A," "B," and "C" as well as other strata along the subsurface 510. A cement sheath is seen at 524.

The production casing 520 has a series of locator tags 522 placed there along. The locator tags 522 are ideally embedded into the wall of the production casing 520 to preserve their integrity. However, for illustrative purposes the locator tags 522 are shown in FIG. 5A as attachments along the inner diameter of the production casing 520. In the arrangement of FIG. 5A, the locator tags 512 represent radio frequency identification tags that are sensed by an RFID reader/antennae. The locator tags 522 create a physical signature along the wellbore 500.

It is noted that the locator tags 522 may also be casing collars. In this instance, the casing collars would be sensed using a CCL sensor rather than an RFID reader/antennae. For the illustrative purposes of FIGS. 5A through 5I, the locator tags will be referred to as casing collars.

The wellbore 500 is part of a well that is being formed for the production of hydrocarbons. As part of the well completion process, it is desirable to perforate and then fracture each of the zones of interest "A," "B," and "C."

Figure 5B:
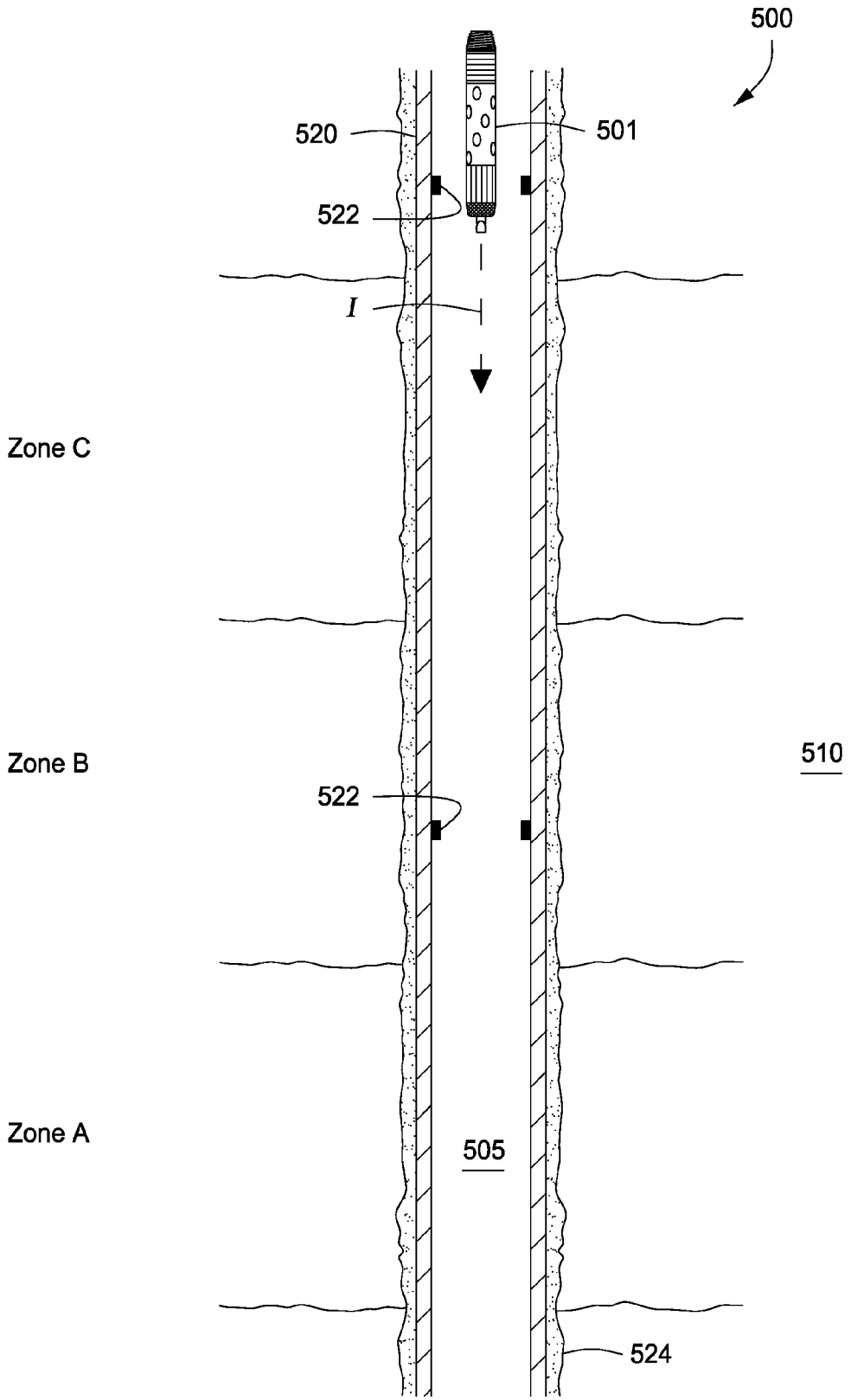
FIG. 5B is another side view of the wellbore of FIG. 5A. Here, the wellbore has received a first perforating gun assembly. The perforating gun assembly is being pumped down the wellbore.

FIG. 5B is another side view of the wellbore 500 of FIG. 5A. Here, the wellbore 500 has received a first perforating gun assembly 501. The first perforating gun assembly 501 is generally in accordance with perforating gun assembly 300' (in its various embodiments) of FIG. 3. In FIG. 5B, the perforating gun assembly 501 is being pumped down the wellbore 500. The perforating gun assembly 501 has been dropped into a bore 505 of the wellbore 500, and is moving down the wellbore 500 through a combination of gravitational pull and hydraulic pressure. Arrow "I" indicates movement of the gun assembly 501.

Figure 5C:
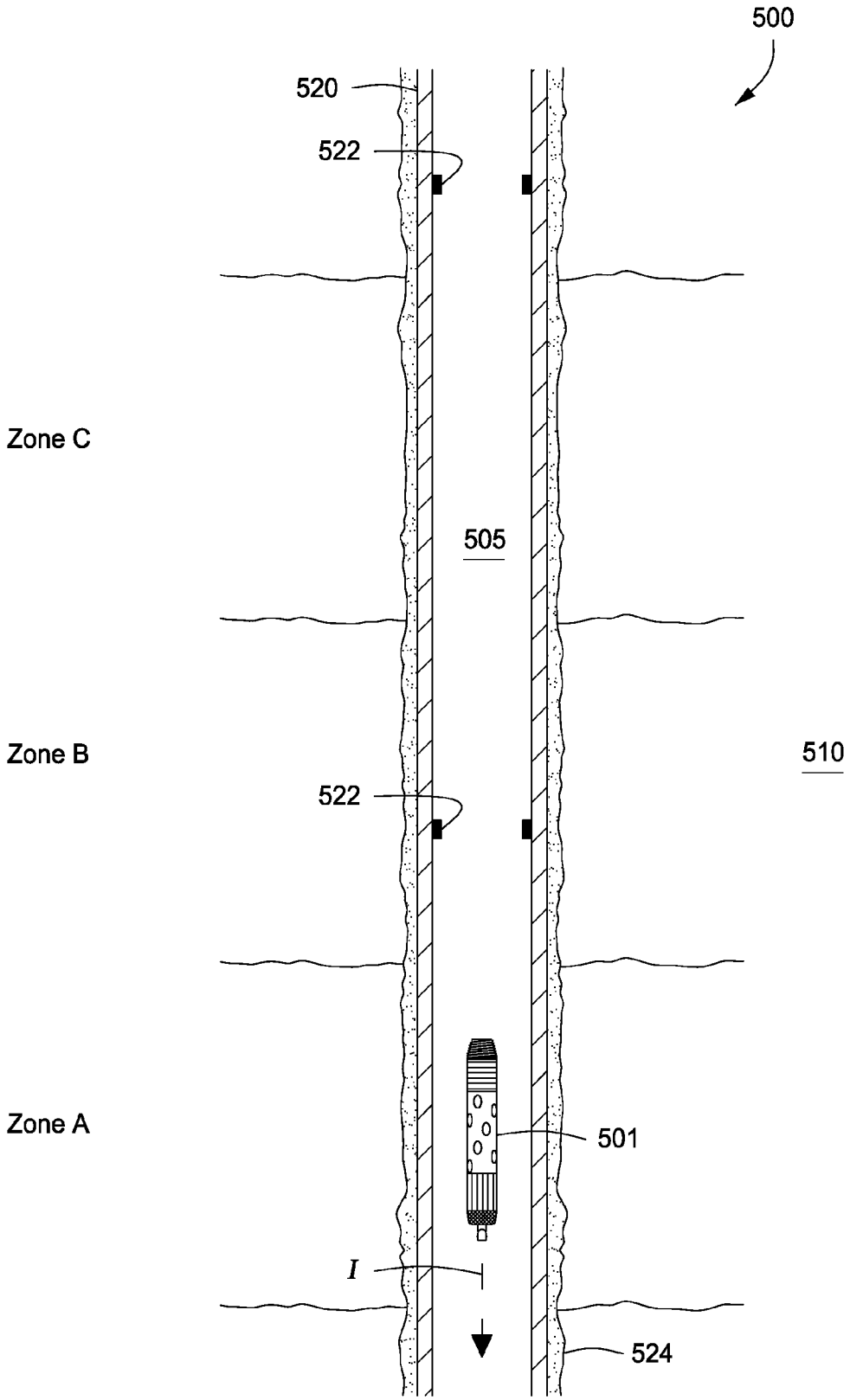
FIG. 5C is another side view of the wellbore of FIG. 5A. Here, the first perforating gun assembly has fallen into the wellbore to a position adjacent zone of interest "A."

FIG. 5C is a next side view of the wellbore 500 of FIG. 5A. Here, the first perforating gun assembly 501 has fallen into the bore 505 to a position adjacent zone of interest "A." In accordance with the present inventions, the locator device (shown at 314' in FIG. 3) has generated signals in response to the collars 522 placed along the production casing 30. In this way, the on-board controller (shown at 316 of FIG. 3) is aware of the location of the first perforating gun assembly 501.

Figure 5D:
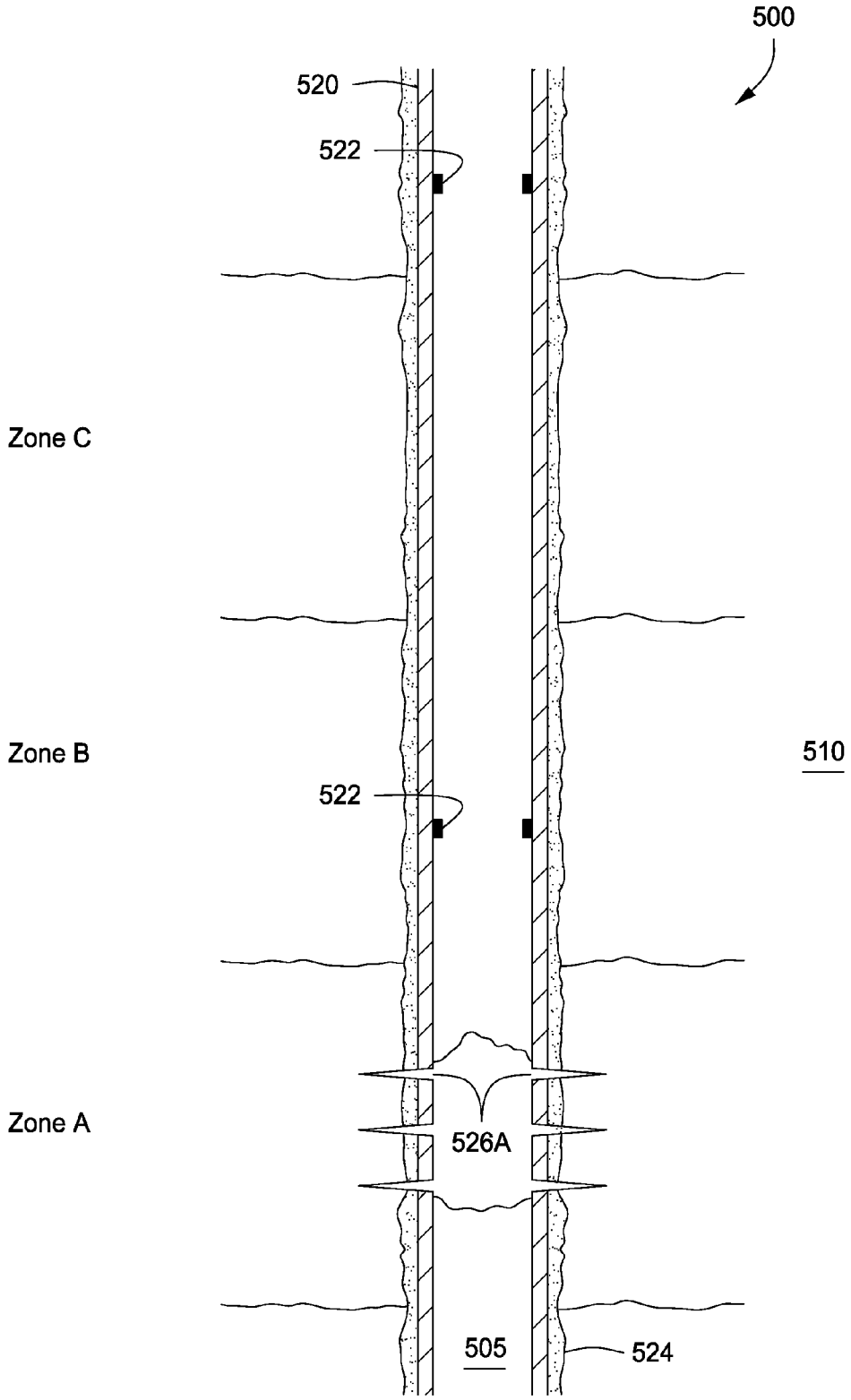
FIG. 5D is another side view of the wellbore of FIG. 5A. Here, charges of the first perforating gun assembly have been detonated, causing the perforating gun of the perforating gun assembly to fire. The casing along the zone of interest "A" has been perforated.

FIG. 5D is another side view of the wellbore 500 of FIG. 5A. Here, charges of the first perforating gun assembly have been detonated, causing the perforating gun of the perforating gun assembly to fire. The zone of interest "A" has been perforated. A set of perforations 526A is shown extending from the wellbore 500 and into the subsurface 510. While only six perforations 526A are shown in side view, it us understood that additional perforations are formed, and that such perforations may extend radially around the production casing 30.

In addition to the creation of perforations 526A, the first perforating gun assembly 501 is self-destructed. Any pieces left from the assembly 501 will likely fall to the bottom of the production casing 30.

Figure 5E:
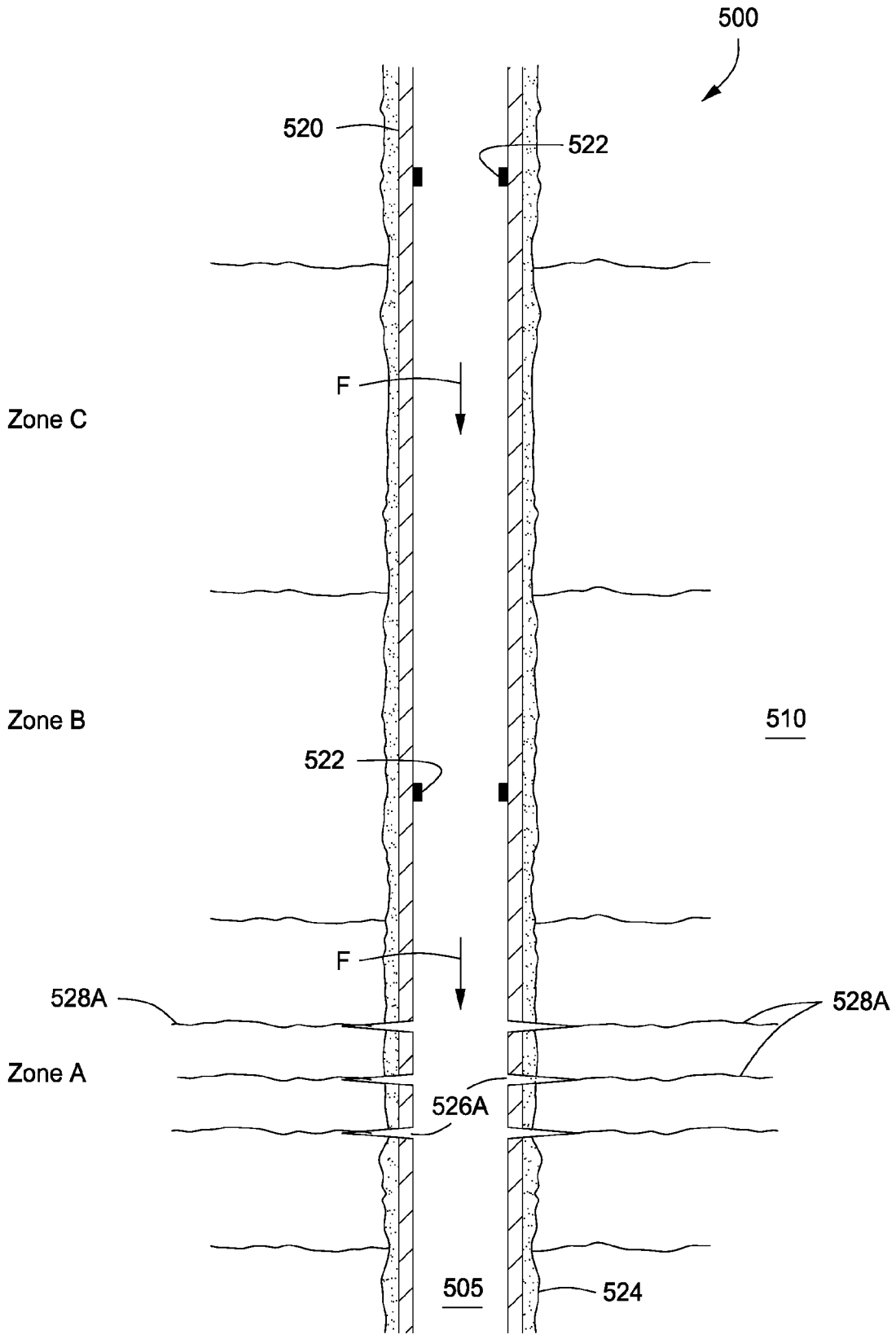
FIG. 5E is yet another side view of the wellbore of FIG. 5A. Here, fluid is being injected into the wellbore under high pressure, causing the rock matrix within the zone of interest "A" to be fractured.

FIG. 5E is yet another side view of the wellbore 500 of FIG. 5A. Here, fluid is being injected into the bore 505 of the wellbore under high pressure, causing the formation within the zone of interest "A" to be fractured. Downward movement of the fluid is indicated by arrows "F." The fluid moves through the perforations 526A and into the surrounding subsurface 510. This causes fractures 528A to be formed within the zone of interest "A." An acid solution may also optionally be circulated into the bore 505 to dissolve drilling mud and to remove carbonate build-up and further stimulate the subsurface 510 for hydrocarbon production.

Figure 5F:
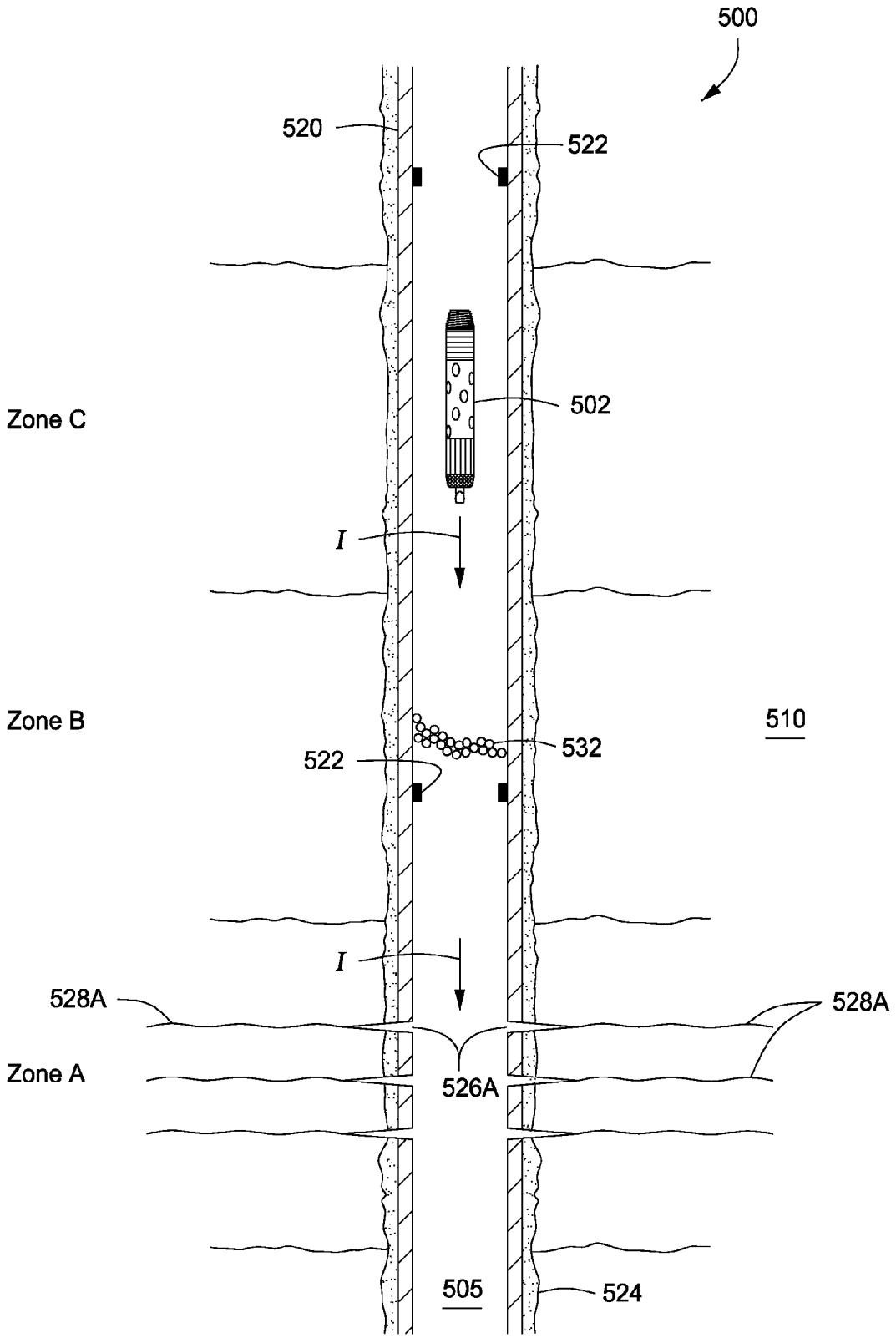
FIG. 5F is yet another side view of the wellbore of FIG. 5A. Here, the wellbore has received a second perforating gun assembly. In addition, ball sealers have been dropped into the wellbore ahead of the second perforating gun assembly.

FIG. 5F is yet another side view of the wellbore 500 of FIG. 5A. Here, the wellbore 500 has received a second perforating gun assembly 502. The second perforating gun assembly 502 may be constructed and arranged as the first perforating gun assembly 501. This means that the second perforating gun assembly 502 is also autonomous, and is also constructed of a friable material.

It can be seen in FIG. 5F that the second perforating gun assembly 502 is moving downwardly in the wellbore 500, as indicated by arrow "I." The second perforating gun assembly 502 may be simply falling through the wellbore 500 in response to gravitational pull. In addition, the operator may be assisting the downward movement of the perforating gun assembly 502 by applying hydraulic pressure through the use of surface pumps (not shown).

In addition to the gun assembly 502, ball sealers 532 have been dropped into the wellbore 500. The ball sealers 532 are preferably dropped ahead of the second perforating gun assembly 502. Optionally, the ball sealers 532 are released from a ball container (shown at 318 in FIG. 3). The ball sealers 532 are fabricated from composite material and are rubber coated. The ball sealers 532 are dimensioned to plug the perforations 526A.

The ball sealers 532 are intended to be used as a diversion agent. The concept of using ball sealers as a diversion agent for stimulation of multiple perforation intervals is known. The ball sealers 532 will seat on the perforations 526A, thereby plugging the perforations 526A and allowing the operator to inject fluid under pressure into a zone above the perforations 526A. The ball sealers 532 provide a low-cost diversion technique, with a low risk of mechanical issues.

Figure 5G:
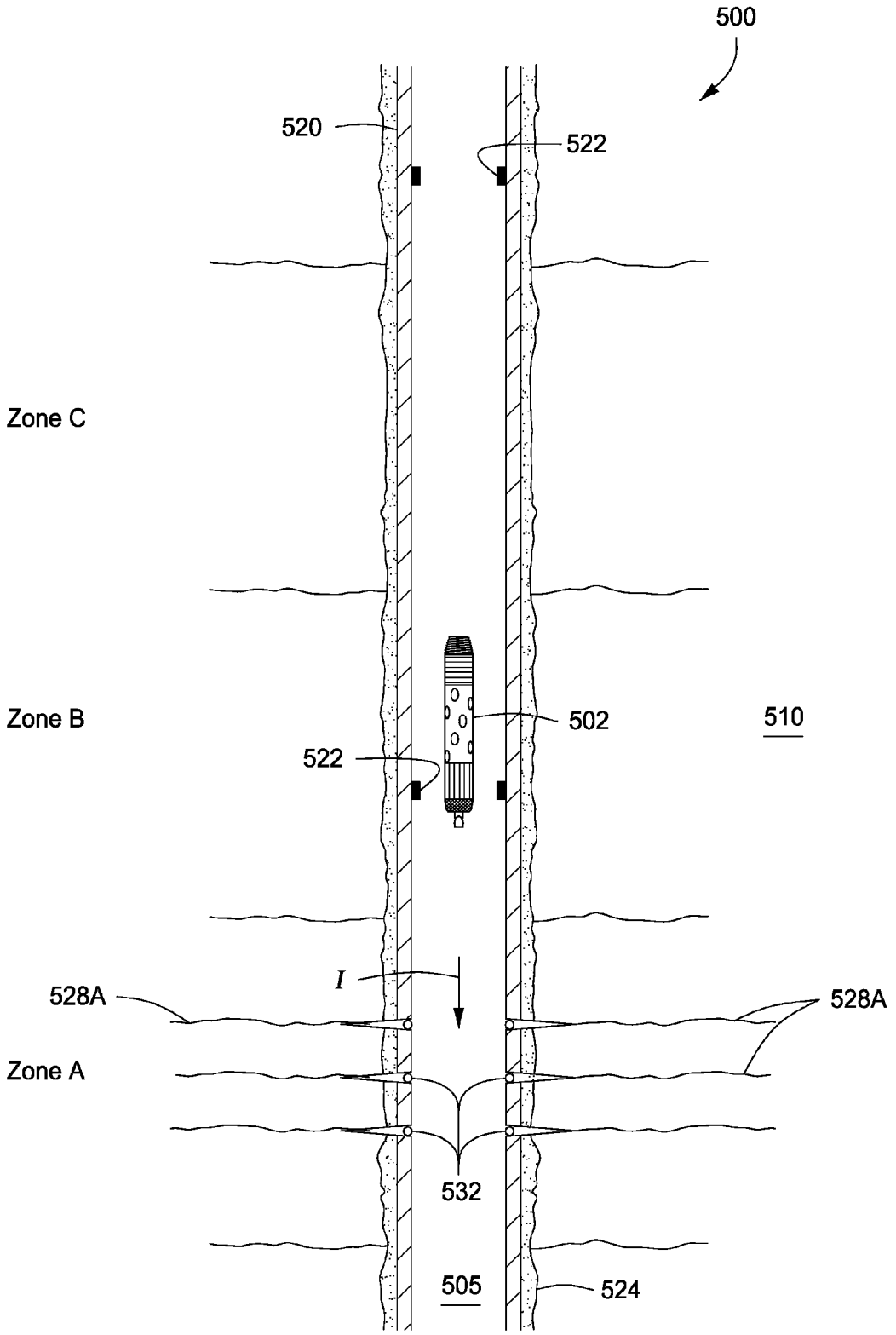
FIG. 5G is still another side view of the wellbore of FIG. 5A. Here, the second fracturing plug assembly has fallen into the wellbore to a position adjacent the zone of interest "B." In addition, the ball sealers have plugged the newly-formed perforations along the zone of interest "A."

FIG. 5G is still another side view of the wellbore 500 of FIG. 5A. Here, the second fracturing plug assembly 502 has fallen into the wellbore 500 to a position adjacent the zone of interest "B." In addition, the ball sealers 532 have temporarily plugged the newly-formed perforations along the zone of interest "A." The ball sealers 532 will later either flow out with produced hydrocarbons, or drop to the bottom of the well in an area known as the rat (or junk) hole.

Figure 5H:
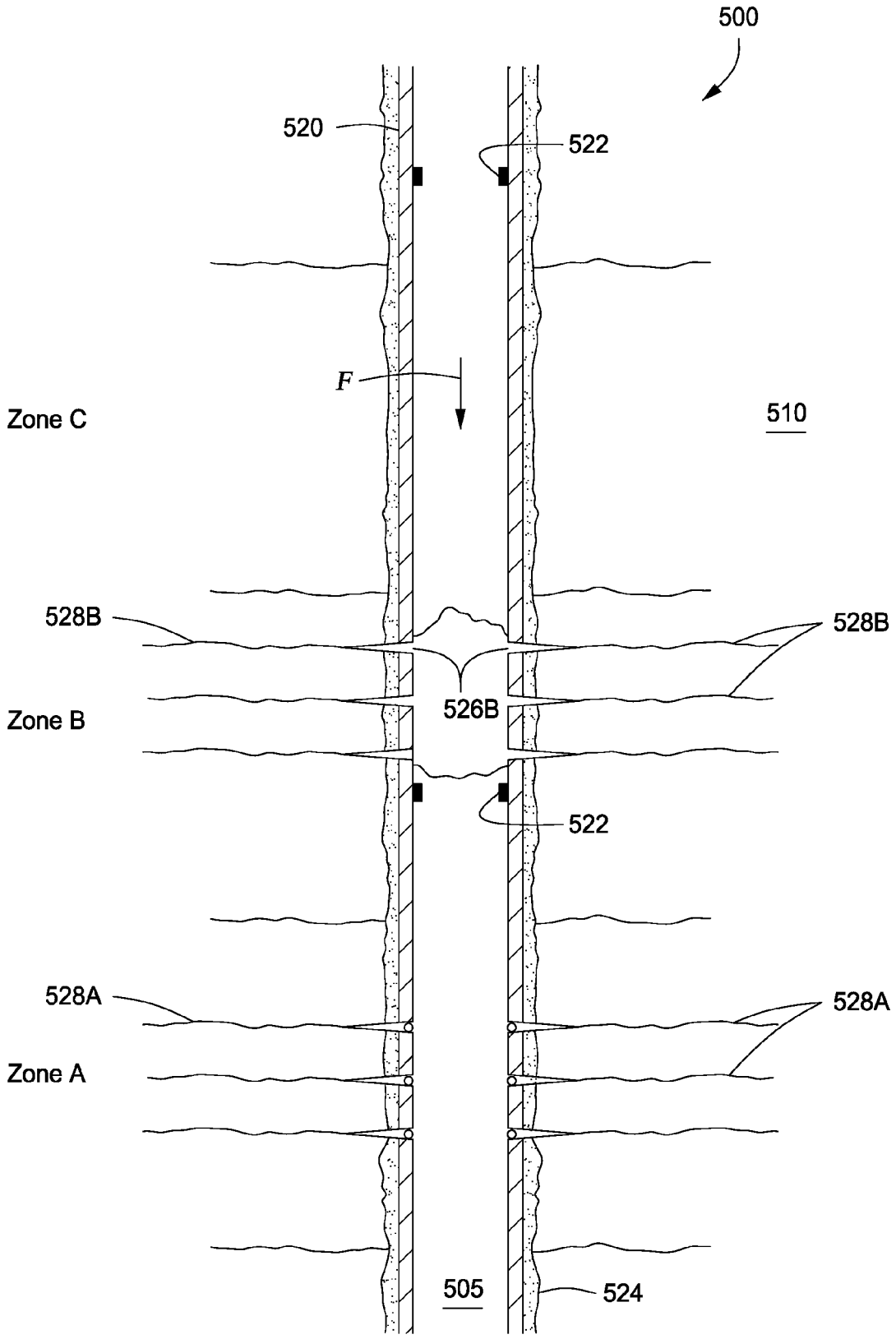
FIG. 5H is another side view of the wellbore of FIG. 5A. Here, the charges of the second perforating gun assembly have been detonated, causing the perforating gun of the perforating gun assembly to fire. The casing along the zone of interest "B" has been perforated. Zone "B" is above zone of interest "A." In addition, fluid is being injected into the wellbore under high pressure, causing the rock matrix within the zone of interest "B" to be fractured.

FIG. 5H is another side view of the wellbore 500 of FIG. 5A. Here, charges of the second perforating gun assembly 502 have been detonated, causing the perforating gun of the perforating gun assembly 502 to fire. The zone of interest "B" has been perforated. A set of perforations 526B is shown extending from the wellbore 500 and into the subsurface 510. While only six perforations 526B are shown in side view, it us understood that additional perforations are formed, and that such perforations will extend radially around the production casing 520.

In addition to the creation of perforations 456B, the perforating gun assembly 502 is self-destructed. Any pieces left from the assembly 501 will likely fall to the bottom of the production casing 520 or later flow back to the surface.

It is also noted in FIG. 5H that fluid continues to be injected into the bore 505 of the wellbore 500 while the perforations 526B are being formed. Fluid flow is indicated by arrow "F." Because ball sealers 532 are substantially plugging the lower perforations along zone "A," pressure is able to build up in the wellbore 500. Once the perforations 526B are shot, the fluid escapes the wellbore 500 and invades the subsurface 510 within zone "B." This immediately creates fractures 528B.

It is understood that the process used for forming perforations 526B and formation fractures 528B along zone of interest "B" may be repeated in order to form perforations and formation fractures in zone of interest "C," and other higher zones of interest. This would include the placement of ball sealers along perforations 528B at zone "B," running a third autonomous perforating gun assembly (not shown) into the wellbore 500, causing the third perforating gun assembly to detonate along zone of interest "C," and creating perforations and formation fractures along zone "C."

Figure 5I:
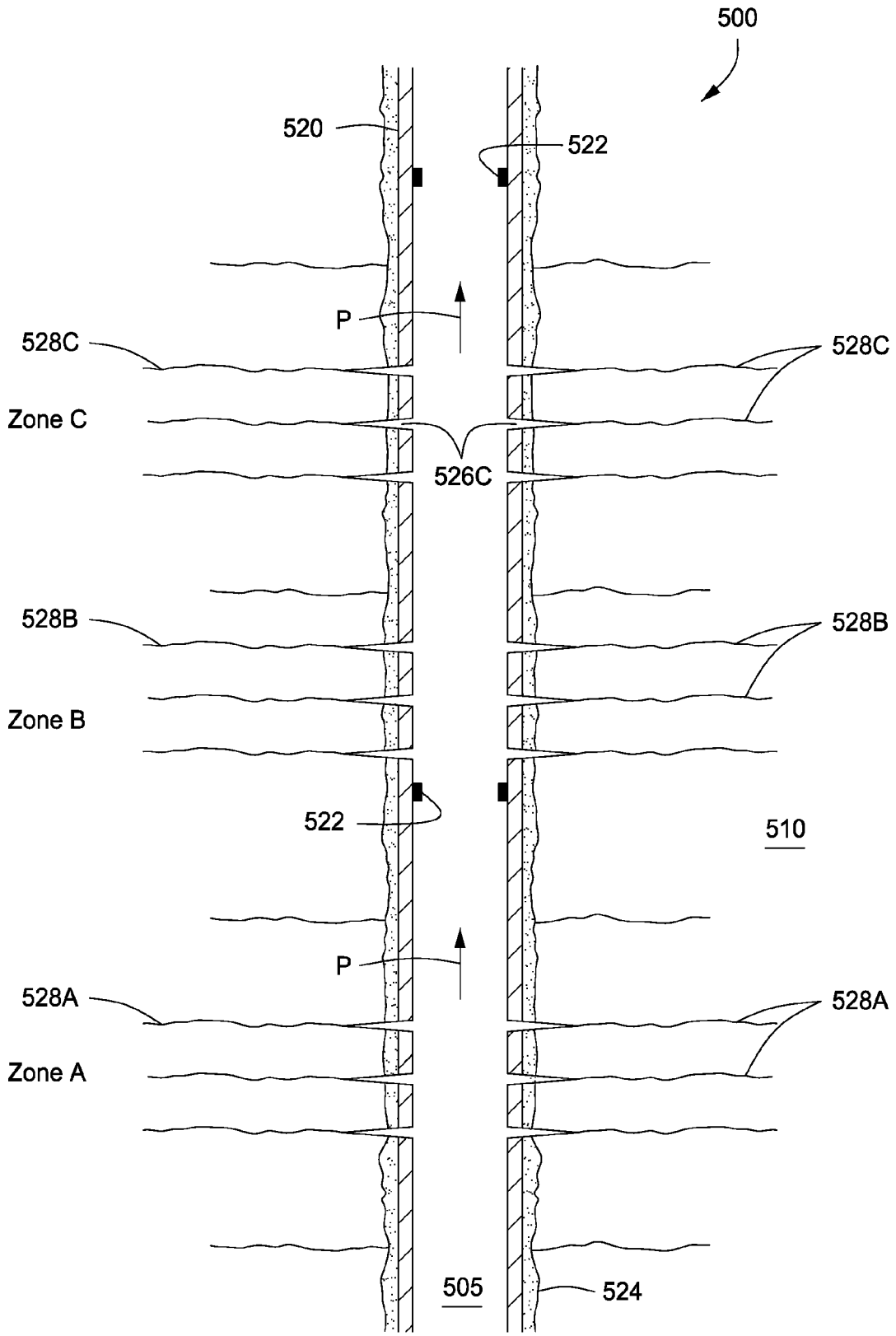
FIG. 5I provides a final side view of the wellbore of FIG. 5A. Here, the production casing has been perforated along zone of interest "C." Multiple sets of perforations are seen. In addition, formation fractures have been formed in the subsurface along zone "C." The ball sealers have been flowed back to the surface.

FIG. 5I provides a final side view of the wellbore 500 of FIG. 5A. Here, the production casing 520 has been perforated along zone of interest "C." Multiple sets of perforations 526C are seen. In addition, formation fractures 528C have been formed in the subsurface 510.

In FIG. 5I, the wellbore 500 has been placed in production. The ball sealers have been removed and have flowed to the surface. Formation fluids are flowing into the bore 505 and up the wellbore 500. Arrows "P" indicate a flow of fluids towards the surface.

FIGS. 5A through 5I demonstrate how perforating gun assemblies may be dropped into a wellbore 500 sequentially, with the on-board controller of each perforating gun assembly being programmed to ignite its respective charges at different selected depths. In the depiction of FIGS. 5A through 5I, the perforating gun assemblies are dropped in such a manner that the lowest zone (Zone "A") is perforated first, followed by sequentially shallower zones (Zone "B" and then Zone "C"). However, using autonomous perforating gun assemblies, the operator may perforate subsurface zones in any order. Beneficially, perforating gun assemblies may be dropped in such a manner that subsurface zones are perforated from the top, down. This means that the perforating gun assemblies would detonate in the shallower zones before detonating in the deeper zones.

It is also noted that FIGS. 5A through 5I demonstrate the use of a perforating gun assembly and a fracturing plug assembly as autonomous tool assemblies. However, additional actuatable tools may be used as part of an autonomous tool assembly. Such tools include, for example, bridge plugs, cutting tools, cement retainers and casing patches. In these arrangements, the tools will be dropped or pumped or carried into a wellbore constructed to produce hydrocarbon fluids or to inject fluids. The tool may be fabricated from a friable material or from a millable material.

As an alternative to the use of separate fracturing plug and perforating gun assemblies, a combination of a fracturing plug assembly 200' and a perforating gun assembly 300' may be deployed together as an autonomous unit. Such a combination adds further optimization of equipment utilization. In this combination, the plug assembly 200' is set, then the perforating gun of the perforating gun assembly 300' fires directly above the plug assembly.

Figure 6A:
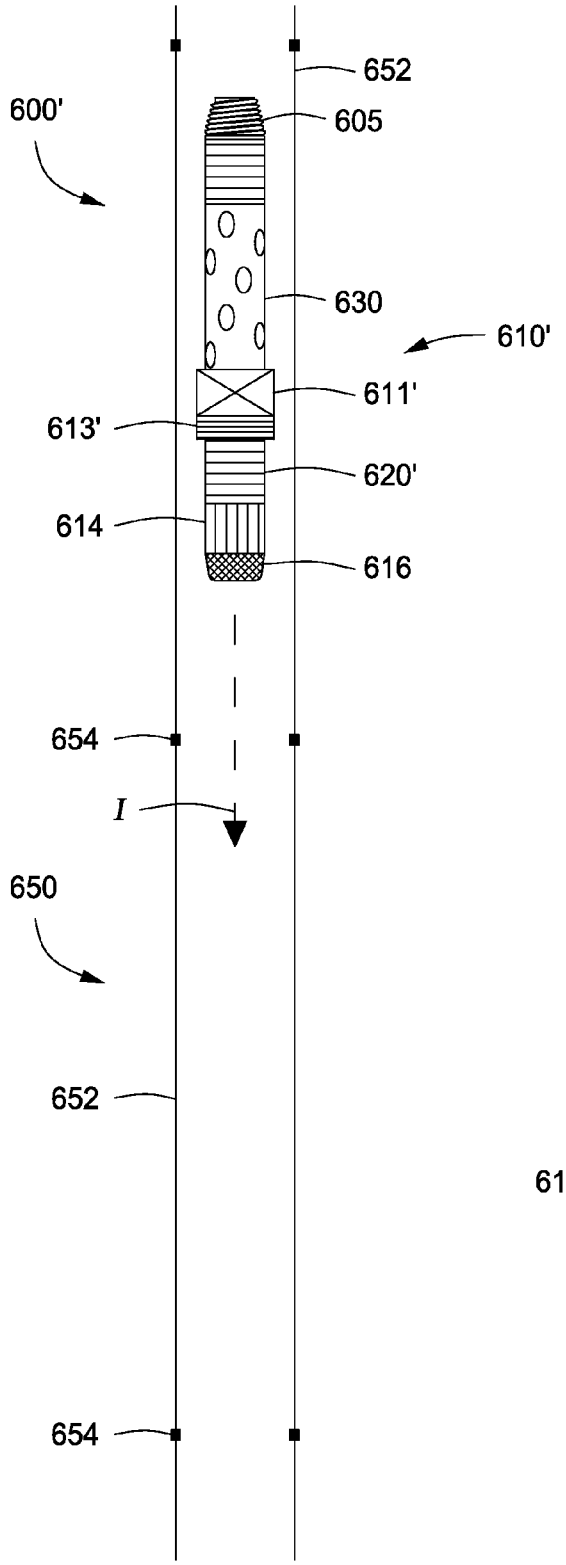
FIGS. 6A and 6B present side views of a lower portion of a wellbore receiving an integrated tool assembly for performing a wellbore operation. The wellbore is being completed in a single zone.
Figure 6B:
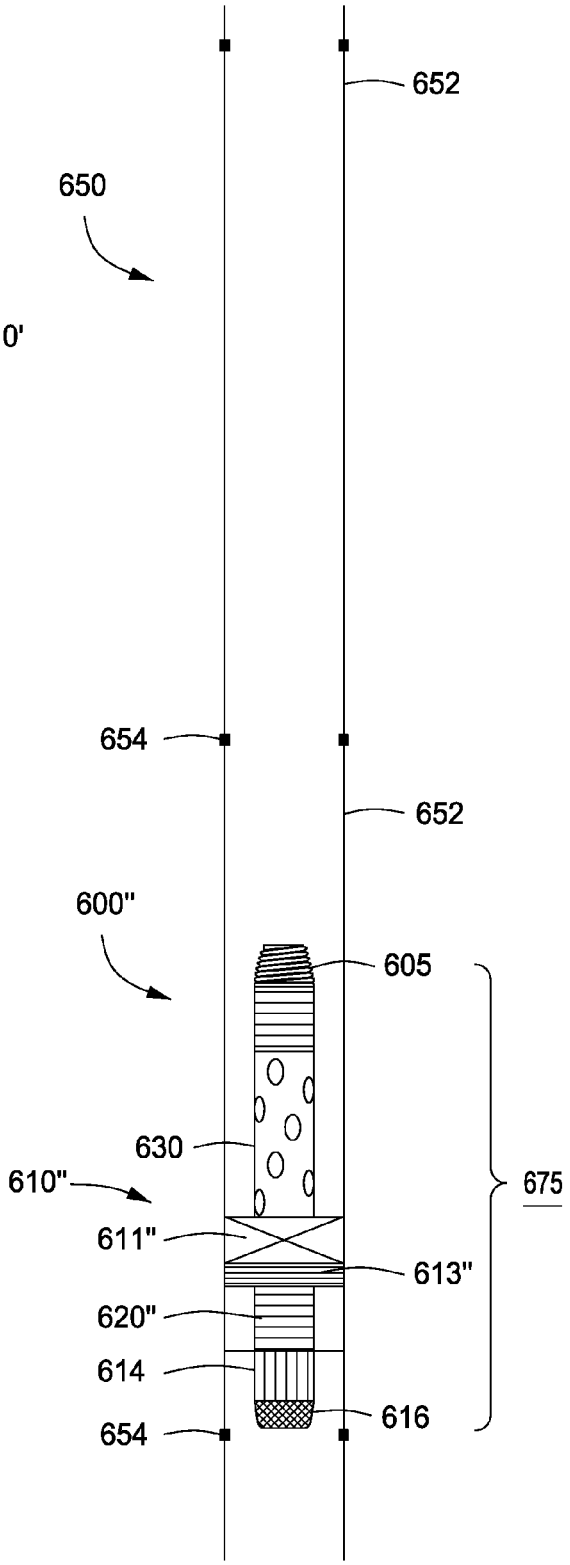

FIGS. 6A and 6B demonstrate such an arrangement. First, FIG. 6A provides a side view of a lower portion of a wellbore 650. The illustrative wellbore 650 is being completed in a single zone. A string of production casing is shown schematically at 652, while casing collars are seen at 654. An autonomous tool 600' has been dropped down the wellbore 650 through the production casing 652. Arrow "I" indicates the movement of the tool 600' traveling downward through the wellbore 650.

The autonomous tool 600' represents a combined plug assembly and perforating gun assembly. This means that the single tool 600' comprises components from both the plug assembly 200' and the perforating gun assembly 300' of FIGS. 2 and 3, respectively.

First, the autonomous tool 600' includes a plug body 610'. The plug body 610' will preferably define an elastomeric sealing element 611' and a set of slips 613'. The autonomous tool 600' also includes a setting tool 620'. The setting tool 620' will actuate the sealing element 611' and the slips 613', and translate them radially to contact the casing 652.

In the view of FIG. 6A, the plug body 610' has not been actuated. Thus, the tool 600' is in a run-in position. In operation, the sealing element 611' of the plug body 610' may be mechanically expanded in response to a shift in a sleeve or other means as is known in the art. This allows the sealing element 611' to provide a fluid seal against the casing 652. At the same time, the slips 613' of the plug body 610' ride outwardly from the assembly 600' along wedges (not shown) spaced radially around the assembly 600'. This allows the slips 613' to extend radially and "bite" into the casing 652, securing the tool assembly 600' in position against downward hydraulic force.

The autonomous tool 600' also includes a position locator 614. The position locator 614 serves as a location device for sensing the location of the tool 600' within the production casing 650. More specifically, the position locator 614 senses the presence of objects or "tags" along the wellbore 650, and generates depth signals in response. In the view of FIG. 6A, the objects are casing collars 654. This means that the position locator 614 is a casing collar locator, or "CCL." The CCL senses the location of the casing collars 654 as it moves down the wellbore 650.

The tool 600' also includes a perforating gun 630. The perforating gun 630 may be a select fire gun that fires, for example, 16 shots. As with perforating gun 312 of FIG. 3, the gun 630 has an associated charge that detonates in order to cause shots to be fired into the surrounding production casing 650. Typically, the perforating gun 630 contains a string of shaped charges distributed along the length of the gun and oriented according to desired specifications.

The autonomous tool 600' optionally also includes a fishing neck 605. The fishing neck 605 is dimensioned and configured to serve as the male portion to a mating downhole fishing tool (not shown). The fishing neck 605 allows the operator to retrieve the autonomous tool 600 in the unlikely event that it becomes stuck in the wellbore 600' or the perforating gun 630 fails to detonate.

The autonomous tool 600' further includes an on-board controller 616. The on-board controller 616 processes the depth signals generated by the position locator 614. In one aspect, the on-board controller 616 compares the generated signals with a pre-determined physical signature obtained for the wellbore objects. For example, a CCL log may be run before deploying the autonomous tool 600 in order to determine the spacing of the casing collars 654. The corresponding depths of the casing collars 654 may be determined based on the length and speed of the wireline pulling a CCL logging device.

Upon determining that the autonomous tool 600' has arrived at the selected depth, the on-board controller 616 activates the setting tool 620. This causes the plug body 610 to be set in the wellbore 650 at a desired depth or location.

FIG. 6B is a side view of the wellbore of FIG. 6A. Here, the autonomous tool 600" has reached a selected depth. The selected depth is indicated at bracket 675. The on-board controller 616 has sent a signal to the setting tool 620" to actuate the elastomeric ring 611" and slips 613" of the plug body 610'.

In FIG. 6B, the plug body 610" is shown in an expanded state. In this respect, the elastomeric sealing element 611" is expanded into sealed engagement with the surrounding production casing 652, and the slips 613" are expanded into mechanical engagement with the surrounding production casing 652. The sealing element 611" offers a sealing ring, while the slips 613" offer grooves or teeth that "bite" into the inner diameter of the casing 650.

After the autonomous tool 600" has been set, the on-board controller 616 sends a signal to ignite charges in the perforating gun 630. The perforating gun 630 creates perforations through the production casing 652 at the selected depth 675. Thus, in the arrangement of FIGS. 6A and 6B, the setting tool 620 and the perforating gun 630 together define an actuatable tool.

Figure 7:
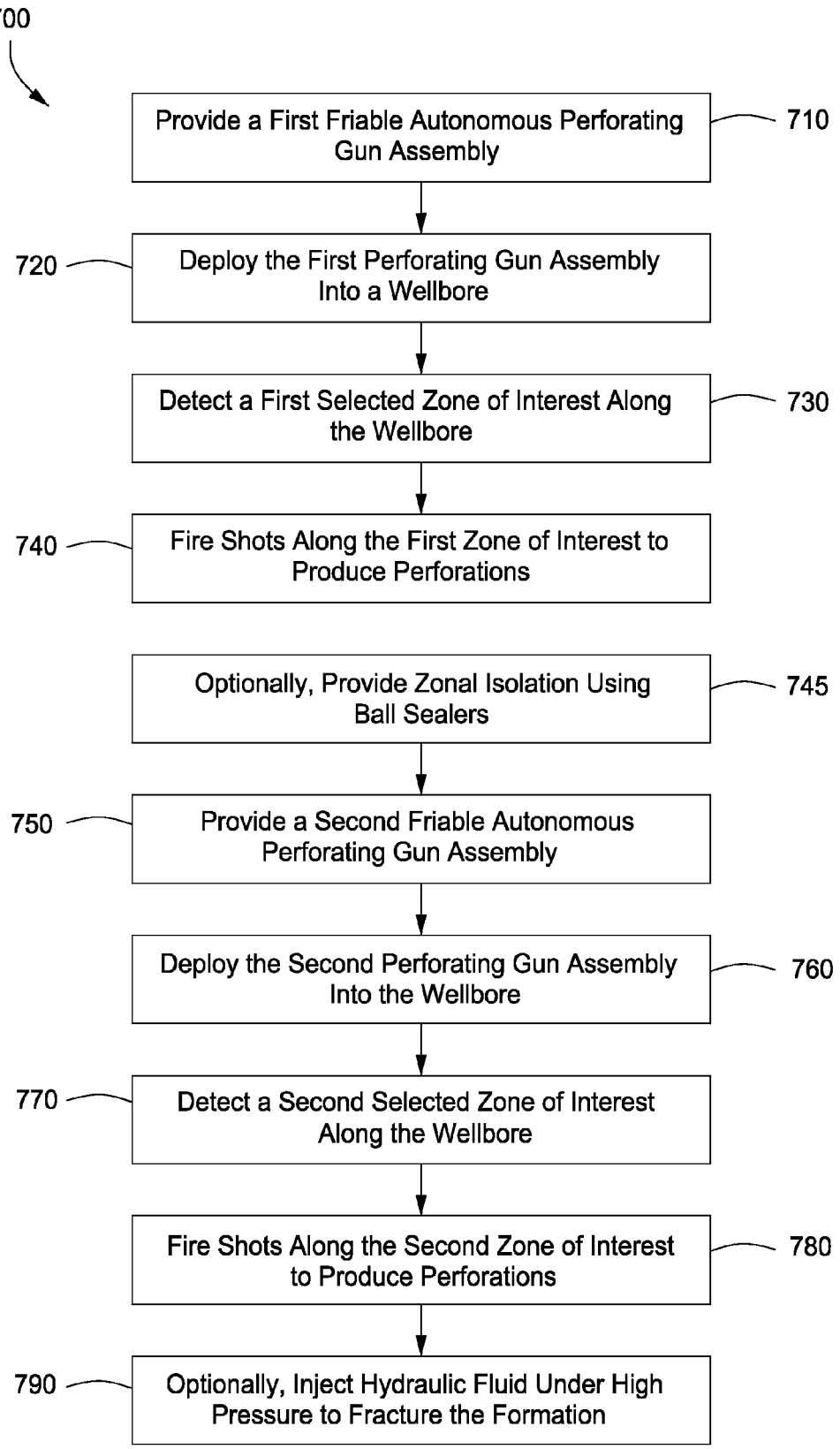
FIG. 7 is a flowchart showing steps for completing a wellbore using autonomous tools, in one embodiment.

FIG. 7 is a flowchart showing steps for a method 700 for completing a wellbore using autonomous tools, in one embodiment. In accordance with the method 700, the wellbore is completed along multiple zones of interest. A string of production casing (or liner) has been run into the wellbore, and the production casing has been cemented into place.

The method 700 first includes providing a first autonomous perforating gun assembly. This is shown in Box 710. The first autonomous perforating gun assembly is manufactured in accordance with the perforating gun assembly 300' described above, in its various embodiments. The first autonomous perforating gun assembly is substantially fabricated from a friable material, and is designed to self-destruct, preferably upon detonation of charges.

The method 700 next includes deploying the first perforating gun assembly into the wellbore. This is seen at Box 720. The first perforating gun assembly is configured to detect a first selected zone of interest along the wellbore. Thus, as the first perforating gun assembly is pumped or otherwise falls down the wellbore, it will monitor its depth or otherwise determine when it has arrived at the first selected zone of interest.

The method 700 also includes detecting the first selected zone of interest along the wellbore. This is seen at Box 730. In one aspect, detecting is accomplished by pre-loading a physical signature of the wellbore. The perforating gun assembly seeks to match the signature as it traverses through the wellbore. The perforating gun assembly ultimately detects the first selected zone of interest by matching the physical signature. The signature may be matched, for example, by counting casing collars or through a collar pattern matching algorithm.

The method 700 further includes firing shots along the first zone of interest. This is provided at Box 740. Firing shots produces perforations. The shots penetrate a surrounding string of production casing and extend into the subsurface formation.

The method 700 also includes providing a second autonomous perforating gun assembly. This is seen at Box 750. The second autonomous perforating gun assembly is also manufactured in accordance with the perforating gun assembly 300' described above, in its various embodiments. The second autonomous perforating gun assembly is also substantially fabricated from a friable material, and is designed to self-destruct upon detonation of charges.

The method 700 further includes deploying the first perforating gun assembly into the wellbore. This is seen at Box 760. The second perforating gun assembly is configured to detect a second selected zone of interest along the wellbore. Thus, as the second perforating gun assembly is pumped or otherwise falls down the wellbore, it will monitor its depth or otherwise determine when it has arrived at the second selected zone of interest.

The method 700 also includes detecting the second selected zone of interest along the wellbore. This is seen at Box 770. Detecting may again be accomplished by pre-loading a physical signature of the wellbore. The perforating gun assembly seeks to match the signature as it traverses through the wellbore. The perforating gun assembly ultimately detects the second selected zone of interest by matching the physical signature.

The method 700 further includes firing shots along the second zone of interest. This is provided in Box 780. Firing shots produces perforations. The shots penetrate the surrounding string of production casing and extend into the subsurface formation. Preferably, the second zone of interest is above the first zone of interest, although it may be below the first zone of interest.

The method 700 may optionally include injecting hydraulic fluid under high pressure to fracture the formation. This is shown at Box 790. The formation may be fractured by directing fluid through perforations along the first selected zone of interest, by directing fluid through perforations along the second selected zone of interest, or both. Preferably, the fluid contains proppant.

Where multiple zones of interest are being perforated and fractured, it is desirable to employ a diversion agent. Acceptable diversion agents may include the autonomous fracturing plug assembly 200' described above, and the ball sealers 532 described above. The ball sealers are pumped downhole to seal off the perforations, and may be placed in a leading flush volume. In one aspect, the ball sealers are carried downhole in a container, and released via command from the on-board controller below the second perforating gun assembly.

The steps of Box 750 through Box 790 may be repeated numerous times for multiple zones of interest. A diversion technique may not be required for every set of perforations, but may possibly be used only after several zones have been perforated.

The method 700 is applicable for vertical, inclined, and horizontally completed wells. The type of the well will determine the delivery method of and sequence for the autonomous tools. In vertical and low-angle wells, the force of gravity may be sufficient to ensure the delivery of the assemblies to the desired depth or zone. In higher angle wells, including horizontally completed wells, the assemblies may be pumped down or delivered using tractors. To enable pumping down of the first assembly, the casing may be perforated at the toe of the well.

It is also noted that the method 700 has application for the completion of both production wells and injection wells.

The above-described tools and methods concern an autonomous tool, that is, a tool that is not actuated from the surface. The autonomous tool would again be a tool assembly that includes an actuatable tool. The tool assembly also includes a location device. The location device serves to sense the location of the actuatable tool within the wellbore based on a physical signature provided along the wellbore. The location device and corresponding physical signature may operate in accordance with the embodiments described above for the autonomous tool assemblies 200' (of FIG. 2) and 300' (of FIG. 3). For example, the location device may be a collar locator, and the signature is formed by the spacing of collars along the tubular body, with the collars being sensed by the collar locator.

The tool assembly further includes an on-board controller. The on-board controller is configured to send an actuation signal to the tool when the location device has recognized a selected location of the tool based on the physical signature. The actuatable tool is designed to be actuated to perform the wellbore operation in response to the actuation signal.

In one embodiment, the actuatable tool further comprises a detonation device. In this embodiment, the tool assembly is fabricated from a friable material. The on-board controller is further configured to send a detonation signal to the detonation device a designated time after the on-board controller is armed. Alternatively, the tool assembly self-destructs in response to the actuation of the actuatable tool. This may apply where the actuatable tool is a perforating gun. In either instance, the tool assembly may be self-destructing.

In one arrangement, the actuatable tool is a fracturing plug. The fracturing plug is configured to form a substantial fluid seal when actuated within the tubular body at the selected location. The fracturing plug comprises an elastomeric sealing element and a set of slips for holding the location of the tool assembly proximate the selected location.

In another arrangement, the actuatable tool is a bridge plug. Here, the bridge plug is configured to form a substantial fluid seal when actuated within the tubular body at the selected location. The tool assembly is fabricated from a millable material. The bridge plug comprises an elastomeric sealing element and a set of slips for holding the location of the tool assembly proximate the selected location.

Other tools may serve as the actuatable tool. These may include a casing patch and a cement retainer. These tools may be fabricated from a millable material, such as ceramic, phenolic, composite, cast iron, brass, aluminum, or combinations thereof.

In each of the above-described embodiments for an autonomous tool (200', 300', 610'), the on-board controller may be pre-programmed with the physical signature of the wellbore undergoing completion. This means that a baseline CCL log is run before deploying the autonomous tool in order to determine the unique spacing of the casing collars. The magnetic signals from the CCL log are converted into a suitable data set comprised of digital values. The digital data set is then preloaded into the controller.

The CCL log correlates collar location with depth. The operator may select a location within the wellbore in which to actuate a downhole tool. In order to sense the location of the casing collars, an algorithm may be provided for the controller so that an actuation signal may be sent at the appropriate depth in the wellbore to actuate a wellbore device. Such a device may be, for example, a fracturing plug or a fracturing gun.

Casing collar locators operate by sensing changes in magnetic flux along a casing wall. Such changes are induced by differences in the thickness of the metallic pipe forming the joints of casing. These changes in wall thickness induce electrical current to flow in a wire or along a coil. The casing collar locator detects these changes and records them as magnetic signals.

It is noted that a CCL will carry its own processor. The processor converts the recorded magnetic signals into digital form using an analog-to-digital converter. These signals may then be uploaded for review and saved as part of the well's file.

It is known to refer to CCL logs in connection with the completion or servicing of a well. The CCL log provides a digital data set that may be used as a reference point for the placement of perforations or downhole equipment. However, it is proposed herein to use a casing collar locator as part of an autonomous tool. As the autonomous tool is deployed into a wellbore, it creates a second CCL log.

The autonomous tool has a processor that receives magnetic signals from the on-board casing collar locator. The processor stores these signals as a second CCL data set. The processor is programmed to transform the signals in the second CCL data set using a moving windowed statistical analysis. In addition, the processor incrementally compares the transformed CCL log with the first CCL log during deployment of the downhole tool. The processor then correlates values between the logs that are indicative of casing collar locations. In this way, the autonomous tool knows its location along the wellbore at all times.

Figure 8:
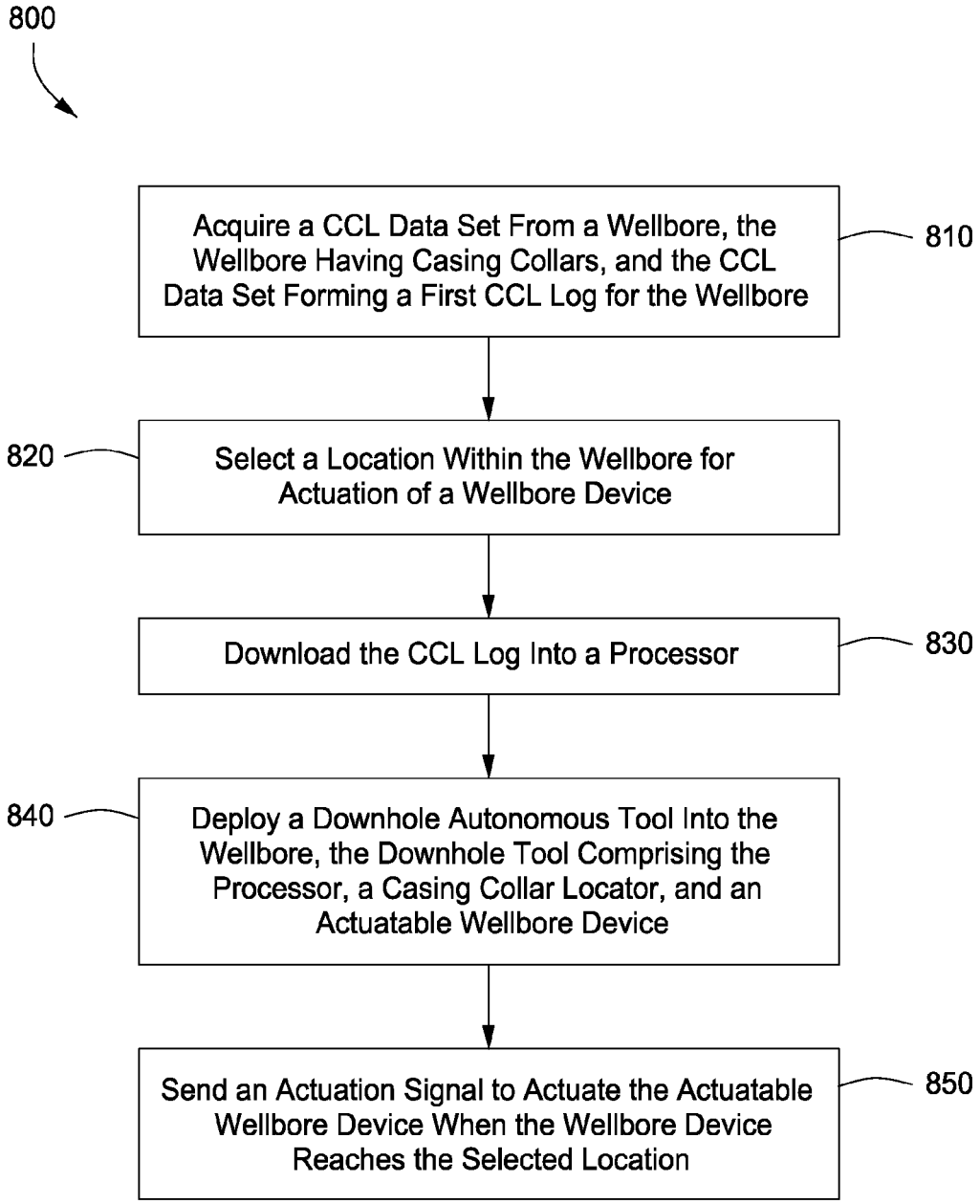
FIG. 8 is a flowchart showing general steps for a method of actuating a downhole tool, in one embodiment. The method is carried out in a wellbore completed as a cased hole.

FIG. 8 provides a flowchart showing general steps for a method 800 of actuating a downhole tool. The method 800 is carried out in a wellbore completed as a cased hole.

The method 800 first includes acquiring a CCL data set from a wellbore. This is shown in Box 810. The CCL data set is obtained through a CCL log that is run into the wellbore on a wireline. The wireline may be, for example, a slick line, a braided wire line, an electric line, or other line. The CCL data set represents a first CCL log for the wellbore.

The first CCL log provides a physical signature for the wellbore. In this respect, the CCL log correlates casing collar location with depth according to the unique spacing provided by the pipe lining the wellbore. Optionally, the pipe includes pup joints at irregular intervals to serve as confirmatory checks.

The method 800 also includes selecting a location within the wellbore for actuating a wellbore device. This is provided at Box 820. The wellbore device may be, for example, a perforating gun or a fracturing plug. The location is chosen with reference to the first CCL log.

The method 800 next includes downloading the first CCL log into a processor. This is shown at Box 830. The processor is an on-board controller that is part of an autonomous tool. The autonomous tool also includes the actuatable wellbore device. Thus, where the wellbore device is a perforating gun, the autonomous tool is a perforating gun assembly.

The method 800 next comprises deploying the downhole autonomous tool into the wellbore. This is indicated at Box 840. The downhole tool comprises the processor, the casing collar locator, and the actuatable wellbore device. Optionally, the downhole tool also includes a battery pack and a fishing neck.

Finally, the method 800 includes sending an actuation signal to actuate the actuatable wellbore device. This is provided at Box 850. The signal is sent from the processor to the wellbore device. Where the wellbore device is a perforating gun, the perforating gun is detonated, causing perforations to be formed in the casing.

As indicated in Box 850, the wellbore device is actuated at the selected location. This is the location selected in Box 820. In order for the processor to know when to send the actuation signal, the processor is pre-programmed.

Figure 9:
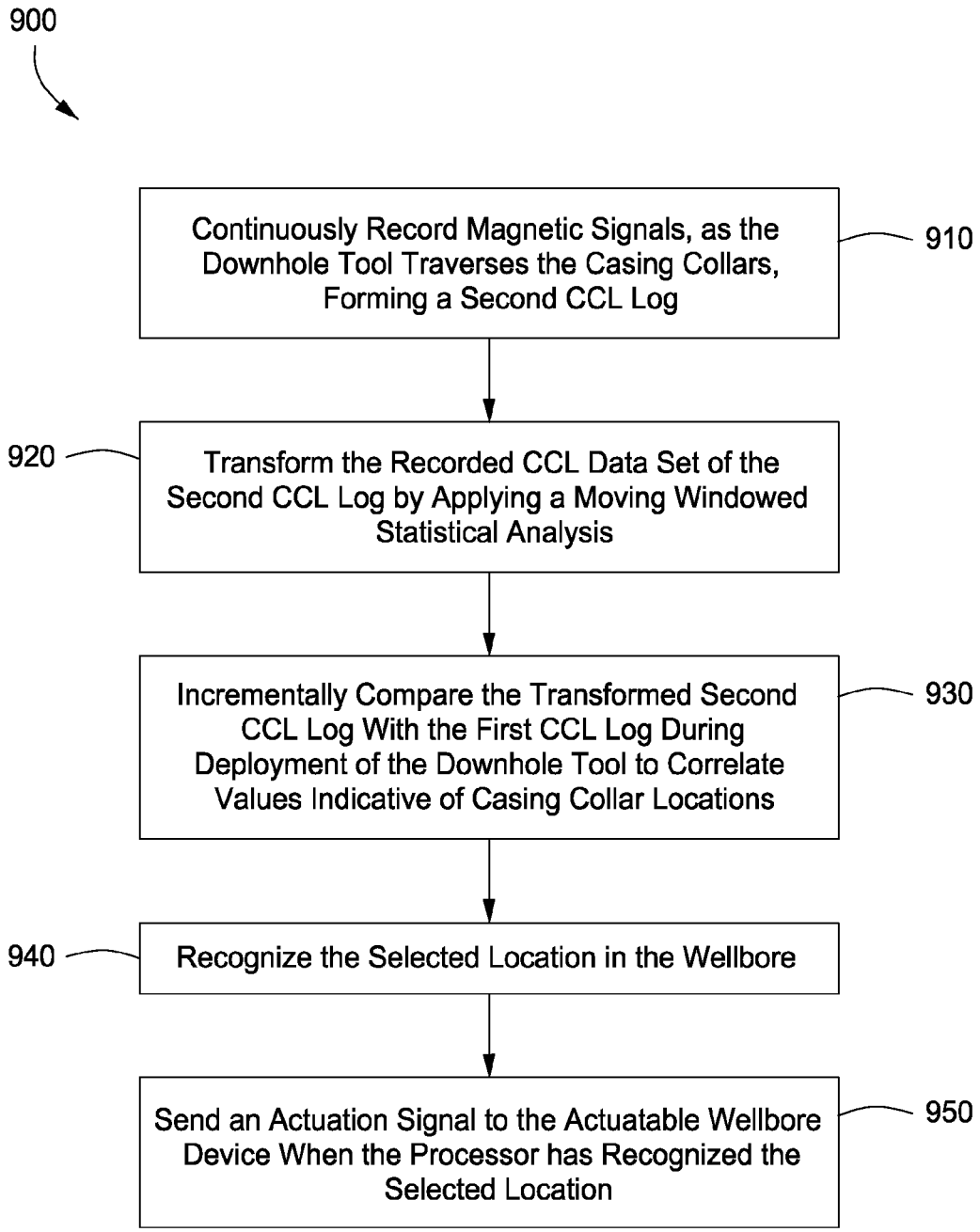
FIG. 9 is a flowchart showing features of an algorithm as may be used for actuating the downhole tool in accordance with the method of FIG. 8, in one embodiment.

FIG. 9 provides features of an algorithm as may be used for actuating the downhole tool. The algorithm is in the form of steps, provided generally at 900. First, the processor is programmed to record magnetic signals. The step of recording magnetic signals is shown at Box 910. The signals are obtained through the casing collar locator as the downhole tool is deployed. Specifically, the signals are recorded continuously, such as, for example, 150 times per second, as the downhole tool traverses the casing collars along the wellbore. The magnetic signals form a second CCL log.

The steps 900 next include transforming the second CCL data set of the second log. This is indicated at Box 920. The second CCL data set is transformed by applying a moving windowed statistical analysis.

Figure 10:
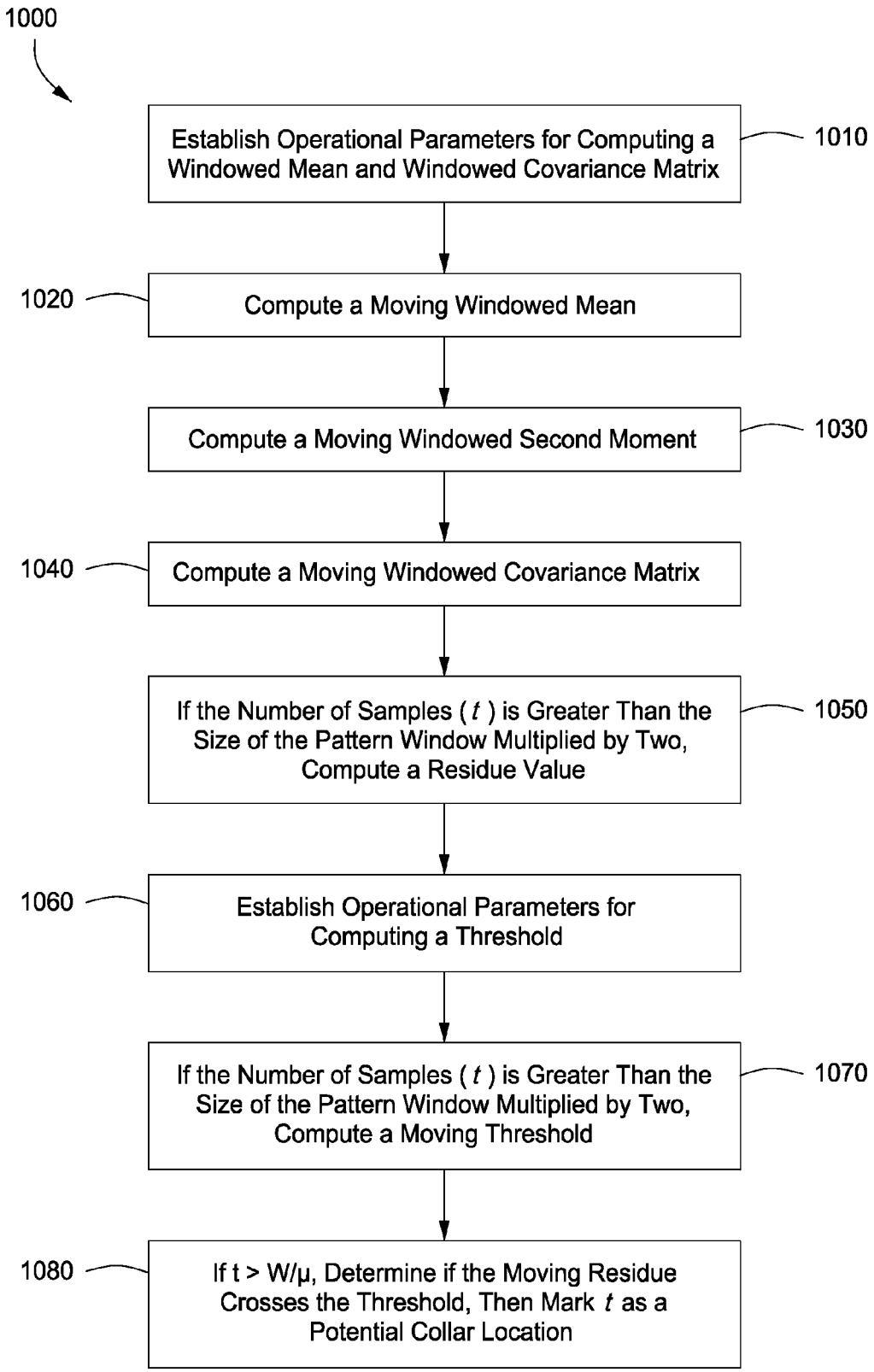
FIG. 10 is a flowchart that provides a list of steps that may be used for applying a moving windowed statistical analysis as part of the algorithm of FIG. 9, in one embodiment. Applying the moving windowed statistical analysis allows the algorithm to determine whether magnetic signals in their transformed state exceed a designated threshold.

FIG. 10 provides a list of steps that may be used for applying the moving windowed statistical analysis. These steps are shown generally at 1000, and represent an algorithm. Applying the moving windowed statistical analysis allows the algorithm 1000 to determine whether magnetic signals in their transformed state exceed a designated threshold. If the signal values exceed the threshold, then they are marked as a potential start of a collar location.

In carrying out the algorithm 1000, certain operational parameters are first established. This is provided at Box 1010. The operational parameters relate to the calculation of a windowed mean and a covariance matrix.

Figure 11:
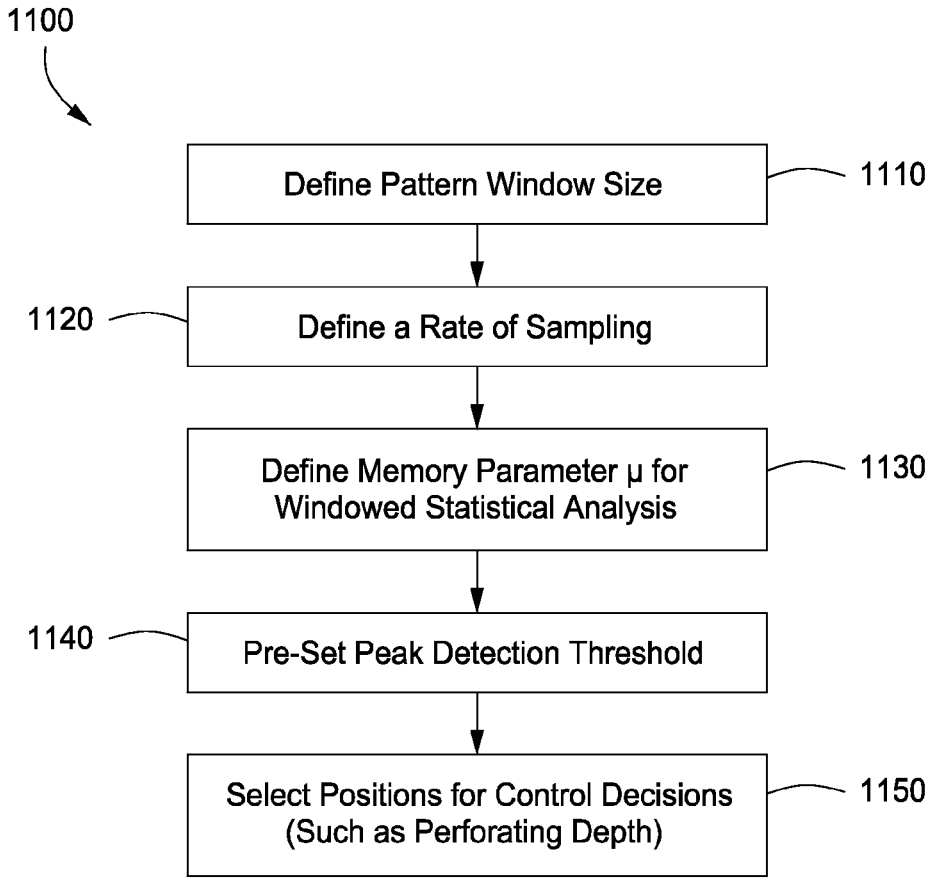
FIG. 11 provides a flowchart for determinations that are made for the operational parameters, in one embodiment. The operational parameters relate to the windowed statistical analysis.

FIG. 11 provides a flowchart for determinations 1100 that are made for the operational parameters. One of the operational parameters relates to what is referred to as a "pattern window." The pattern window (W) is a set of magnetic signal values recorded by the CCL sensor. The operator must determine the window size (W') for the pattern windows. This is seen at Box 1110.

It is preferred that the pattern window (W) be sized to cover less than one collar of data. This determination is dependent on the velocity of the CCL sensor as the autonomous tool traverses the collars. Typically, the pattern window size (W') is about 10 samples. By way of example, if the tool is traveling at 10 feet/second, and if the sensor is sampling at 10 samples per second, and if a collar is 1 foot in length, then the pattern window (W) may have a size (W') of about 5. More typically, the sensor may be sampling at 20 to 40 samples per second, and the pattern window size (W') would then be about 10 samples.

Another of the operational parameters from the algorithm 1000 is the rate of sampling. The step of defining the rate of sampling is indicated at Box 1120. In one aspect, the rate of sampling is no more than 1,000 samples per second or, more preferably, no more than 500 samples per second.

Ideally, the rate of sampling is correlated to the velocity of the autonomous tool in the wellbore. Preferably, the rate is sufficient to capture between about 3 and 40 samples within a peak. Stated another way, the sampling rate captures about 3 to 40 signals as the tool traverse a collar. By way of example, if the tool is traveling at 10 feet/second, and if a collar is 1 foot in length, then the rate of sampling would preferably be about 30 to 400 samples per second.

Another of the operational parameters from the algorithm 1000 is a memory parameter μ. The step of defining the memory parameter μ is provided at Box 1130. The memory parameter μ determines how many magnetic signals are averaged as part of a moving average technique in the algorithm. Typically, the memory parameter μ will be about 0.1. This is also a single, unitless number.

The value of the memory parameter μ is also dependent on the average velocity of the autonomous tool. The value of the memory parameter μ is further dependent on the amount of time that forms the memory of the algorithm 1000. If the pattern window size (W') is 10, and if the memory parameter μ is 0.1, the number of samples stored in memory for operating the algorithm may be calculated as:

$$\begin{aligned} \text{No.} &= W' * \frac{1}{\mu} \\ &= 10 * \frac{1}{0.1} \\ &= 100 \end{aligned}$$

In this illustrative equation, the algorithm 1000 would store the last 100 samples in applying the moving windowed statistical analysis, for example, in determining the Residue(t), discussed below.

As an alternative, the algorithm 1000 may only store the last 10 magnetic signal samples, but then use the memory parameter μ to weight the most recent pattern window samples. This is then added to a moving mean m(t+1) and a moving covariance matrix Σ(t+1), described below.

Another operational feature for the algorithm 1000 relates to pre-setting a peak-detection threshold. Pre-setting a peak-detection threshold is shown in Box 1140. The operator may set an initial threshold for when the autonomous tool is first deployed. During the time immediately after the initial launch of the autonomous tool, the algorithm 1000 may initiate a calibration phase. During the calibration phase, the processor starts to collect magnetic signal data. The processor then adjusts the pre-set peak detection threshold. This will allow more robust peak detection.

Yet another operational feature relates to the selection of tool positions for control decisions. This is presented at Box 1150. For example, if the downhole tool is a perforating gun, then the step of Box 1150 will include selecting a location at which the perforating gun is to fire charges. If the downhole tool is (or otherwise includes) a fracturing plug, then the step of Box 1150 will include selecting a location at which the plug is to be set in the wellbore.

Returning to FIG. 10, the algorithm steps 1000 also include computing a moving windowed mean m(t+1). This is provided at Box 1020. The moving mean m(t+1) represents a moving average for the magnetic signal values of a pattern window (W). It is to be observed that a mean is preferably not taken and need not be taken for each individual pattern window (W); instead, the individual pattern window values (for example, $\{x_2, x_3, x_4, \ldots x_{W+1}\}$) are placed in vector form. A moving average m(t+1) is then continuously computed over time.

The moving mean m(t+1) is preferably in vector form. Further, the moving mean m(t+1) is preferably an exponentially weighted moving average. The moving mean m(t+1) may be computed according to the following equation:

$$m(t+1)=\mu y(t+1)+(1-\mu)m(t)$$

where y(t+1) is a sequence of magnetic signal values in a most recent pattern window (W+1), and m(t) is the mean of magnetic signal values for a preceding pattern window (W).

By way of further explanation, y(t) represents a collection of magnetic signal values within a pattern window, $\{x_1, x_2, x_3, \ldots x_W\}$. This is in vector form. By implication, y(t+1) represents a collection of magnetic signal values within the next pattern window, $\{x_2, x_3, x_4, \ldots x_{W+1}\}$. m(t) is thus a vector that gets continually updated, with the vector preferably being an exponentially weighted moving average of the pattern window.

The algorithm steps 1000 of FIG. 10 also include computing a moving windowed second moment A(t+1). This is indicated at Box 1030. The moving second moment A(t+1) is also in vector form. Preferably, the moving second moment is an exponentially weighted average that is calculated according to the following equation:

$$A(t+1)=\mu y(t+1)\times[y(t+1)^T+(1-\mu)A(t)].$$

In general terms, a second moment is the product of the data. The general form is:

$$A(t)=m(t)*m(t)^T$$

where $m(t)^T$ is m(t) transposed.

The algorithm steps 1000 of FIG. 10 also include computing a moving windowed covariance matrix Σ(t+1). This is seen at Box 1040. The covariance matrix Σ(t+1) may be calculated according to the following equation:

$$\Sigma(t+1)=A(t+1)-m(t+1)\times[m(t+1)]^T.$$

The covariance matrix Σ(t+1) is continuously updated, meaning that it is a moving vector.

It is noted that in computing the moving mean m(t+1) and the moving covariance matrix Σ(t+1), certain initial values should be set. Thus, for example, the operator should define:

$$m(W)=y(W),$$

where m(W) is the mean m(t) for a first pattern window (W), and y(W) is a transpose for m(W);

The operator may also define:

$$y(W)=[x_1,x_2,x_3,\ldots x(W)]^T \text{ when the downhole tool is deployed,}$$

where $x_1, x_2, x_3, \ldots x_W$ represent magnetic signal values within a pattern window (W).

The operator may also define Σ(W) as a matrix of zeroes.

The algorithm steps 1000 of FIG. 10 also include computing a Residue value R(t). This is provided at Box 1050. The Residue R(t) offers a way of comparing two vectors that belong to a statistical distribution. The Residue R(t) represents the Mahalonobis distance between the most recent pattern window (W) and the present moving mean m(t+1), and may be computed according to the following equation:

$$R(t)=[y(t)-m(t-1)]^T\times[\Sigma(t-1)^{-1}\times[y(t)-m(t-1)]$$

where

R(t) is a single, unitless number y(t) is a vector representing a collection of magnetic signal values for a present pattern window (W), and m(t−1) is a vector representing the mean for a collection of magnetic signal values for a preceding pattern window (W).

It is noted that the algorithm 1000 does not compute the Residue value R(t) unless the number of samples (t) that has been taken is greater than the size (W') of the pattern window (W) multiplied by 2. This may be expressed as:

$$t>2*W.$$

The reason is because the covariance matrix Σ is inverted (shown above as $\Sigma(t-1)^{-1}$) when computing the Residue R(t), and the inverse would generally not be computable until the covariance matrix accumulates a sufficient number of statistical samples.

The algorithm 1000 of FIG. 10 also includes establishing another set of operational parameters. This is shown at Box 1060. In this case, the operational parameters relate to computing a moving Threshold T(t+1).

Figure 12:
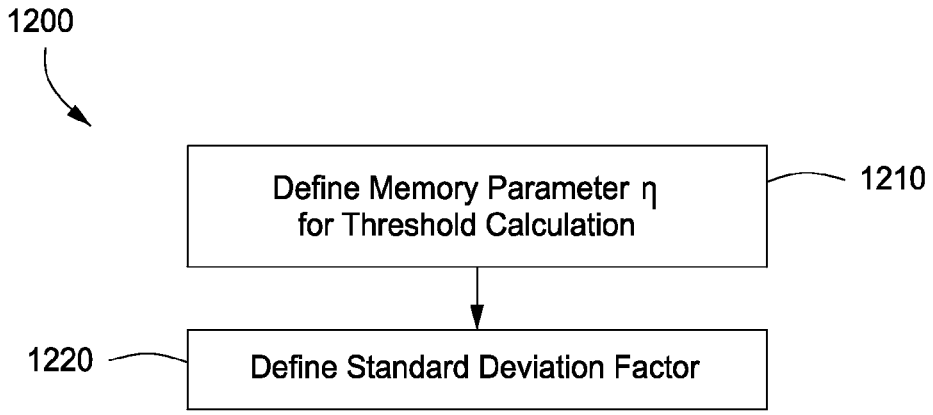
FIG. 12 is a flowchart showing steps for determinations that are made for additional operational parameters, in one embodiment. These relate to the determination of a Threshold.

FIG. 12 provides a flowchart for determinations 1200 that are made for these operational parameters. One of the operational parameters is defining a memory parameter ii. This is shown at Box 1210. The memory parameter η is not a vector, but represents a single number. As shown in the formula below, the value assigned to η affects the number of samples used to calculate an initial Threshold T(t) or to update a moving Threshold (t+1).

The memory parameter η should be greater than the time it takes for the autonomous tool to cross a collar. However, η should be smaller than the spacing between the closest collars. In one aspect, η is about 0.5 to 5.

Another operational parameter for the determinations 1200 is defining a standard deviation factor (STD_Factor). This is provided at Box 1220. The STD_Factor is a value that indicates the likelihood of an abnormality in the data. The algorithm 1000 actually functions to detect abnormalities.

Prior to computing threshold values in the algorithm 1000, initial values may be established. Initial values may be determined by:

defining MR(2*W'+1)=R(2*W'+1)

where

R represents the Residue,

MR represents the Moving Residue, and (2*W'+1) indicates a calculation when t>2*W', defining $SR(2*W'+1)=[R(2*W'+1)]^2$ where SR represents the second moment of Residue, defining STDR(2*W'+1)=0, where STDR represents the standard deviation of the Residue, and defining T(2*W'+1)=0 when the downhole tool is deployed.

where

T(2*W'+1) represents the initial threshold value.

Returning again to FIG. 10, the algorithm 1000 also includes computing a moving Threshold T(t+1). This is shown at Box 1070. As with computing the Residue R(t) of Box 1050, the moving Threshold T(t+1) preferably is not enforced unless the number of samples (t) that has been taken is greater than the size (W') of the pattern window (W) multiplied by 2.

Figure 13:
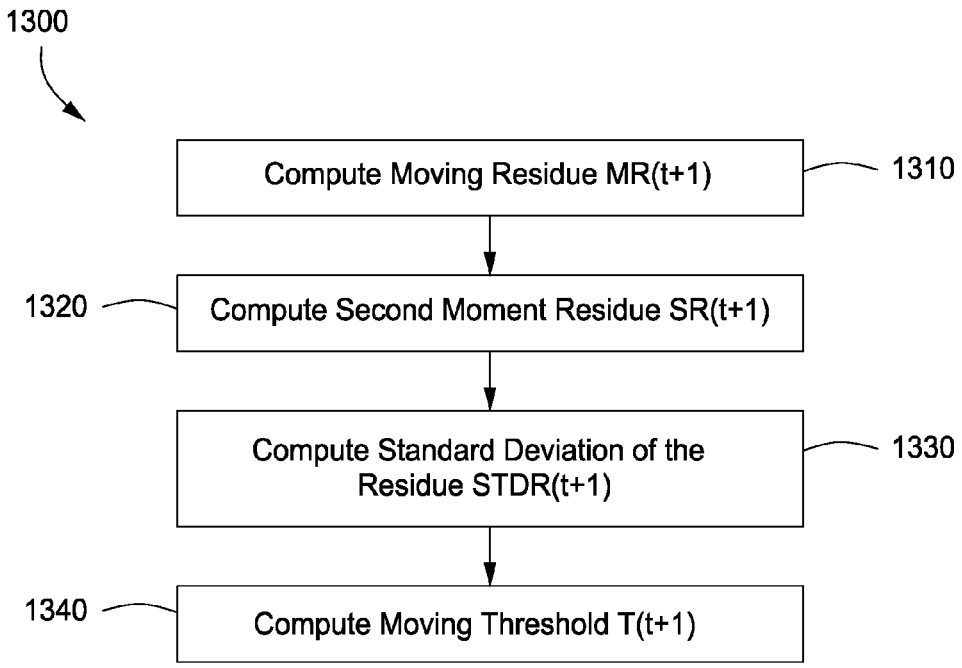
FIG. 13 presents a flowchart showing steps for computing a moving threshold, in one embodiment. This is in accordance with the steps of FIG. 10.

The computing step of Box 1070 itself includes a series of calculations. FIG. 13 presents a flowchart showing steps 1300 for computing a moving threshold T(t+1).

First, the steps 1300 include computing a moving Residue MR(t+1). This is seen at Box 1410. The moving Residue MR(t+1) is the Residue value over time as the pattern windows (W) advance. The moving Residue may be calculated according to the following equation:

$$MR(t+1)=\mu R(t+1)+(1-\mu)MR(t)$$

where

μ is the memory parameter for the windowed statistical analysis,

MR(t) is the Moving Residue at a preceding pattern window, and

MR(t+1) is the Moving Residue at a present pattern window.

The steps 1300 also include computing a second moment Residue SR(t+1). This is shown at Box 1320. The second moment Residue SR(t+1) is also a moving value, and represents the second moment of Residue over time as the pattern windows (W) advance. The second moment Residue may be calculated according to the following equation:

$$SR(t+1)=\mu[R(t+1)]^2+(1-\mu)SR(t)$$

where

SR(t) is the second moment of Residue at the preceding pattern window, and

SR(t+1) is the second moment of Residue at the present pattern window.

The steps 1300 for computing a moving threshold T(t+1) also include computing a standard deviation of the Residue value STDR(t+1). This is indicated at Box 1330. The standard deviation of the Residue STDR(t+1) is also a moving value, and represents a standard deviation of Residue over time as the pattern windows (W) advance. The standard deviation of the Residue value may be calculated according to the following equation:

$$STDR(t+1)=\sqrt{SR(t+1)-[MR(t+1)]^2}$$

where

STDR(t+1) is the Standard Deviation of the Residue at the present pattern window, The steps 1300 further include computing a moving Threshold T(t+1). This is seen at Box 1340. The Threshold T(t+1) is also a moving value, and represents a baseline for determining the potential start of a collar location as the pattern windows (W) advance. The Threshold may be calculated according to the following equation:

$$T(t+1)=MR(t+1)+STD_Factor\times STDR(t+1).$$

Returning to the algorithm steps 1000 of FIG. 10, the steps 1000 also provide for determining if the moving Residue value R(t+1) has crossed the moving Threshold value T(t+1). This is offered in Box 1080. The following query is made:

$$R(t-1)<T(t), \text{ and}$$

$$R(t)\geq T(t).$$

where

R(t) is the Residue value for a present pattern window (W),

R(t−1) is the Residue for a preceding pattern window (W), and

T(t) is the Threshold value for the present pattern window.

If the query is satisfied, then the algorithm 1000 marks a time (t) as a start of a potential collar location.

Note again that the determination of Box 1080 is only made if t>2×W'. In addition, a collar location is only marked if:

$$t > \frac{W}{\mu}$$

where

W is a pattern window number, and

μ is the memory parameter for the windowed statistical analysis.

This means that the time must be greater than the window size divided by the memory parameter μ.

Figure 14A:
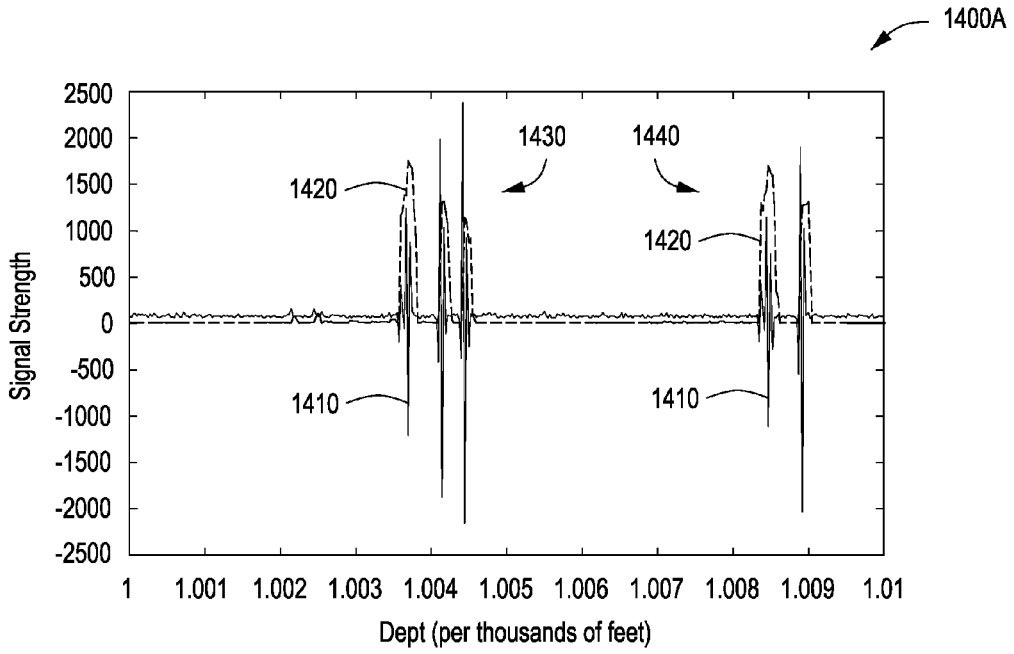
FIGS. 14A and 14B provide screen shots related to the windowed statistical analysis of the present inventions, in one embodiment.
Figure 14B:
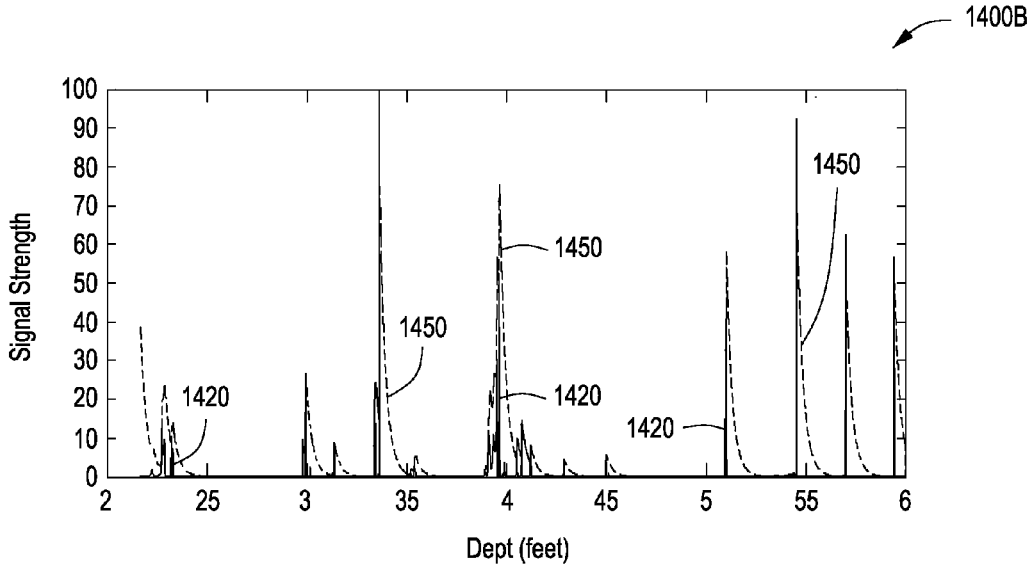

FIGS. 14A and 14B provide screen shots 1400A, 1400B for an illustrative portion of the second transformed CCL log. A first line, indicated at 1410, represents real time magnetic signals obtained from the deployment of the autonomous tool as part of Box 840 and the recording of signals as part of Box 910. A second line, indicated at 1420, represents the moving Residue R(t+1). The moving Residue R(t+1) is obtained as part of Box 920 and the computation of the moving Residue R(t+1) as part of Box 1310. The moving residue values form a log that becomes the 'transformed' signal stored in the processor.

In each of FIGS. 14A and 14B, the x-axis represents depth (or location) in units of feet. The y-axis represents magnetic signal value or strength. In FIG. 14A, magnetic signal values for the second CCL log 1410 indicate two distinct regions of peaks. The first region, shown at 1430, shows peaks (relatively high magnetic signals) that may be representative of collars. Alternatively, peaks in region 1430 may be representative of a so-called short joint. Such a short joint typically has two rings. The second region of peaks, shown at 1440, is representative of a collar.

Moving to FIG. 14B, FIG. 14B provides another screen shot 1400B. Moving Residue values R(t+1) 1420 for the transformed CCL log 1410 are again shown. In addition, moving Threshold values T(t+1) are shown at 1450, in dashed lines. The early peaks between 2 and 4.5 feet are discarded as part of the method 1000 (Box 1080). This is discussed further below in connection with FIG. 16. Peaks between 5 feet and 6 feet are indicative of a collar.

It is noted that the Threshold line 1450 is moving and adjusting. The threshold is typically chosen as a mean value plus one or two standard deviations. In FIG. 14B, the Threshold value T(t+1) meets the Residue value R(t+1) at every collar starting around 5.

Now returning to FIG. 9, the steps 900 for the processor algorithm next include incrementally comparing the transformed second CCL log with the first CCL log. This is seen at Box 930. The comparison takes place during deployment of the autonomous downhole tool in the wellbore. The comparison of Box 930 correlates values between the two logs indicative of casing collar locations.

The comparison with respect to the first CCL log may involve a comparison of the magnetic signals recorded from the initial wireline run from the step of Box 810. These signals, of course, will have been converted to digital form. As part of the step of acquiring a CCL data set from Box 810, the magnetic signals for the first CCL log may further be transformed. For example, the signals may undergo smoothing to form the first CCL log. Alternatively, the signals may undergo a windowed statistical analysis, such as the one described in FIGS. 10, 11 and 12 for the magnetic signals of the second CCL log. Transforming both the first CCL log (the depth series) and the second CCL log (the time series) allows the magnetic signals or pulses to look similar, for example, simple peaks.

The step of incrementally comparing the transformed second CCL log with the first CCL log of Box 930 is performed using a collar pattern matching algorithm. Preferably, the algorithm compares peaks between the first and second logs, one peak at a time.

Figure 15:
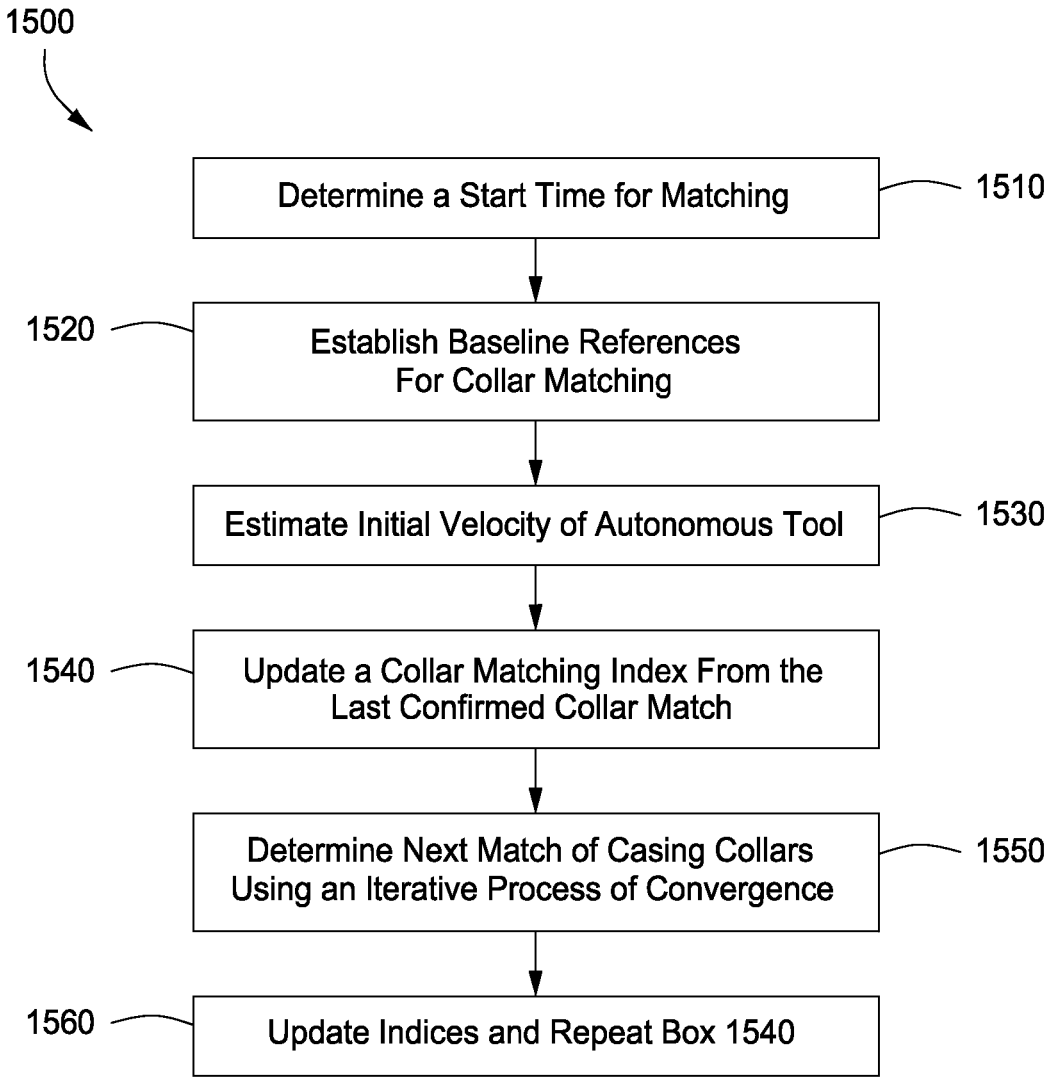
FIG. 15 provides a flowchart for a method of iteratively comparing the transformed second CCL log with the first CCL log, in one embodiment. This is for the collar pattern matching algorithm of from FIG. 9.

FIG. 15 provides a flowchart for a method 1500 of iteratively comparing the transformed second CCL log with the first CCL log, in one embodiment. The method 1500 first includes determining a start time for matching. This is shown at Box 1510. The purpose for determining a start time is so that the processor does not attempt to identify collars from peaks that are inevitably read as the autonomous tool is first being deployed in the wellbore.

Figure 16:
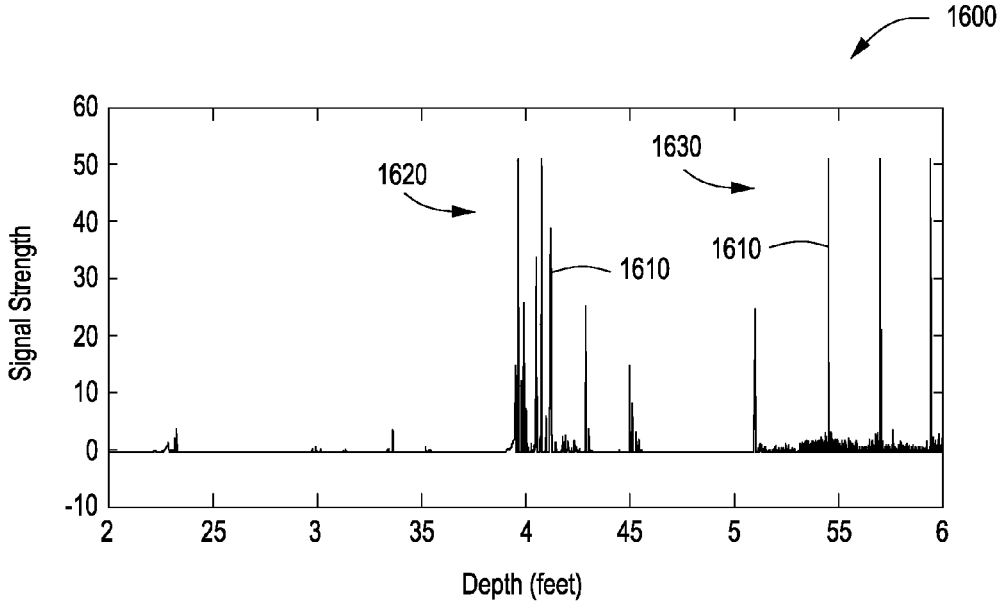
FIG. 16 provides a screen shot for initial magnetic signals from a CCL log. The x-axis for FIG. 16 represents depth (measured in feet), while the y-axis represents signal strength.

FIG. 16 provides a screen shot 1600 for initial magnetic signals 1610. The x-axis for FIG. 16 represents depth (measured in feet), while the y-axis represents signal strength. It can be seen that a first set of peaks (high signal strength values) is seen in an area marked at 1620. The signals in area 1620 are found in the wellbore between 4 and 4.5 feet. These signals are not compared in the collar pattern matching algorithm of method 1500. This is based on the inquiry from Box 1080:

$$t > \frac{W}{\mu}.$$

Returning to FIG. 15, a second set of peaks is shown at an area 1630. The signals in area 1630 are found in the wellbore between 5 and 6 feet. These signals from area 1630 represent a first collar that is implemented in the comparison algorithm for method 1500.

The method 1500 also includes establishing baseline references for the collar matching algorithm. This is shown in Box 1520. The baseline references refer to depths and times. The depths $\{d_1, d_2, d_3, \ldots\}$ are obtained from the first CCL log. These indicate respective depths of the casing collars in the wellbore as determined from the first CCL log. The times $\{t_1, t_2, t_3, \ldots\}$ refer to times for the location of magnetic signal responses in the transformed second CCL log. These indicate potential casing collar locations as determined by the processor in the autonomous tool. At these instances, the transformed magnetic signal responses exceed the moving Threshold T(t+1).

The method 1500 also includes estimating an initial velocity of the autonomous tool. This is provided at Box 1530. In order to estimate velocity v, depth $d_1$ is assumed to match time $t_1$. Likewise, depth $d_2$ is assumed to match time $t_2$. Then, the initial velocity is calculated as:

$$v_1 = \frac{d_2 - d_1}{t_2 - t_1}$$

The method 1500 also includes updating a collar matching index. This is indicated at Box 1540. The index refers to the sequence of collar matches. In the step of Box 1540, the last confirmed match is indexed to be $d_k$ for the depth, and $t_l$ for the time. The last confirmed velocity estimate will be u.

The method 1500 next includes determining the next match of casing collars. This is seen at Box 1550. The matching is done using an iterative process of convergence. In one aspect, the iterative steps of convergence are:

(1) If $$v = \left(\frac{d_{k+1} - d_k}{v_{l+1} - v_l}\right)$$

satisfies $(1-e)u<v<(1+e)u$, match $d_{k+1}$ with $t_{l+1}$.

In this query, e represents a margin of error. Preferably, the margin "e" is not greater than about 10%.

(2) Else, if $(d_{k+1}-d_k)<v(t_{l+1}-tl)$, delete $d_{k+1}$ from the CCL log sequence and reduce all later indices by 1. This means that the algorithm treats the next depth number in sequence as $d_{k+1}$, and returns to step (1).

(3) Else, if $(d_{k+1}-d_k)>v(t_{l+1}-t_l)$, delete $d_{1+1}$ from the CCL log sequence and reduce all later indices by 1. This means that the algorithm treats the next time number in sequence as $t_{l+1}$, and again returns to step (1).

The method 1500 then includes updating the indices, and repeating the iterative process of Box 1550. This is provided in box 1560. In this way, the collars between the two CCL logs are matched one at a time.

It is noted here that an autonomous tool could be deployed in a wellbore and a continuous comparison made between the first and the second CCL log without using an iterative process. In this respect, the algorithm could simply match locations sequentially where signal peaks are found, indicating the presence of a collar. In such an arrangement, the operator may choose thresholds for the first (stored depth series) and second (on-line time series) CCL residues. This would typically be chosen as a moving mean value plus one or two standard deviations, to detect the start of collar positions in both data sets. Then, starting from the top of the wellbore or other pre-determined location, the algorithm may continuously match the event start values to obtain a position value for the autonomous tool from the CCL log at these times, as shown in the adjoining figure. However, such a direct comparison of values would not take into account spurious peaks or missing peaks that might arise in either the first or the second CCL log, and it assumes a constant tool velocity within the wellbore.

The method 1500 represents an enhancement to this approach. The method 1500 automatically estimates velocity from the recent collar matches, and uses current matches to produce velocity estimates close to the earlier ones. This novel enhancement provides robustness and error-correcting ability to compensate for occasional and random missing or spurious peaks, while allowing small velocity changes to accumulate over time.

Figure 17A:
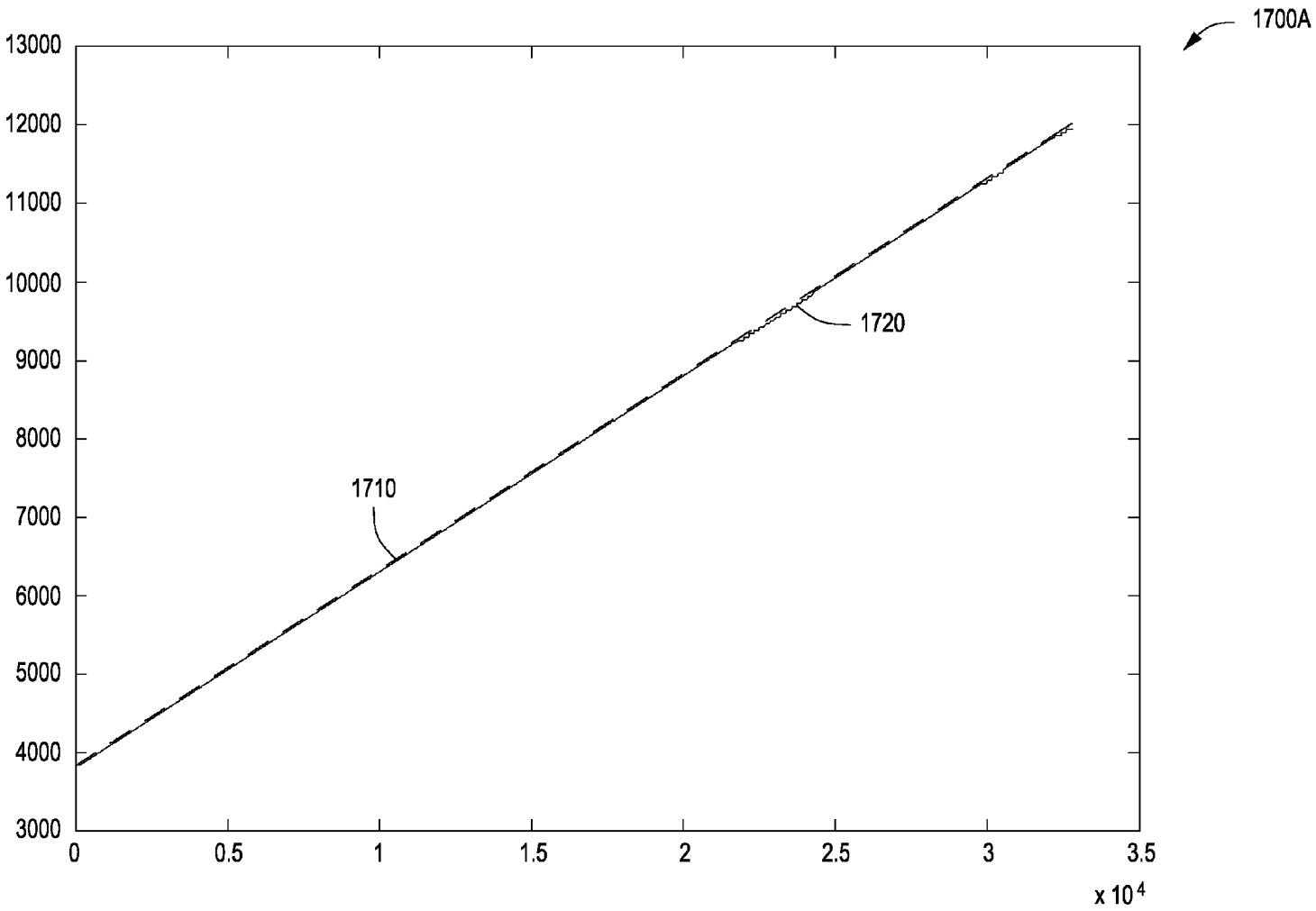
FIGS. 17A, 17B, and 17C provide screen shots demonstrating the use of the collar pattern matching algorithm for the method of FIG. 15.
Figure 17B:
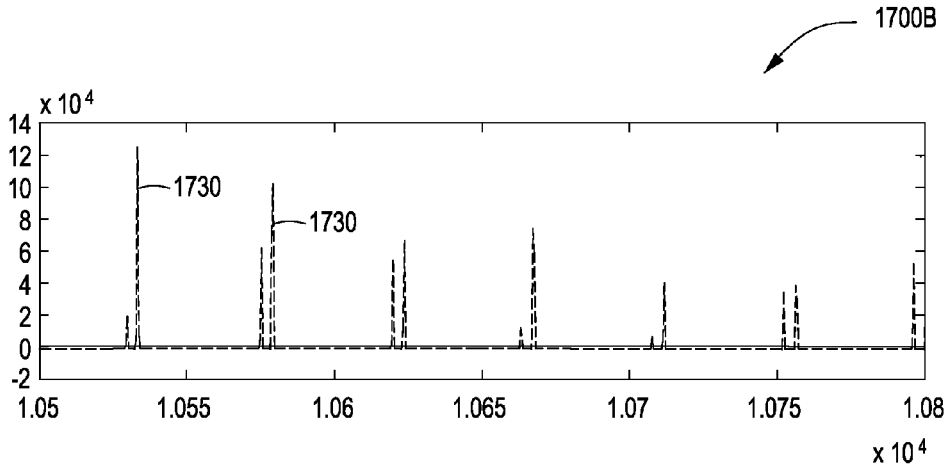
Figure 17C:
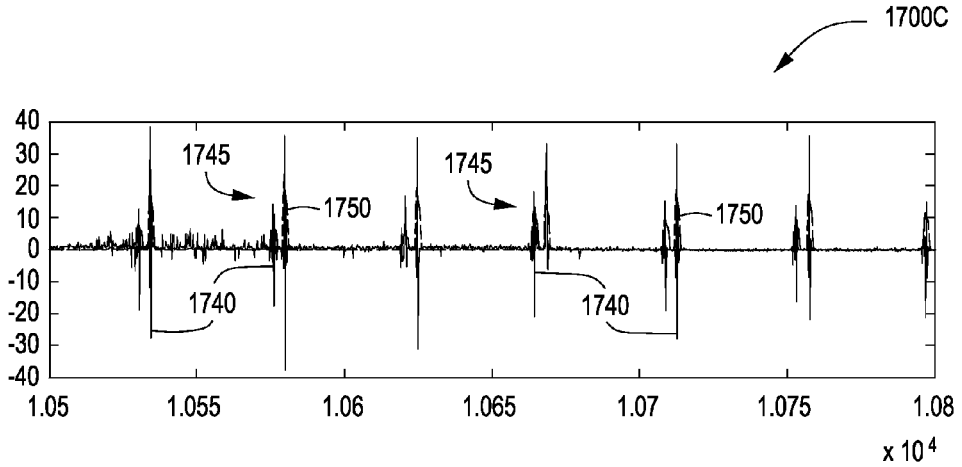

FIGS. 17A, 17B, and 17C provide screen shots 1700A, 1700B, 1700C demonstrating the use of the collar pattern matching algorithm for the method 1500 of FIG. 15. First, FIG. 17A provides a screen shot 1700A that compares depth readings for the autonomous tool with depth readings for the first CCL log. The screen shot 1700A is a Cartesian graph that plots collar location against depth.

The depth readings for the first CCL log are indicated at line 1710, while the depth readings for the autonomous tool are indicated at line 1720. The line 1720 from the autonomous tool is based upon the collar matching process of FIG. 15. It can be seen in screenshot 1700A that the line 1720 matches very well with the actual depth measured from the first CCL log. In this respect, line 1710 for the first CCL log and line 1720 for the transformed second CCL log substantially overlap.

FIG. 17B provides a second screen shot 1700B. Screen shot 1700B shows a three-foot section of a wellbore along the x-axis. The x-axis runs from a depth of roughly 1,005 feet to 1,008 feet. In FIG. 17B, magnetic signals 1730 from just the first or base CCL log are shown. The y-axis is indicative of signal strength for the magnetic signals 1730. Peaks 1730 are cleanly shown as each sample is taken. A collar is most likely present between 1,005 and 1,006 feet.

FIG. 17C provides yet a third screen shot 1700C. FIG. 17C is taken along the same three-foot section of wellbore. The x-axis is again in units of feet, while the y-axis is indicative of signal strength.

In FIG. 17C, lines 1740 and 1750 are provided. Line 1740 represents raw magnetic signal readings from the second CCL log. This is from the autonomous tool. Peaks 1745 from line 1740 are indicative of collar locations. Line 1750 is the transformed second CCL log, or Residue(t). The Residue R(t) 1750 correlates cleanly with the peaks 1745 of the raw second CCL log.

To further reduce uncertainty in the detected second CCL peaks 1745, another embodiment of this invention involves the use of two or more CCL sensors located in the autonomous tool. The purpose is to provide redundant magnetic signal measurements. The algorithm for the processor then includes a comparison step between sequential signals within the autonomous tool. In one aspect, two signals, or two simultaneously obtained windows of signals, are averaged before calculation of the mean Residue m(t+1). This helps to smooth the magnetic responses. In another embodiment, the magnetic signals are separately transformed in parallel under the step of Box 920, and then separately compared with the first CCL log under the step of Box 930. The transformed signals that best match the collar pattern from the first CCL log are selected. In either instance, such redundancy helps detect false peaks due to drastic changes in tool velocity.

It is also observed that where two casing collar locators, or sensors, are employed, the sensors may be separated a known distance along the tool. As the autonomous tool travels across the collars, the dual sensors provide a built-in measurement system for tool velocity. This is derived from the known length between the two CCL sensors and the timing between CCL peaks. This velocity measurement may be compared to or even substituted for the velocity estimates from the step of Boxes 1540 and 1550. FIG. 3 actually demonstrates a tool assembly 300 having two separate position locators 314', 314".

As an alternative, the process of estimating the velocity of the autonomous tool from the steps of Boxes 1520, 1540, and 1550 may involve using an accelerometer. In this instance, the position locator 214 includes an accelerometer. An accelerometer is a device that measures acceleration experienced during a freefall. An accelerometer may include multi-axis capability to detect magnitude and direction of the acceleration as a vector quantity. When in communication with analytical software, the accelerometer allows the position of an object to be determined. Preferably, the position locator would also include a gyroscope. The gyroscope would maintain the orientation of, for example, the fracturing plug assembly 200'. Accelerometer readings are compared with calculated velocity estimates. Such readings may then be averaged for increased accuracy.

Yet even more elaborate iterative processes may be employed. For example, the method 1500 may be upgraded by comparing two or even three peaks at a time for pattern matching. For example, the last three detected peaks from the first and second CCL logs may be compared to determine the velocity and matching peaks simultaneously. Such an embodiment can beneficially take advantage of special features along the wellbore such as short joints or spacing variations between collars to perform a more robust pattern matching to determine velocity and depth. However, processing speed is important in obtaining accurate results, and more complex algorithms slow the processing speed.

In order to compare more than one peak at a time for the pattern matching algorithm, a dynamic programming technique may be employed. The dynamic programming technique seeks to find a minimum, and utilizes the following equation:

$$\underset{a,v}{\mathrm{Min}} \sum_{i=1}^{M} (a + vt_i - d_{j(i)})^2 \sum_{j=1}^{N} (a + vt_{i(j)} - d_j)^2$$

where:

$a$ is a shift, meaning how much a point is moved;

$v$ represents velocity, and is a scaling factor;

$d$ represents depth;

$j^*(i) = \underset{j}{\mathrm{ArgMin}} |a + vt_i - d_j|;$ $i^*(j) = \underset{i}{\mathrm{ArgMin}} |a + vt_i - d_j|;$ and ArgMin means the value of a variable that provides the minimum.

Figure 18:
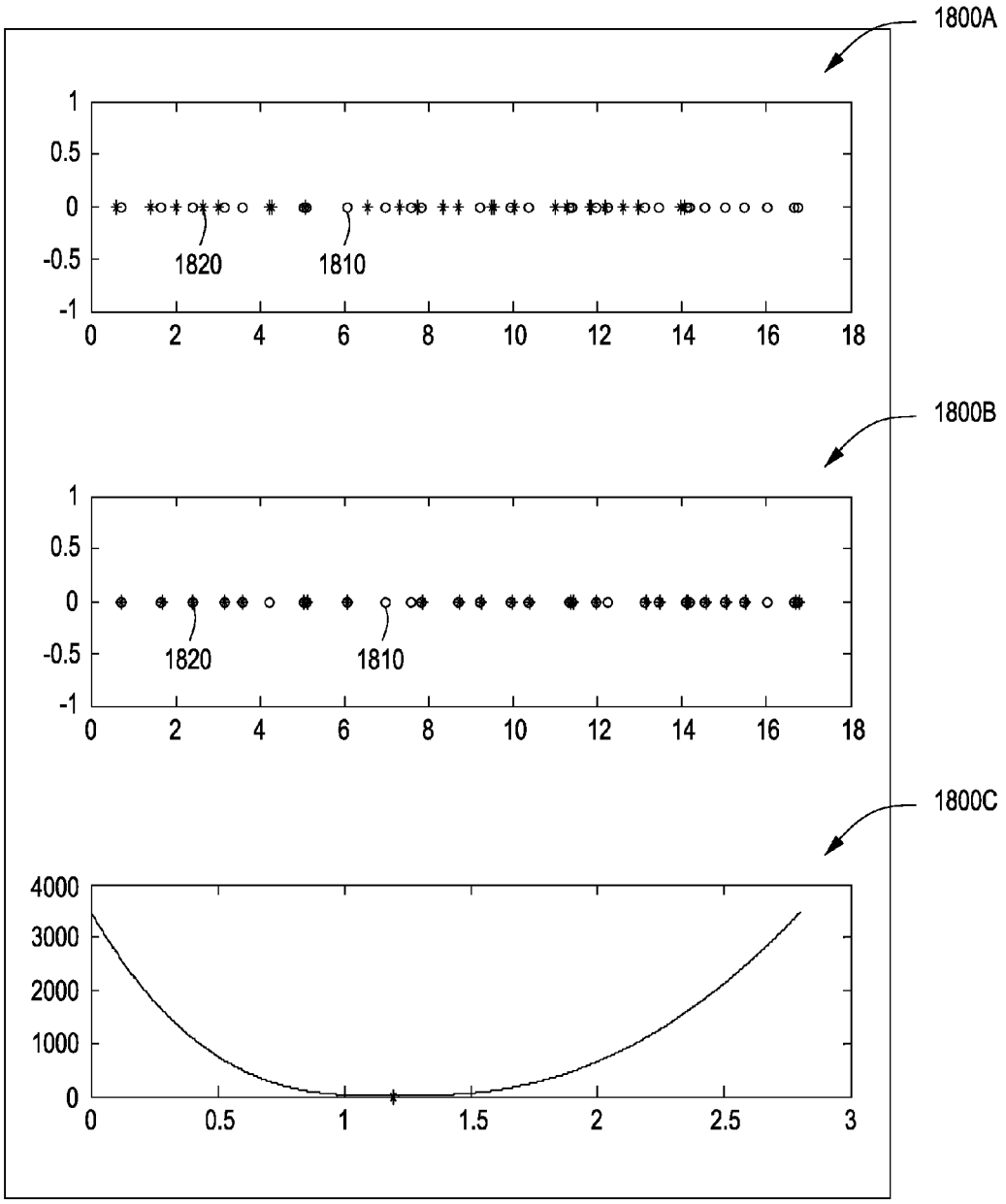
FIG. 18 presents charts demonstrating the use of a collar pattern matching algorithm for the method of FIG. 15, in an alternate embodiment.

FIG. 18 is a graphic broken into three boxes. The three boxes are indicated as Box 1800A, Box 1800B, and Box 1800C.

The first two boxes—Boxes 1800A and 1800B—each show two sets of data. These represent circles 1810 and asterisk 1820. The circles 1810 represent casing collars identified from the first CCL log. The asterisks 1820 represent casing collars identified from the second CCL data set. This is the real time data acquired by the autonomous tool. Both the circles 1810 and the asterisk 1820 may be derived from the method 1000 for applying a moving windowed statistical analysis in FIG. 10.

The axes in each of Boxes 1800A and 1800B are each calibrated. The x-axis shows collar sequences 0 through 18. All circles 1810 and asterisks 1820 are calibrated to 0.

It can be seen in the first box—Box 1800A—that the circles 1810 and the asterisks 1820 do not precisely align. Those of ordinary skill in the art of well logging will appreciate that casing collar logs can be imprecise. In this respect, joints of casing can generate false peaks. In addition, some casing collars may be missed. This creates a need to mathematically align the data from the first and second CCL logs.

To provide casing collar matching, variables a and v are provided. a is a shift, meaning how much a point is moved, while v represents velocity, and is a scaling factor. The algorithm seeks the best possible (a, v) to match points.

In Box 1800A, only the scaling factor v is applied. In Box 1800B, both the shift and the scaling factor are applied. It can be seen that the circles 1810 and the asterisks 1820 have become more closely aligned in box 1800B.

The third box—Box 1800C—applies the pattern matching algorithm shown above to a set of points. The algorithm seeks to minimize a least squares object function for a given (a, v). The object function calculates a squared distance to a nearest point. It can be seen in Box 1800C that a corrected velocity is provided. Convexity of the object function is noted, along with a near-exact match of the true scaling factor with the velocity estimate.

The collar pattern matching algorithm 1500 may be used along the entire length of a wellbore. Alternatively, the algorithm 1500 may be used along only a most current portion of the wellbore, for example, the last 1,000 feet traveled. To facilitate the use the pattern recognition algorithm 1500, the casing joints could be intentionally selected to have different lengths, for example, by running full joints as well as ¼, ½ and ¾ length joints. Using a designed combination of short-long joints will enable the processor to more accurately determine its position even if there are missed and/or spurious peaks in the second CCL log.

Returning again to FIG. 9, the steps 900 for actuating the downhole tool next include sending an actuation signal to the actuatable wellbore device. This is seen at Box 950. The actuation signal is sent when the processor has sensed the selected wellbore location, or depth. Sensing is based upon recognizing the last collar, or a last set of collars. Sending the actuation signal causes the autonomous tool to perform its core function. Thus, where the autonomous tool is a perforating gun assembly, the signal will cause the perforating gun to detonate its charges, thereby perforating the surrounding casing.

As can be seen novel techniques are provided herein for controlling the timing of actions by an autonomous tool traveling downhole. Control is based on a combination of depth/frequency and time/frequency signal processing and pattern recognition methods to match collar locations. The analysis is performed on the signal received from a magnetic casing collar locator, or CCL sensor, mounted on the autonomous tool. The CCL sensor continuously records magnetic signals that register characteristic spikes when the thicker metallic segment of a casing collar is crossed. The wireless autonomous tool is pre-programmed with a depth-based signal derived from a previously recorded CCL log. The methods disclosed herein will automatically match the latter to the streaming CCL-based time series from the CCL log measured by the autonomous tool.

While it will be apparent that the inventions herein described are well calculated to achieve the benefits and advantages set forth above, it will be appreciated that the inventions are susceptible to modification, variation and change without departing from the spirit thereof.

What is claimed is:

1. A method of actuating a downhole tool in a wellbore, the wellbore having casing collars that form a physical signature for the wellbore, comprising:

acquiring a CCL data set from the wellbore, the CCL data set correlating recorded magnetic signals with measured depth, thereby forming a first CCL log for the wellbore;

selecting a location within the wellbore for actuation of a wellbore device;

downloading the first CCL log into a processor on-board the downhole tool;

deploying the downhole tool into the wellbore such that the downhole tool traverses casing collars, the downhole tool comprising the processor, a casing collar locator, and an actuatable wellbore device;

wherein the processor is programmed to:

continuously record magnetic signals as the downhole tool traverses the casing collars, forming a second CCL log;

transform the recorded magnetic signals of the second CCL log by applying a moving windowed statistical analysis, wherein applying a moving windowed statistical analysis comprises (i) defining a pattern window size (W') for sets of magnetic signal values, and (ii) computing a moving mean m(t+1) for the magnetic signal values over time;

incrementally compare the transformed second CCL log with the first CCL log during deployment of the downhole tool to correlate values indicative of casing collar locations;

recognize the selected location in the wellbore; and send an actuation signal to the actuatable wellbore device when the processor has recognized the selected location; and sending the actuation signal to actuate the downhole tool.

2. The method of claim 1, wherein:

the method further comprises transforming the CCL data set for the first CCL log by applying a moving windowed statistical analysis;

downloading the first CCL log into a processor comprises downloading the first transformed CCL log into the processor on-board the downhole tool; and the processor incrementally compares the second transformed CCL log with the first transformed CCL log to correlate values indicative of casing collar locations.

3. The method of claim 1, wherein:

the first CCL log represents a depth series;

the second CCL log represents a time series; and incrementally comparing the second transformed CCL log with the first CCL log uses a collar matching pattern algorithm to compare and correlate individual peaks representing casing collar locations.

4. The method of claim 3, wherein the collar matching pattern algorithm comprises:

establishing baseline references for depth from the first CCL log, and for time from the transformed second CCL log;

estimating an initial velocity $v_1$ of the autonomous tool;

updating a collar matching index from a last confirmed collar match, indexed to be $d_k$ for the depth, and $t_l$ for the time;

determining a next match of casing collars using an iterative process of convergence;

updating the collar matching index based on a best computed match; and repeating the iterative process.

5. The method of claim 4, wherein estimating an initial velocity $v_1$ of the autonomous tool comprises:

assuming a first depth $d_1$ matches a first time $t_1$;

assuming a second depth $d_2$ matches a second time $t_2$; and calculating the estimated initial velocity using the following equation:

$$v_1 = \frac{d_2 - d_1}{t_2 - t_1}.$$

6. The method of claim 4, wherein the iterative process of convergence comprises the following steps:

(1) If $$v = \left(\frac{d_{k+1} - d_k}{v_{l+1} - v_l}\right)$$

satisfies $(1-e)u<v<(1+e)u$, match $d_{k+1}$ with $t_{l+1}$;

(2) Else, if $(d_{k+1}-d_k)<v(t_{l+1}-t_l)$, delete $d_{k+1}$ from the index and reduce all later indices by 1 so that the next depth number in sequence is $d_{k+1}$, and return to step (1);

(3) Else, if $(d_{k+1}-d_k)>v(t_{l+1}-t_l)$, delete $d_{l+1}$ from the index and reduce all later indices by 1 so that a next time number in sequence is $t_{l+1}$, and return to step (1);

wherein u represents a last confirmed velocity estimate; and e represents a margin of error.

7. The method of claim 6, wherein the margin of error e is no greater than 10 percent.

8. The method of claim 1, wherein:

the moving mean m(t+1) is in vector form and represents a mean of magnetic signal values for a pattern window (W); and applying a moving windowed statistical analysis further comprises:

defining a memory parameter μ for the windowed statistical analysis; and calculating a moving covariance matrix Σ(t+1) for the magnetic signal values over time.

9. The method of claim 8, wherein:

the moving mean m(t+1) is an exponentially weighted moving average for the magnetic signal values for a pattern window (W); and calculating a moving mean m(t+1) for the magnetic signal values is done according to the following equation:

$$m(t+1)=\mu y(t+1)+(1-\mu)m(t)$$

where y(t+1) is a collection of magnetic signal values in a most recent pattern window (W+1), and m(t) is the mean of magnetic signal values for a preceding pattern window (W).

10. The method according to claim 9, wherein calculating a moving covariance matrix Σ(t+1) for the magnetic signal values comprises:

computing an exponentially weighted moving second moment A(t+1) for the magnetic signal values in a most recent pattern window (W+1); and computing the moving covariance matrix Σ(t+1) based upon the exponentially weighted second moment A(t+1).

11. The method of claim 10, further comprising:

defining m(W)=y(W) when the downhole tool is deployed, where m(W) is the mean m(t) for a first pattern window (W), and y(W) is a transpose for m(W);

and defining $y(W)=[x(1), x(2), \ldots x(W)]^T$ when the downhole tool is deployed, where x(1), x(2), . . . x(W) represent magnetic signal values within a pattern window (W).

12. The method of claim 10, wherein:

computing an exponentially weighted second moment A(t+1) is done according to the following equation:

$$A(t+1)=\mu y(t+1)\times[y(t+1)^T+(1-\mu)A(t)$$

and computing the moving covariance matrix Σ(t+1) is done according to the following equation:

$$\Sigma(t+1)=A(t+1)-m(t+1)\times[m(t+1)]^T$$

13. The method of claim 12, wherein applying a moving windowed statistical analysis further comprises:

computing an initial Residue R(t) for when the downhole tool is deployed;

computing a moving Residue R(t+1) over time; and computing a moving Threshold T(t+1) based on the moving Residue R(t+1).

14. The method of claim 13, wherein:

the initial Residue R(t) is only computed if t>2×W' where t represents the number of magnetic signals that have been cumulatively obtained, and W' represents the number of samples, or size, of each pattern window (W);

and computing the initial Residue R(t) is done according to the following equation:

$$R(t)=[y(t)-m(t-1)]T\times[E(t-1)^{-1}\times[y(t)-m(t-1)]$$

where

R(t) is a single, unitless number y(t) is a vector representing a collection of magnetic signal values for a present pattern window (W), and m(t−1) is a vector representing the mean for a collection of magnetic signal values for a preceding pattern window (W).

15. The method of claim 14, wherein computing a moving Threshold T(t+1) comprises:

defining a memory parameter η for the threshold calculations; and defining a standard deviation factor (STD_Factor).

16. The method of claim 15, wherein:

the moving Threshold T(t+1) is only computed if t>2×W'; and applying a moving windowed statistical analysis further comprises marking a time (t) as a potential start of a collar location if:

$$t > \frac{W}{\mu},$$

R(t−1)<T(t), and

R(t)≥T(t), where

R(t) is a single, unitless number for a present pattern window,

R(t−1) is the Residue for a preceding pattern window (W),

W is a pattern window number, and

μ is the memory parameter for the windowed statistical analysis.

17. The method of claim 16, further comprising:

defining MR(2*W'+1)=R(2*W'+1) when the downhole tool is deployed, where

R represents the Residue,

MR represents the Moving Residue, and (2*W'+1) indicates a calculation when t>2*W', defining SR(2*W'+1)=[R(2*W'+1)]$^2$ when the downhole tool is deployed, where SR represents the second moment of Residue, defining STDR(2*W'+1)=0 when the downhole tool is deployed, where STDR represents the standard deviation of the Residue, and defining T(2*W'+1)=0 when the downhole tool is deployed.

18. The method of claim 17, wherein:

computing the Moving Residue (MR) is done is done according to the following equation:

$$\mathrm{MR}(t+1)=vR(t+1)+(1-\mu)\mathrm{MR}(t)$$

where

MR(t) is the Moving Residue at a preceding pattern window, and

MR(t+1) is the Moving Residue at a present pattern window, computing the Second Moment of Residue (SR) is done is done according to the following equation:

$$\mathrm{SR}(t+1)=\mu[R(t+1)]^2+(1-\mu)\mathrm{SR}(t)$$

where

SR(t) is the Second Moment of Residue at the preceding pattern window, and

SR(t+1) is the Second Moment of Residue at the present pattern window, computing the Standard Deviation of the Residue (STDR) is done is done according to the following equation:

$$\mathrm{STDR}(t+1)=\sqrt{\mathrm{SR}(t+1)-[\mathrm{MR}(t+1)]^2}$$

where

STDR(t+1) is the Standard Deviation of the Residue at the present pattern window, and computing the moving Threshold T(t+1) is done is done according to the following equation:

$$T(t+1)=MR(t+1)+STD_\mathrm{Factor}\times STDR(t+1).$$

19. The method of claim 1, wherein incrementally comparing the second transformed CCL log with the first CCL log uses a collar matching pattern algorithm to compare and correlate more than two individual peaks at a time.

20. The method of claim 1, wherein acquiring a CCL data set from the wellbore comprises:

running a casing collar locator into the wellbore on a wireline; and pulling the casing collar locator to record magnetic signals as a function of depth.

21. The method of claim 1, wherein the downhole tool further comprises a fishing neck.

22. The method of claim 1, wherein:

the actuatable wellbore device is a fracturing plug configured to form a substantial fluid seal when actuated within the wellbore at the selected depth;

the fracturing plug comprises an elastomeric sealing element and a set of slips for holding the location of the downhole tool proximate the selected depth; and sending the actuation signal actuates the sealing element and the slips.

23. The method of claim 22, wherein:

the fracturing plug is fabricated from a friable material; and the fracturing plug is configured to self-destruct a designated period of time after the fracturing plug is set in the wellbore.

24. The method of claim 1, wherein:

the actuatable wellbore device is a perforating gun having charges; and sending the actuation signal actuates the perforating gun to detonate the charges.

25. The method of claim 24, wherein:

the perforating gun is substantially fabricated from a friable material; and the perforating gun is configured to self-destruct after the charges are detonated.

26. A tool assembly for performing a tubular operation in a wellbore, the wellbore having casing collars that form a physical signature for the wellbore, and the tool assembly comprising:

an actuatable tool;

a casing collar locator for sensing the location of the actuatable tool within a tubular body based on the physical signature provided along the tubular body; and an on-board controller configured to send an actuation signal to the actuatable tool when the location device has recognized a selected location of the actuatable tool based on the casing collars;

wherein:

the actuatable tool, the casing collar locator, and the on-board controller are together dimensioned and arranged to be deployed in the tubular body as an autonomous unit;

the on-board controller has stored in memory a first CCL log representing magnetic signals pre-recorded from the wellbore; and the on-board controller is programmed to:

continuously record magnetic signals as the tool assembly traverses the casing collars, forming a second CCL log;

transform the recorded magnetic signals of the second CCL log by applying a moving windowed statistical analysis, wherein applying a moving windowed statistical analysis comprises (i) defining a pattern window size (W') for sets of magnetic signal values, and (ii) computing a moving mean m(t+1) for the magnetic signal values over time;

incrementally compare the transformed second CCL log with the first CCL log during deployment of the downhole tool to correlate values indicative of casing collar locations;

recognize a selected location in the wellbore; and send an actuation signal to the actuatable tool when the processor has recognized the selected location in order to perform the tubular operation.

27. The tool assembly of claim 26, wherein:

the actuatable tool is a fracturing plug configured to form a substantial fluid seal when actuated within the tubular body at the selected location; and the fracturing plug comprises an elastomeric sealing element and a set of slips for holding the location of the tool assembly proximate the selected location.

28. The tool assembly of claim 26, wherein:

the tool assembly is a perforating gun assembly; and the actuatable tool comprises a perforating gun having an associated charge.

29. The tool assembly of claim 26, further comprising:

a fishing neck.

30. The tool assembly of claim 26, wherein:

the actuatable tool is a bridge plug configured to form a substantial fluid seal when actuated within the tubular body at the selected location; and the bridge plug comprises an elastomeric sealing element and a set of slips for holding the location of the tool assembly proximate the selected location.

31. The tool assembly of claim 26, further comprising:

an accelerometer in electrical communication with the on-board controller to provide a velocity estimate of the tool assembly when comparing the transformed second CCL log with the first CCL log.

32. The tool assembly of claim 26, wherein:

the casing collar locator comprises a first casing collar locator proximate a first end of the tool assembly;

the tool assembly further comprises a second casing collar locator proximate a second opposing end of the tool assembly, separated a distance d; and the on-board controller is further programmed to:

calculate velocity based upon the distance (d) divided by time (t) in which the first and second casing collar locators respectively traverse a casing collar to provide a velocity estimate of the tool assembly when comparing the transformed second CCL log with the first CCL log.

33. The tool assembly of claim 26, wherein:

the actuatable tool is a casing patch, a cement retainer, or a bridge plug; and the actuatable tool is fabricated from a millable material.

* * * * *